US006004331A

United States Patent [19]

Takeuchi et al.

[11] Patent Number: 6,004,331

[45] Date of Patent: Dec. 21, 1999

[54] DEPILATOR

[75] Inventors: Toshihiro Takeuchi; Jyuzaemon Iwasaki, both of Shiga, Japan

[73] Assignee: Matsushita Electric Works, Ltd., Osaka, Japan

[21] Appl. No.: 09/028,659

[22] Filed: Feb. 24, 1998

[30] Foreign Application Priority Data

| | | | |
|---|---|---|---|
| Feb. 25, 1997 | [JP] | Japan | 9-040320 |
| Sep. 25, 1997 | [JP] | Japan | 9-259173 |
| Nov. 25, 1997 | [JP] | Japan | 9-322623 |

[51] Int. Cl.[6] ..... A61B 17/50

[52] U.S. Cl. ..... 606/133; 606/131

[58] Field of Search ..... 606/133, 131; 452/82, 83, 84, 85

[56] References Cited

U.S. PATENT DOCUMENTS

| | | | |
|---|---|---|---|
| 5,507,753 | 4/1996 | Iwasaki et al. | 606/133 |
| 5,810,843 | 9/1998 | Iwasaki et al. | 606/133 |

FOREIGN PATENT DOCUMENTS

| | | | |
|---|---|---|---|
| 405168523 | 7/1993 | Japan | 606/133 |
| 405168525 | 7/1993 | Japan | 606/133 |
| 7-313243 | 12/1995 | Japan . | |

*Primary Examiner*—Michael H. Thaler
*Attorney, Agent, or Firm*—Armstrong, Westerman, Hattori, McLeland & Naughton

[57] ABSTRACT

A depilator has a casing, a row of tweezers, and a skin tensioner which is driven independently from the skin tensioner. When using the depilator, the user grips the casing of the depilator. The skin tensioner swings back and forth between a home position and a tensioning position, thereby applying an appropriate tension to the skin during the depilation.

The pain caused by plucking hair is reduced. The driving load of the skin tensioner can also be reduced.

29 Claims, 48 Drawing Sheets

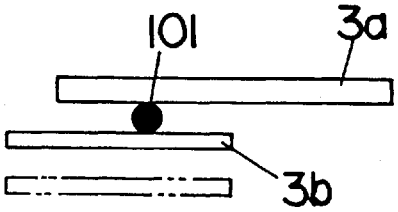
FIG. 24
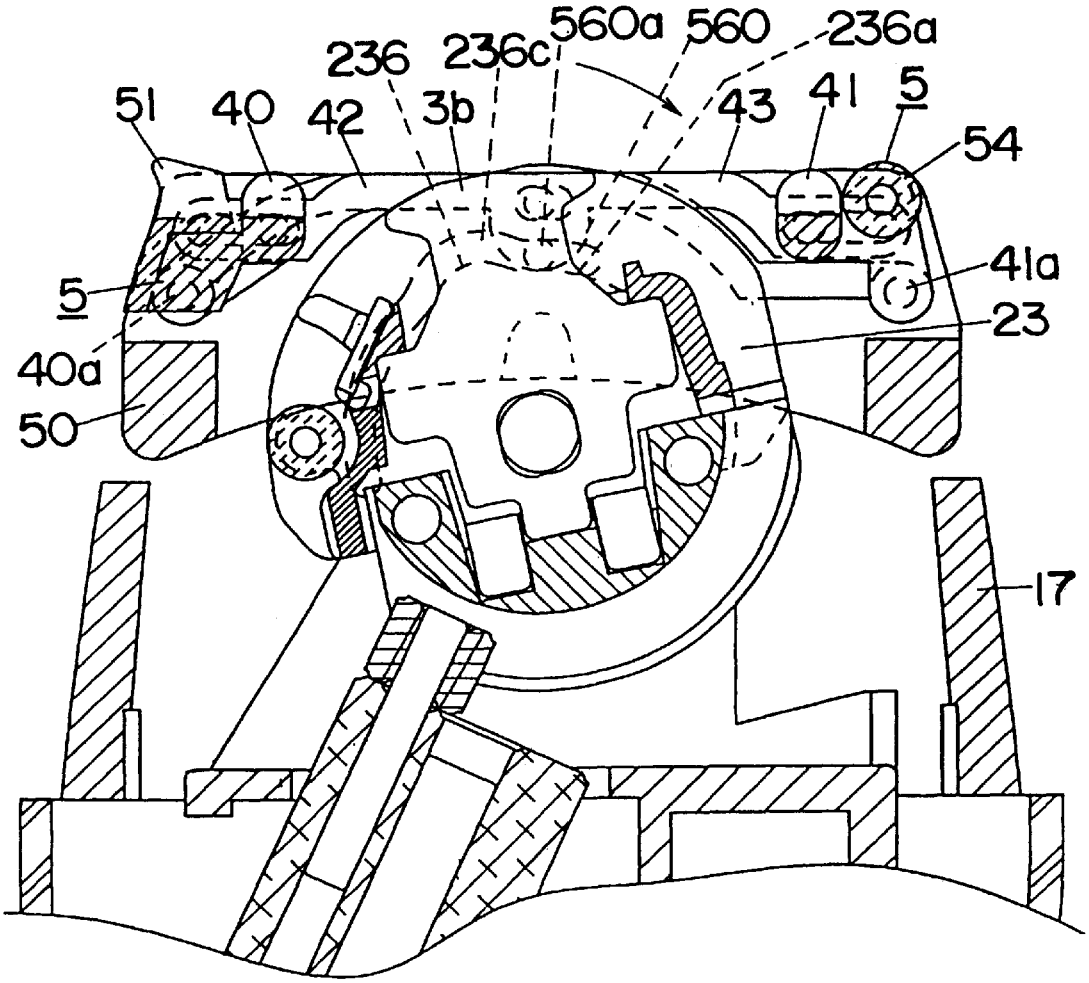

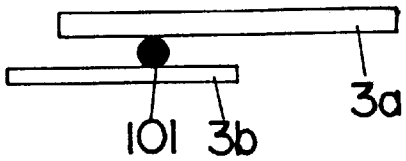
FIG. 25
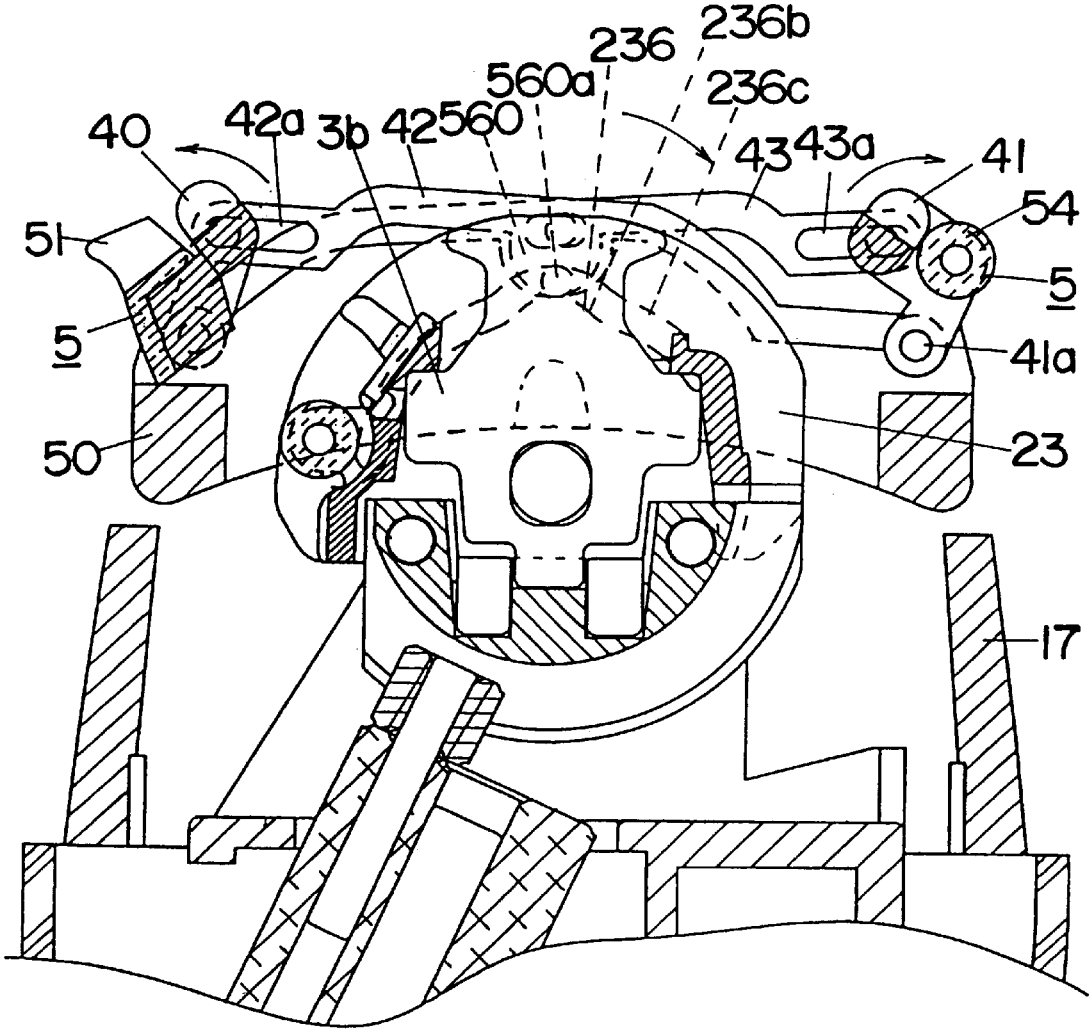

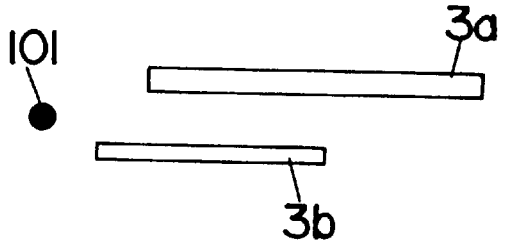
FIG. 28
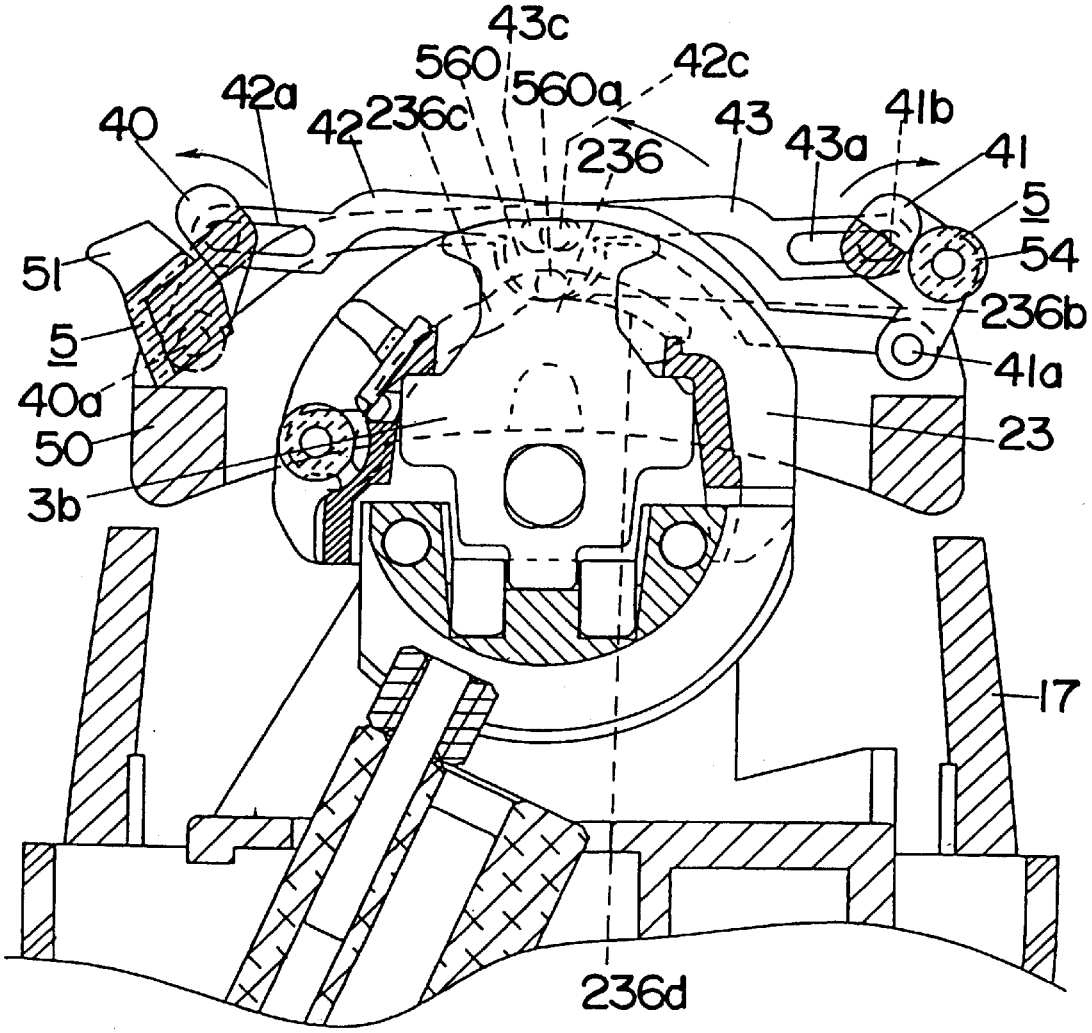

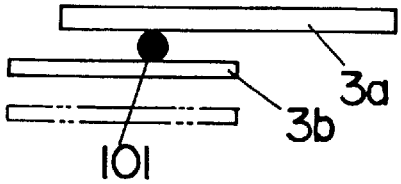
FIG. 29
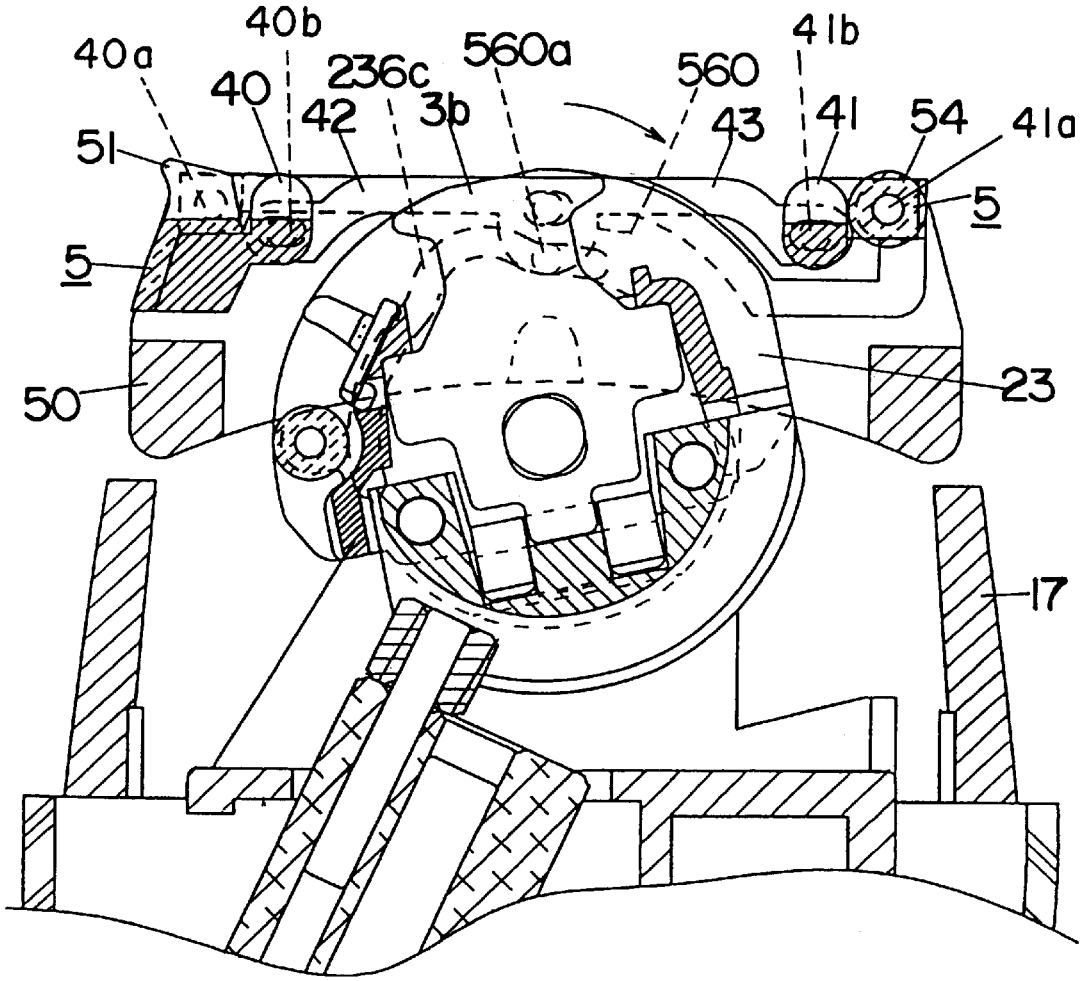

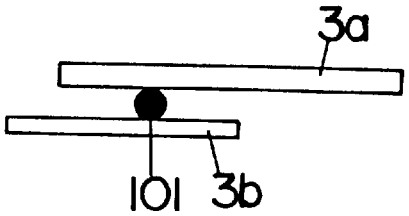
FIG. 30
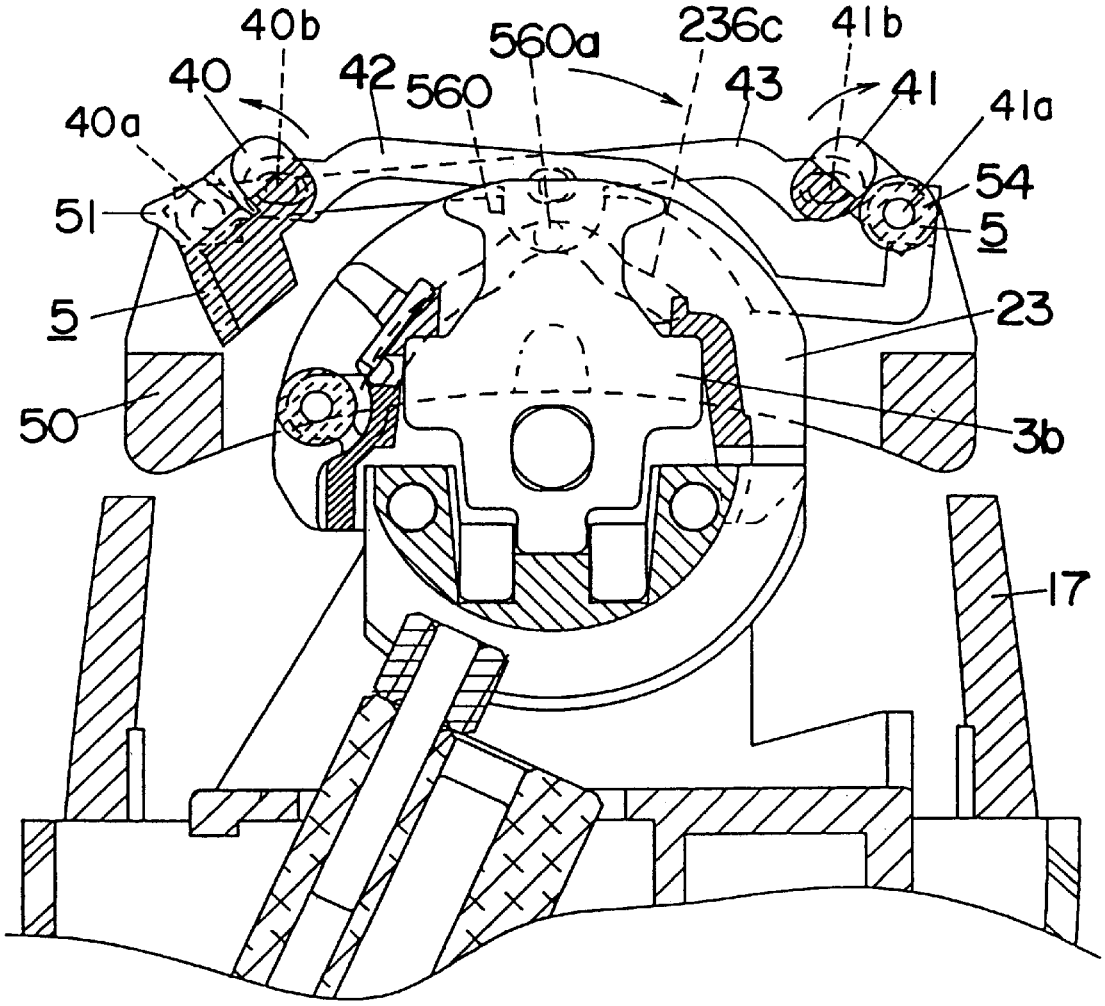

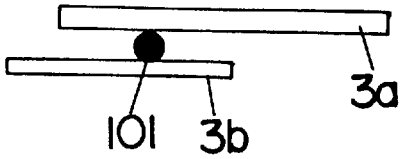
FIG. 31
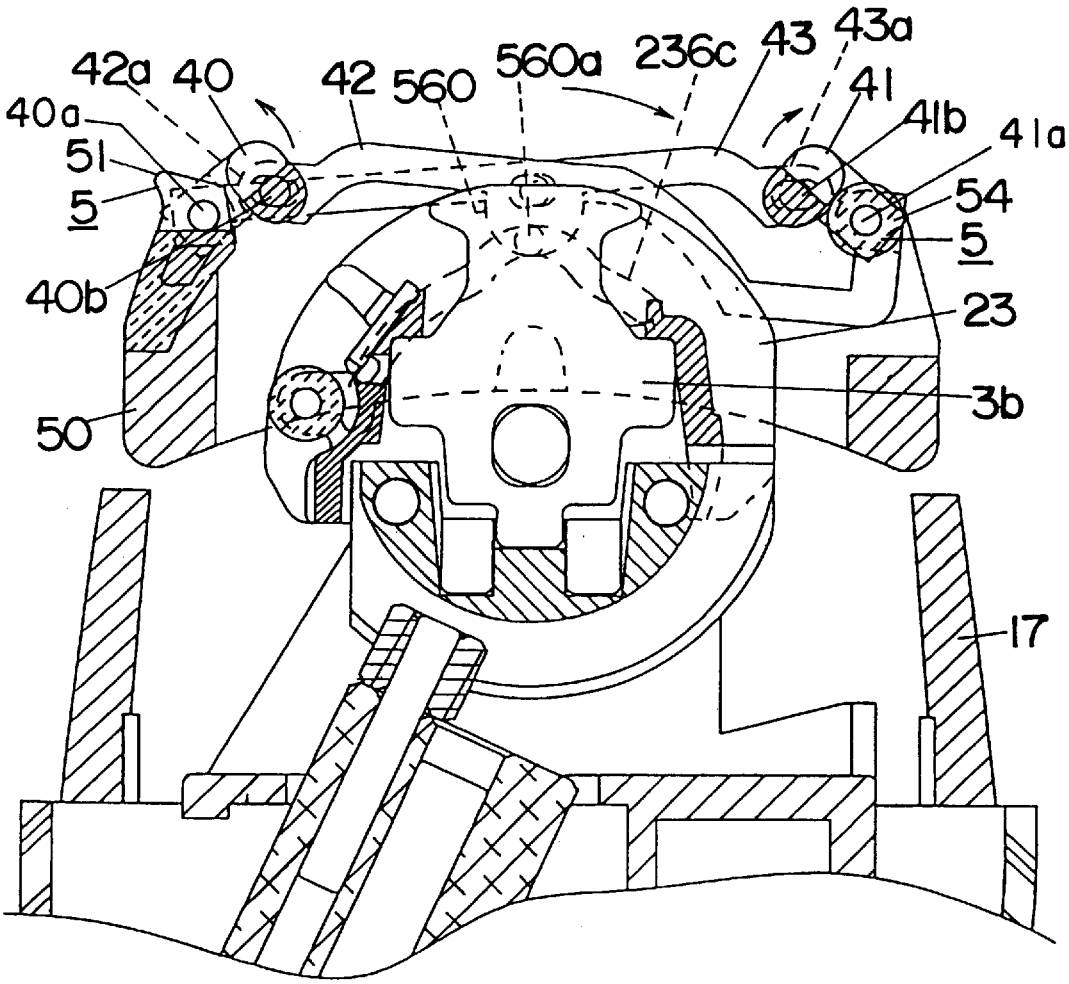

DEPILATOR

BACKGROUND OF THE INVENTION

1. Field of the Invention

The present invention relates to depilators for removing unwanted hairs for cosmetic and aesthetic purposes.

2. Description of the Related Arts

Many types of cosmetic/aesthetic depilators are known. For example, Japanese Patent Application Laid-open No. 7-313243 discloses a depilator which has a rotational skin tensioner along the periphery of the depilator. This depilator removes unwanted hairs, while tensioning the skin using the rotating skin tensioner, thereby reducing stimulus to the skin. In particular, this arrangement can effectively relieve pain caused when the skin is pulled up due to the resistance of the hair.

However, the conventional depilators have some drawbacks. Because the skin tensioner is continuously rotating on the skin surface during use, the skin tensioner's driving load is large and, in addition, relatively long hair is caught in the rotating device.

SUMMARY OF THE INVENTION

This present invention was conceived to overcome the above-described problems of the prior art, and it is an object of the present invention to provide a depilator which can remove unwanted hairs with a small driving load, while reducing both pain to the skin and the resistance of hair during the depilation. It is another object of the invention to prevent hair from being caught in the device.

In order to achieve the above-described objects, the depilator according to the present invention includes a casing, which allows the user to grip the depilator, a row of tweezers for tweezing hair, and a skin tensioner which is driven independently of the tweezers. The skin tensioner swings back and forth between the home position and a tensioning position for tensioning the skin. This arrangement can effectively reduce pain to the skin caused by plucking a hair against the resistance of the hair. Unlike the conventional depilator having a skin tensioner that continuously rotates on the skin surface in one direction, the depilator of the present invention does not catch hairs in the skin tensioner because of the pivoting motion of the skin tensioner.

The skin tensioner may include a tensioning piece, which has a pivot shaft and swings about the pivot shaft between the home position and the tensioning position. This arrangement can prevent hairs from being caught in the skin tensioner, while the skin is reliably tensioned.

The skin tensioner may also include a coupling arm for supporting the tensioning piece. The tensioning piece is connected to first end of the coupling arm, so that the tensioning piece can swing about a fulcrum. The second end of the coupling arm pivots about other fulcrum. The pivot shaft of the tensioning piece is positioned farther from the tweezers than the connecting point of the tensioning piece to the coupling arm. When a driving force is applied to the coupling arm, the tensioning piece swings, whereby the skin is tensioned more effectively.

An elongated hole may be formed in the end of each coupling arm. The pivot shaft of the tensioning piece may be inserted into the elongated hole so that the pivot shaft slides along the elongated hole. When a driving force is applied to the coupling arm, the tensioning piece swings about the fulcrum, while the pivot shaft is sliding along the elongated hole, which allows the tensioning piece to swing smoothly.

It is preferable to provide a point of application for a driving force for driving the coupling arm in the middle of the coupling arm between the two ends. When the driving force is applied to the point of application in order to drive the coupling arm, the tensioning piece moves twice as much as the displacement of the point of application, whereby a sufficient amount of swing of the tensioning piece is obtained.

The tensioning piece may be formed monolithically with the coupling arm and an elastic hinge may be formed therebetween. The elastic hinge allows the tensioning piece to swing about a fulcrum when the driving force is applied to the coupling arm. The other end of the coupling arm pivots about another fulcrum. This arrangement can reduce the number of parts used in the skin tensioner. In addition, the elastic hinge used between the coupling arm and the tensioning piece can greatly reduce noise during the depilation.

The tweezers may include a depilation block, which swings back and forth or rotates about a rotational shaft. A driving force is transferred from the depilation block to the tensioning pieces, and the tensioning pieces swing in opposite directions in response to the driving force from the depilation block.

The driving force may be transferred through an oscillator to the coupling arm which makes the tensioning piece swing. In this arrangement, the skin is effectively tensioned with a simple structure.

The tensioning piece of the skin tensioner may slide back and forth (or reciprocate) in opposite directions on the skin surface along a direction substantially parallel to the motion of the depilator. This arrangement can prevent hair from being caught in the skin tensioner. In addition, the tensioning piece appropriately tensions the skin at the same level as the tweezers without pressing the skin too hard.

The coupling arm may be formed monolithically with the tensioning piece and an elastic hinge may be locate between the coupling arm and the tensioning piece. In this case, an elongated hole is formed in the casing so as to receive the pivot shaft of the tensioning piece and allow the pivot shaft to slide along the elongated hole. With this simple arrangement, the tensioning piece reciprocates smoothly when a driving force is applied to the coupling arm.

Because of the above-described structure, the driving force is transferred from the depilation block to the coupling arm. This makes the tensioning pieces reciprocate smoothly.

The driving force may be transferred through oscillators to the coupling arm. This causes the tensioning pieces to reciprocate even more smoothly.

The skin tensioner may have a single tensioning piece that moves along a loop in a plane perpendicular to the skin. This looping motion effectively prevents hairs from being caught in the skin tensioner. It also allows the skin to be tensioned reliably while the tweezers are plucking hairs and at the sometime allows the number of components used in the depilator to be reduced.

In this case, an elongated hole is formed in one end of the coupling arm, and an eccentric pin is provided on the rotational axis of the coupling arm. A first end of the coupling arm is connected to the tensioning piece by inserting a pin into the elongated hole. A second end of the coupling arm is supported by the rotational axis via the eccentric pin. In this arrangement, as the eccentric pin moves, the tensioning piece moves along a loop in a plane perpendicular to the skin, and the skin is reliably tensioned.

The depilator may have a gear having an eccentric pin. As the gear rotates, the eccentric pin moves, which causes the tensioning piece to tension the skin. Slow rotation of the gear can transfer a large power to the tensioning piece and, in addition, appropriate tension can be applied to the skin several times in one depilation cycle.

If a pair of tensioning pieces are used, it is preferable to provided them in front of and behind the row of tweezers. The row of tweezers is arranged perpendicular to the direction in which the depilator advances. The tensioning pieces tension the skin in opposite directions in front of and behind the tweezers, whereby the tweezers can reliably nip and pluck unwanted hair without causing unpleasant stimulus to the skin.

The tensioning pieces are designed so as to project toward the skin in order to achieve a reliable tensioning motion.

Each of the tensioning pieces has a fulcrum, about which the tensioning piece pivots, and these tensioning pieces are connected to each other by elongated holes and pins. This arrangement can achieve a smooth movement of the tensioning pieces.

The tensioning pieces are positioned in front of and/or behind the tweezers. In addition, skin supporters are fixed outside the tensioning piece. The skin is tensioned in a direction away from the tweezers in order to reduce pain or unpleasant stimulus to the skin.

The skin supporters control the tension applied to the skin by the tensioning pieces by adjusting the height of the skin supporters with respect to the top surface of the connecting frame of the depilator. The position of the skin tensioner relative to the skin supporter varies as the height of the skin supporter is changed, whereby the tension applied to the skin can be adjusted to a desired level. For example, in soft areas of the body, more tension is applied to the skin in order to allow the tweezers to reliably nip hairs. However, if the user feels discomfort due to that tension, the height of the skin supporter is increased to reduce the tension. Thus, tension applied to the skin can be adjusted to a desired level.

The height of the skin supporter is adjusted by, for example, sliding a handle in the lateral direction, which can easily adjust the tension.

The tensioning piece and the associated skin supporter are placed together inside the connecting frame of the depilator. In this case, the skin supporter is positioned parallel to and outside the tensioning piece. The skin is appropriately tensioned inside the skin supporter under the control of the skin supporter.

It is preferable to provide comb-like projections on the top of the skin supporter. The projections comb hairs and make the hairs stand erect prior to the depilation so that the tweezers can nip the roots of the hairs.

The projection is made of, for example, an elastic material in order to avoid an unpleasant stimulus to the skin.

In contrast, the bottom portion of the skin supporter is made of a hard material. This portion functions as a base mechanism for the vertical motion of the skin supporter. A mechanism for adjusting the height of the skin supporter is placed under the hard part of the skin tensioner.

The skin supporter for controlling the tension of the tensioning piece is floatable from the connecting frame of the depilator. This floatable structure allows the skin supporter to smoothly trace the skin surface.

The tweezers repeat a depilation cycle, which includes approaching a hair, nipping the hair, plucking the hair, and releasing the plucked hair. The depilation cycle is associated with a skin tensioning cycle so as to effectively relieve pain or unpleasant stimulus to the skin.

It is preferable that the skin is tensioned at least during the period of time the hair is being plucked because the plucking of the hair causes most of the pain to the skin. By applying appropriate tension to the skin to expand the skin surface, the pain can be relieved.

It is also preferable to tension the skin at least during the period of time that the hair is approached in order to allow the tweezers to reliably nip the root of the hair.

BRIEF DESCRIPTION OF THE DRAWING FIGURES

The above and other objects, features, and advantages of the present invention will be apparent from the detailed description which follows with reference to the attached drawing figures wherein:

FIG. 24 illustrates the top portion of the depilator, in which the tweezers have nipped the hair while the skin is not tensioned;

FIG. 25 illustrates the top portion of the depilator, in which the tweezers are tweezing the hair while the skin is tensioned;

FIG. 28 illustrates a second example of the top portion of the depilator, in which the tweezers are advancing to a hair while the skin is tensioned;

FIG. 29 illustrates a second example of the top portion of the depilator, in which the tweezers haves nipped the hair while the skin is not tensioned;

FIG. 30 illustrates a second example of the top portion of the depilator, in which the tweezers are tweezing the hair while the skin is tensioned;

FIG. 31 is a third example of the top portion of the depilator, in which the tweezers are tweezing a hair while the skin is tensioned;

DETAILED DESCRIPTION OF THE INVENTION

Figure 1:
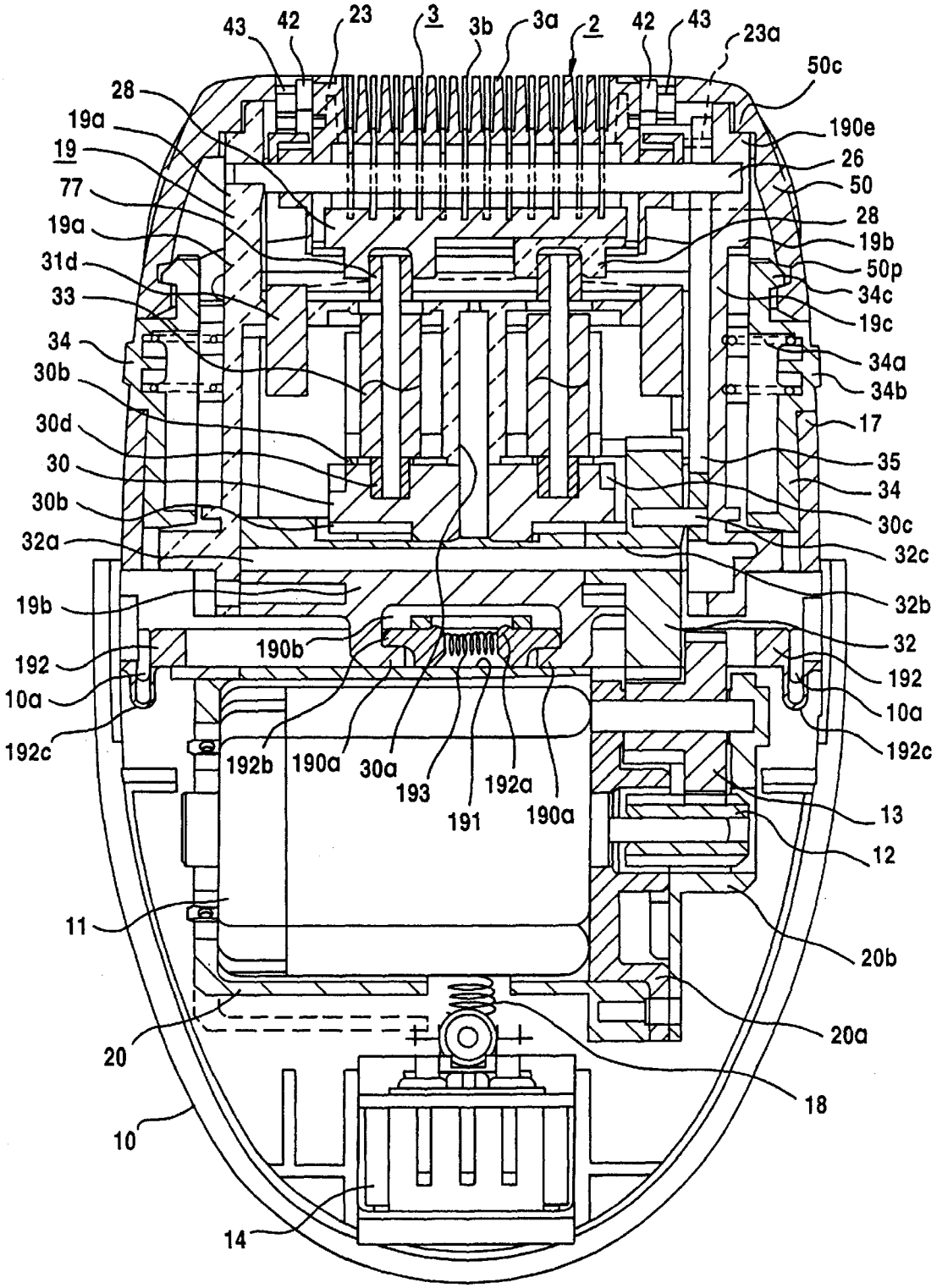
FIG. 1 is a cross-sectional front view of the depilator according to an embodiment of the present invention.
Figure 2:
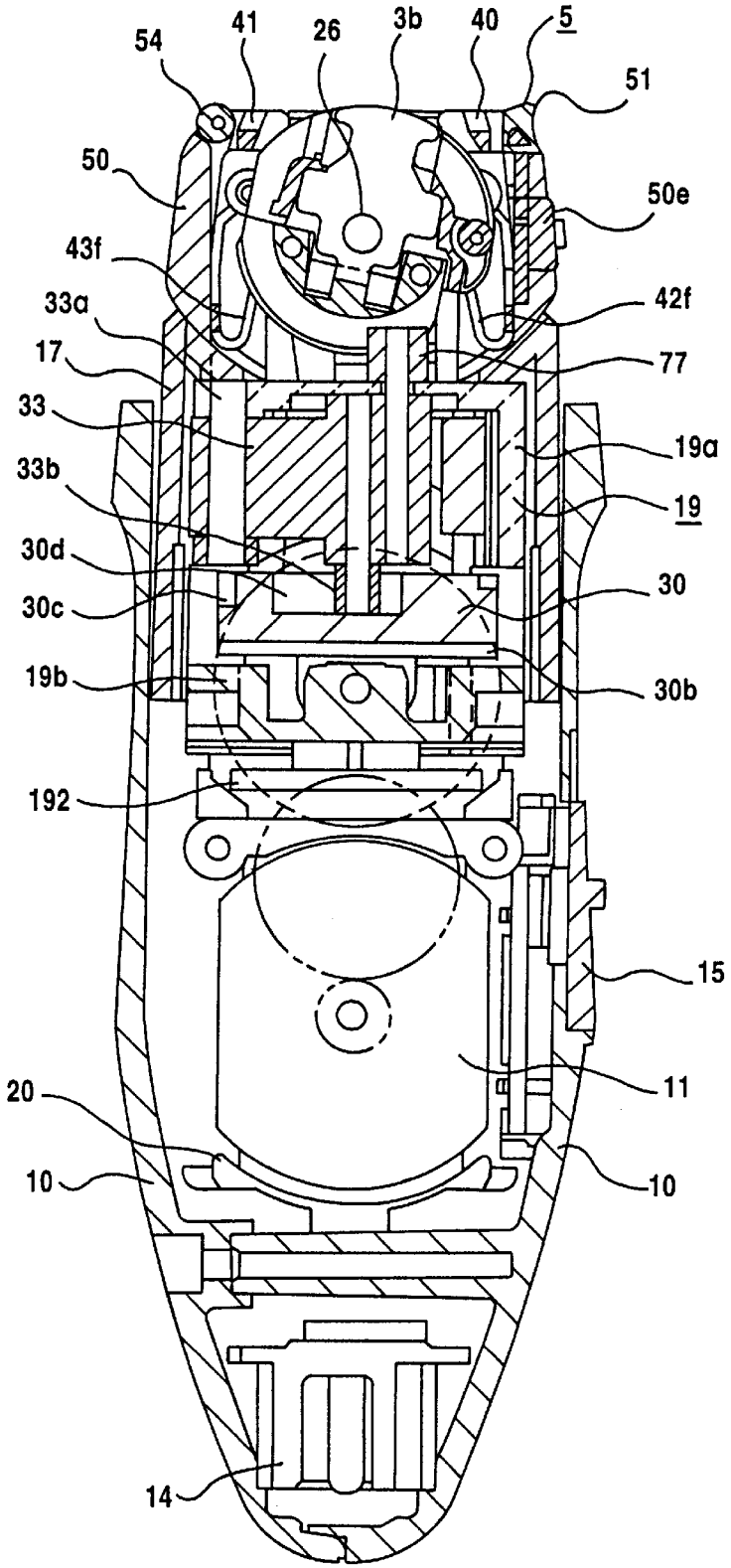
FIG. 2 is a cross-sectional side view of the depilator shown in FIG. 1 taken along a first line.

The preferred embodiments of the invention will now be described with reference to the attached drawing figures.

First Embodiment

FIGS. 1 through 10 illustrate the depilator according to a first embodiment. A driving unit 6 is housed in a casing 1. Tweezers 3 are provided above the driving unit 6 and a pair of skin supporters 5, which are surrounded by a connecting frame 50, are provided above the casing 1. The skin supporters 5 are placed in front of and behind the row of tweezers 3. The casing 1 consists of a housing 10 and a sub-housing 17 which is movably inserted into the top portion of the housing 10. The housing 10 includes a front wall and a rear wall. The housing 10 serves as a grip. A power source jack 14 is placed on the bottom of the housing 10, and a switch 15 is provided on the side of the housing 10.

Figure 5:
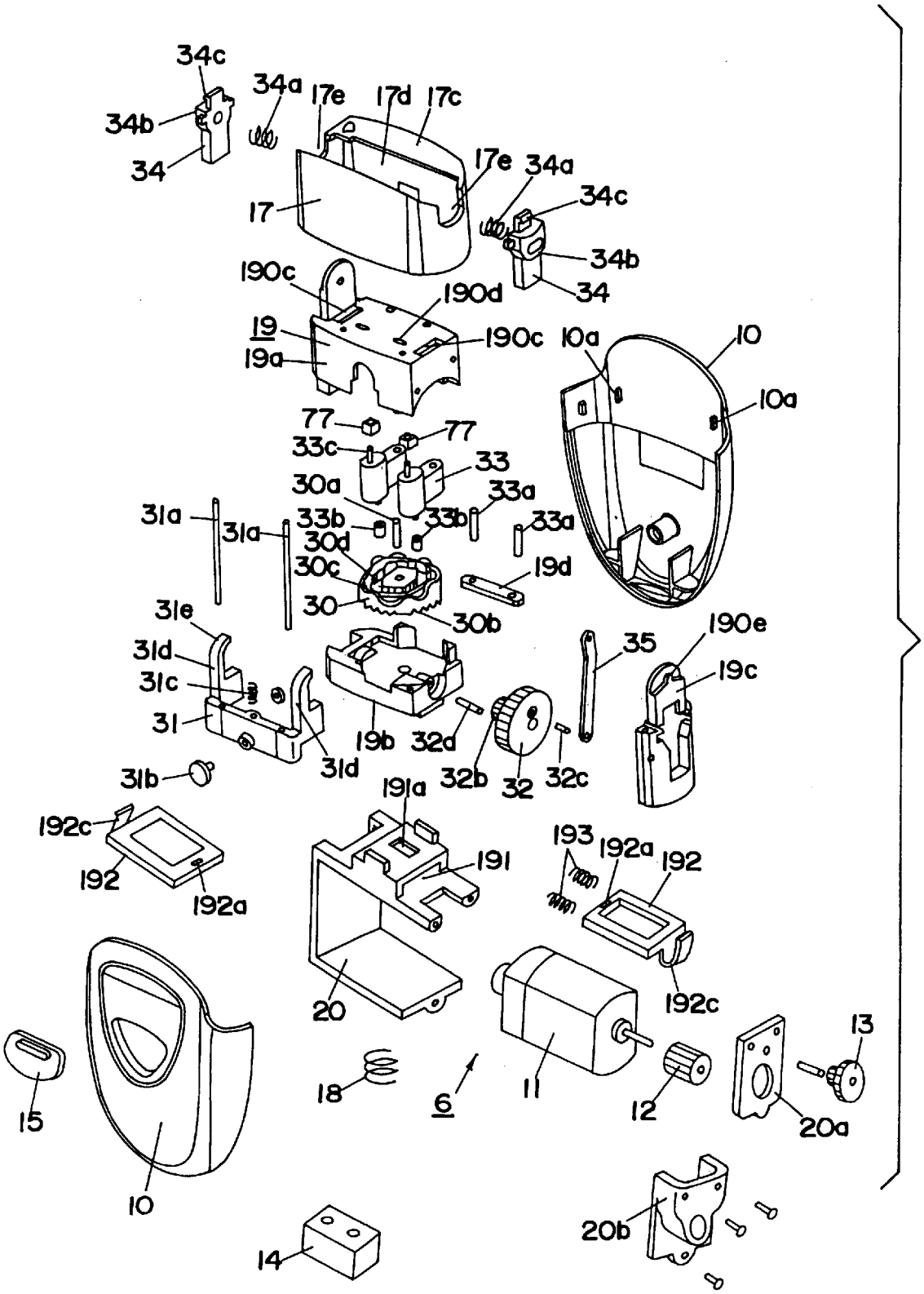
FIG. 5 is an exploded view of the depilator of FIG. 1, showing the casing and the inner parts.

The driving unit 6 is movable in the vertical direction in FIG. 1 inside of the housing 10. A spring 18 is provided under the driving unit 6, whereby the driving unit is forced upwardly so as to float in the housing 10. As shown in FIG. 5, the driving unit 5 has a frame 19 which includes a top wall 19*a*, a bottom wall 19*b*, and side walls 19*c*. A motor frame 20 is attached to the bottom of the frame 19.

In order to attach the motor frame 20 to the frame 19, a slot 190*b*, which opens downwardly, is formed on the bottom surface of the bottom wall 19*b* of the frame 19. Flanges 190*a* extend from both edges of the slot 190*b*. The top face of the motor frame 20 has a rectangular tunnel 191, and attachments 192 are inserted into the tunnel 191 from both sides. The attachments 192 are slidable in the tunnel 191, and forced in opposite directions by springs 193 positioned between the two attachments 192. A hole 191*a* is formed on the top of the tunnel 191, while each of the attachments 192 has a small upward projection 192*a* and a downward projection 192*b* at one end. The small upward projection 192*a* abuts against the inner wall of the hole 191*a* so that the attachment 192 does not come out of the tunnel 191. When the tunnel 191 is fit into the slot 190*b*, the downward projection 192*b* of each of the attachments 192 abuts against one of the flanges 190*a* of the slot 190*b*, whereby the motor frame 20 is fixed to the bottom wall 196 of the frame 19.

The other end of the attachment 192 is provided with an elastic J-shaped arm 192*c*, which is hooked on an attachment 10*a* formed in the inner wall of the housing 10. The elasticity of the J-shaped arm 192*c* allows the driving unit 6, which is forced upwardly by the spring 18, to move up and down inside the casing 1.

Figure 3:
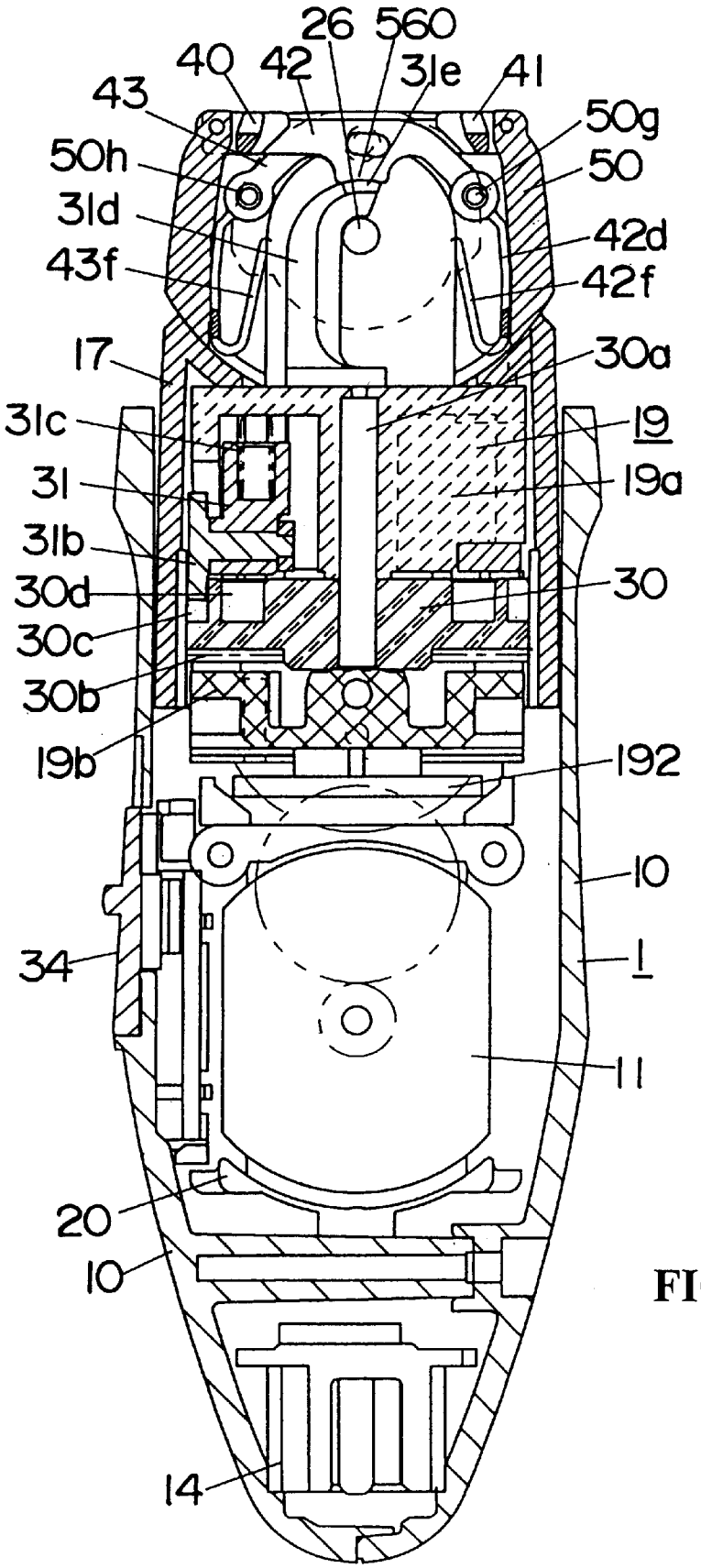
FIG. 3 is a cross-sectional side view of the depilator of FIG. 1 taken along a second line.
Figure 4:
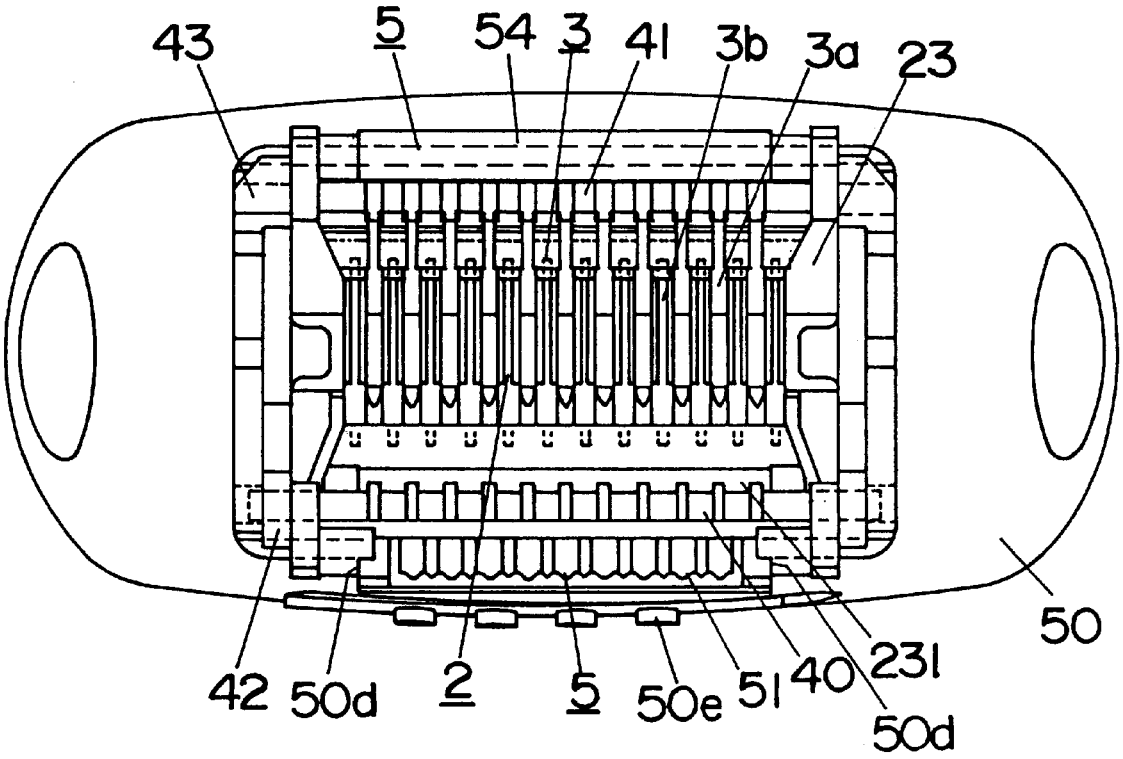
FIG. 4 is a top view of the depilator shown in FIG. 1.

As shown in FIGS. 1, 3, and 5, a motor 11 is accommodated in the motor frame 20. The motor 11 has an output shaft which receives a pinion 12. The pinion 12 projects from the hole in a side frame 20*a* attached to the side of the motor frame 20, and is engaged with an intermediate gear 13 outside of the side frame 20*a*. The pinion 12 and the intermediate gear 13 are covered with a gear cover 20*b* attached to the outside of the side flame 20*a*.

A cam 30, which is rotatable about a cam shaft 30*a*, is placed in the frame 19. The cam 30 has a face gear 30*a* on a bottom face thereof. As shown in FIG. 10, annular cam 30*c* is provided on the top face the cam 30 along a periphery thereof. The height (i.e., the level) of the annular cam 30*c* differs depending on the position that the annular cam 30*c* is provided on the top face of the cam 30. A irregularly circular cam groove 30*d* is also formed in the top face of the cam 30.

As shown in FIGS. 3 and 5, an oscillator 31 is attached to the frame 19 via vertical axes 31*a* so that the oscillator 31 is movable in the vertical direction. A vibrating roller 31*b* is rotatably attached to the oscillator 31. The oscillator 31 is forced downwardly by a spring 31*c*, whereby the vibrating roller 31*b* comes into contact with the top surface of the annular cam 30*c* having a height which varies along a circumference thereof. Arms 31*d* project upwardly from both ends of the oscillator 31. The top end 31*e* of each arm 31*d* is slightly curved, and projects out of the top wall 19*a* of the frame 19 through a hole 190*c*.

As shown in FIGS. 1 through 3 and 5, a driving gear 32 is attached to the bottom wall 19*b* of the frame 19 so as to be rotatable about a shaft 32*a*. The driving gear 32 is meshed with the intermediate gear 13. The driving gear 32 has a gear 32*b* which is meshed with the face gear 30*b* of the cam 30.

As the motor 11 rotates, the cam 30 rotates via the gear group, which causes the oscillator 31 to move along the top surface of the annular cam 30*c*, while changing a vertical position thereof according to the height of the annular cam 30*c*. As the oscillator 31 moves up and down along the annular cam 30*c*, the arms 31*d* also move in the vertical direction.

Figure 10A:
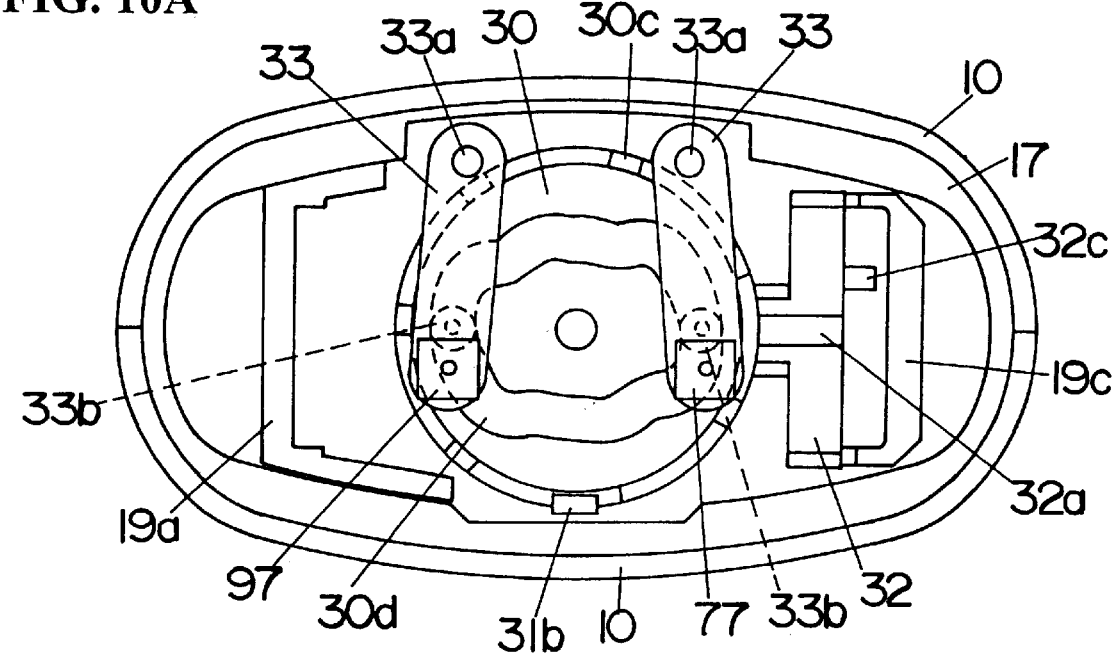
FIGS. 10A and 10B are horizontal cross-sectional views of the depilator of FIG. 1, showing a pair of levers pivoted by a rotational cam.
Figure 10B:
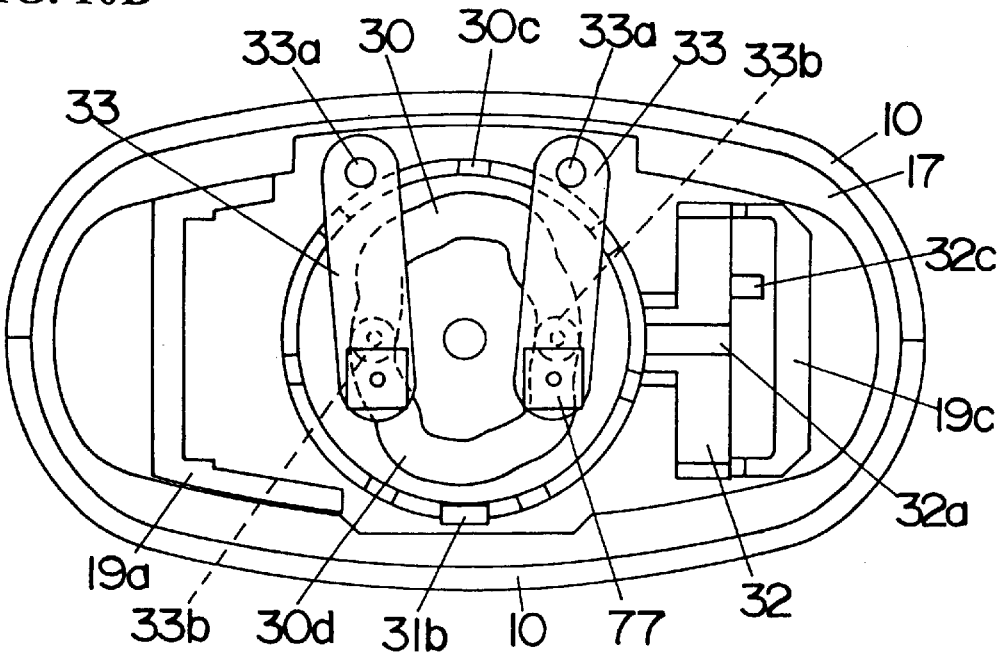

A pair of levers 33 are provided above the face gear 30*b*. Each lever 33 is pivotable about the pivot shaft 33*a* fixed to the frame 19. The upper end of the pivot shaft 33*a* is inserted into the hole formed in the top wall 19*a* of the frame 19, while the lower end of the pivot shaft 33*a* is inserted into the hole formed in the support plate 19*d* which is attached to the bottom wall 19*b* of the frame 19. A vertical axis 33*c* extends through the pivoting part of each of the levers 33, and projects downwardly and upwardly from the bottom and top surfaces, respectively, of the pivoting part. A roller 33*b* receives the lower end of the vertical axis 33*c*, which projects from the bottom surface of each of the levers 33, in such a manner that the roller 33*b* is rotatable about the vertical axis 33*c*. The upper end of the vertical axis 33*c* is movably inserted into an elongated hole 190*d* formed in the top wall 19*a* of the frame 19. A driving die 77 is rotatably attached to the top end of the vertical axis 33*c*. The roller 33*b* is fit into the cam groove 30*d* of the cam 30. As the cam 30 rotates, both of the levers 33 and the driving die 77 swing. As shown in FIG. 10, the cam groove 30*d* is designed so as to cause the levers 33 to swing at the same time in opposite directions. In one rotation of the cam 30, the levers 33 swing twice between the open position, where the rollers 33*b* are away from each other, as shown in FIG. 10A, and the closed position, where the rollers 33*b* approach closest to each other, as shown in FIG. 10B.

As shown in FIGS. 1 and 5, surrounding the frame 19, the lower end of the sub-housing 17 is screwed on the frame 19. The sub-housing 17 has an opening 17*d* on the top face, and U-shaped cut-away portions 17*e* on both sides of the side wall. There is a gap between the housing 17 and the frame 19, and a pair of release buttons 34 and springs 34*a* are provided on both sides of in this gap so that the supporting legs of the release buttons 34 are pressed against the inner wall of the housing 17 by the springs 34*a*. The buttons 34*b* of the release buttons 34 are exposed by the U-shaped cut-away portions 17*e*.

Figure 6:
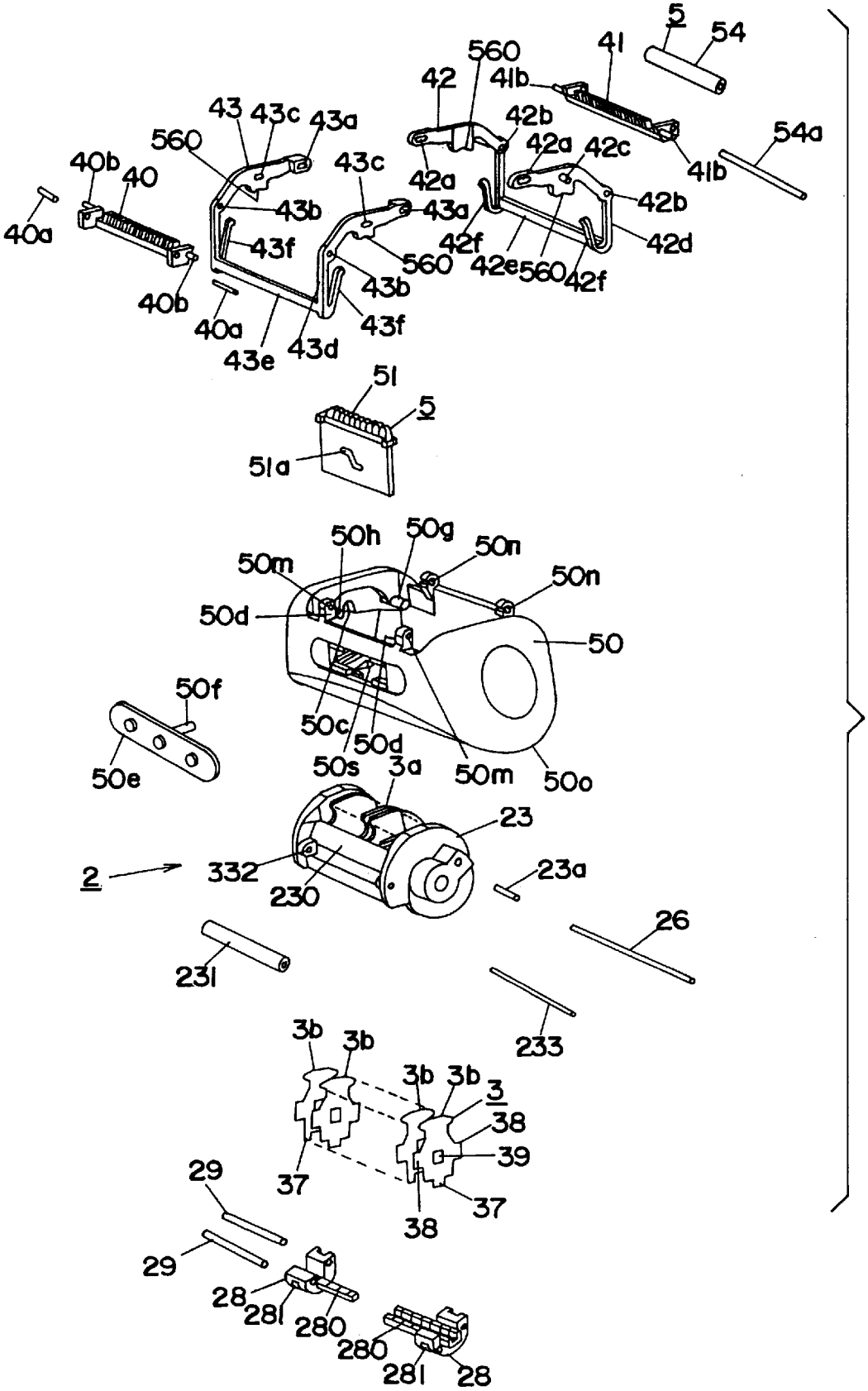
FIG. 6 is an exploded view showing the depilation block and the skin tensioner used in the depilator of FIG. 1.
Figure 7:
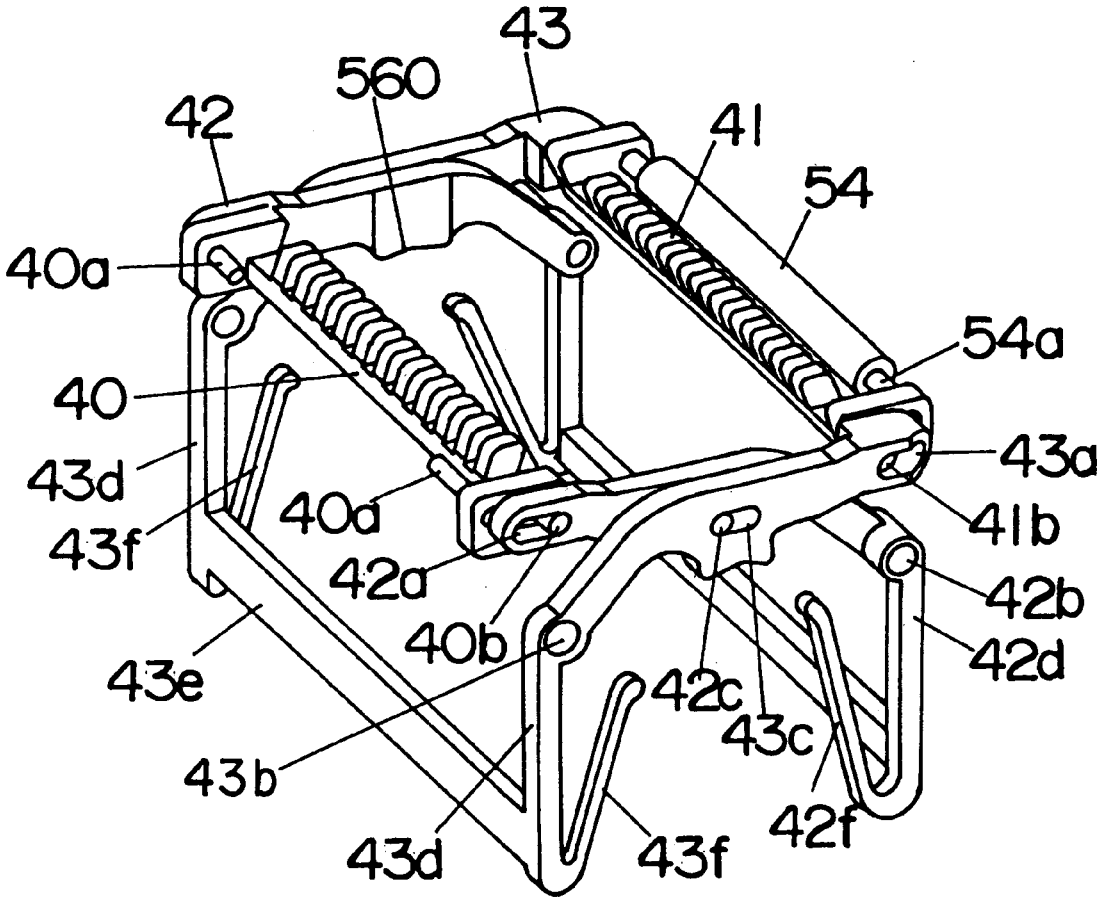
FIG. 7 is a perspective view of the skin tensioner, in which the tensioning pieces are in a home position where the skin is not tensioned.
Figure 8:
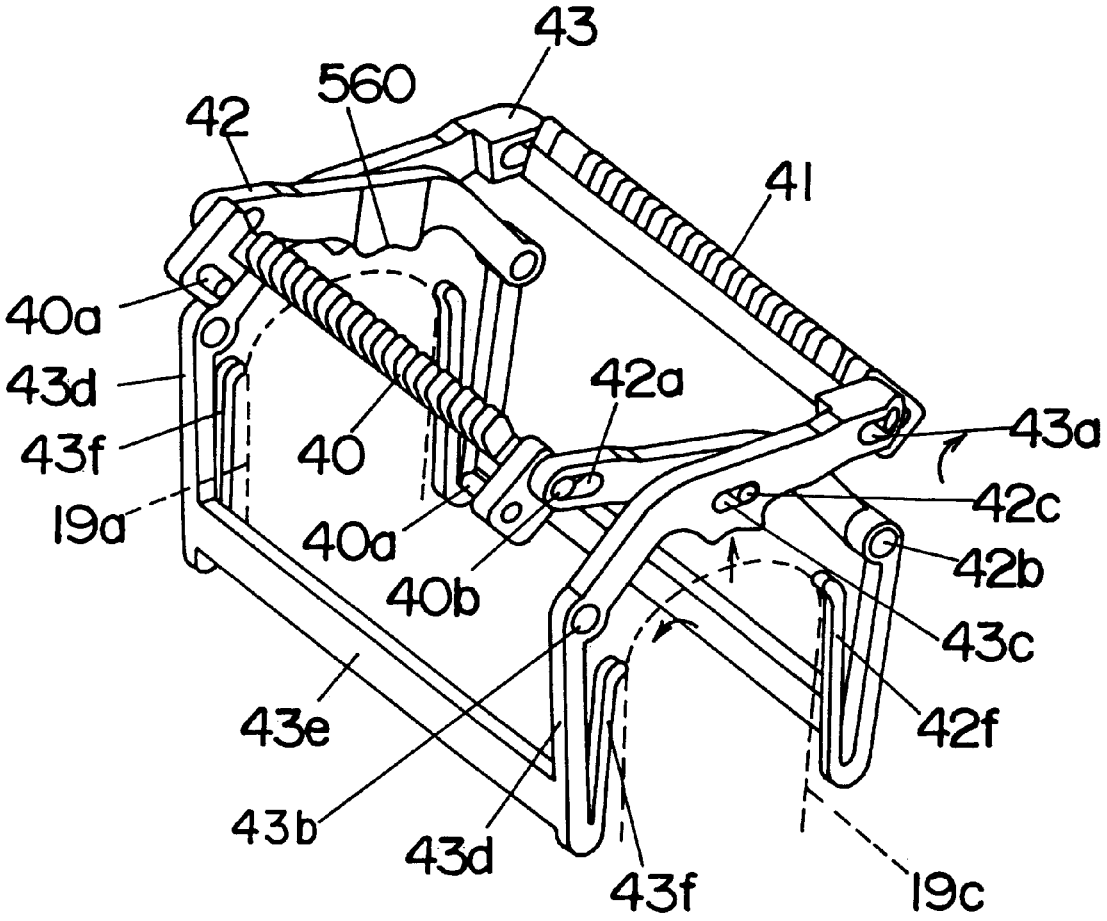
FIG. 8 is a perspective view of the skin tensioner, in which the tensioning pieces are in a tensioning position where the skin is tensioned.

A connecting frame 50 is attached to the top of the sub-housing 17. As shown in FIG. 6, the connecting frame 50 is a frame-like wall with openings on the top and the bottom, and has a rounded lower end 50*o*. Arch-shaped grooves 50*p* are formed in the inner surface of the connecting frame 50 in the lower portion of both sides. Axes 50*c* also extend from the inner surface of the connecting frame 50 on both side. The rounded lower end 50*o* is mounted on the arched top end 17*c* of the sub-housing 17, and the axes 50*c* are inserted into the supporting shafts 190*e* which horizontally project from the top of the side walls 19*c* of the frame 19. In this state, projections 34*c*, formed on the top of the release buttons 34, are fit into the arch-grooves 50*p*, whereby the connecting frame 50 is fixed to the sub-housing 17. The connecting frame 50 can move up and down together with the frame 19 to which the sub-housing 17 is fixed. In addition, the connecting frame 50 can swing about the axes 50*c* and the supporting shaft 190*e*. As the connecting frame 50 swings, the projections 34*c* move along the arch-shaped grooves 50*p* so as not to prevent the swinging motion of the connecting frame 50.

When detaching the connecting frame 50, the buttons 34*b* of the release buttons 34 are pressed from both sides against the springs 34*a* in order to disengage the projections 34*c* from the arch-shaped grooves 50*p*.

Next, the depilation block 2 will be explained. The depilation block 2 is positioned above the frame 19. As shown in FIGS. 1 through 4 and 6, a rotating body 23 is supported by a pivot axis 26 which extends between the side walls 19*c* of the frame 19. The rotating body has a row of tweezers 3 and a pair of sliders 28 which are positioned on the bottom of the rotating body 23. Each of the sliders 28 receives the pivoting motion of the associated driving die 77 and the associated lever 33 to drive the tweezers 3. The sliders 28 are slidable along a pair of sliding axes 29 in a direction parallel to the pivot axis 26, and move laterally with respect to the rotating body 23.

The tweezers 3 in the depilation block 2 consist of a plurality of fixed blades 3*a*, which are arranged in a row at a predetermined interval in a direction parallel to the axis of the rotating body 23, and a plurality of movable blades 3*b* positioned between two adjacent fixed blades 3*a*. Each of the movable blades 3*b* has side projections 38 extending from the side edges and bottom projections 37 extending from the bottom edge. There are two types of movable blades 3*b* which are different from each other in number and in the position of the bottom projections. One type of movable blade 3*b* has two bottom projections on both ends of the bottom edge, while the other type of movable blade 3*b* has a bottom projection in the middle of the bottom edge. These two types of movable blades 3*b* are alternately arranged in a row. The side projections are supported by the rotating body 23 so that the movable blades 3*b* are pivotable about axes perpendicular to the axis of the rotating body 23. Each of the movable blades 3*b* has a center hole 39, through which the pivot axis 26 is inserted.

The sliders 28, which are attached to the rotating body 23 in a slidable fashion, overlap with each other in the axial direction. The sliders 28 are slid by the levers 33 in opposite directions. One of the sliders 28 causes every other movable blade 3*b* to pivot in one direction at a time, while the other slider 28 causes the rest of the movable blades 3*b* to pivot in the opposite direction at a time. One of the sliders 28 has a groove 280 for receiving the single bottom projection of every other one of the movable blades 3*b*, while the other slider 28 has two parallel grooves 280 for receiving the double bottom projections of the rest of the movable blades 3*b*. Each slider 28 has a groove 281 on a curved bottom face thereof, which defines an arch extending about the pivot axis 26. The driving dies 77 of the pair of levers 33 are fit into the grooves 281.

The rotating body 23 has a long cavity in front of the fixed blades 3*a*, which accommodates a rotating roller 231 via the axis 233 which is inserted into the hole 332 formed in front of the row of movable blades 3*a*. The axis 233 may be inserted in and fixed to the roller 231, and the hole 332 may receive the axis 233 in such a manner that the axis 233 is rotatable in the hole 332. The rotating roller 231 can compensate for the sliding friction which occurs in the lib of the rotating body 23. The rotating roller 231 rolls on the skin surface with a soft touch immediately after the tweezers 3 have plucked the hairs, whereby unpleasant the stimulus due to the depilation is relieved.

The driving unit 6 accommodated in the frame 19 has a vertically extending lever 35. As shown in FIGS. 1 and 5, the lower end of the lever 35 is rotatably fixed to the eccentric shaft 32*c* of the driving gear 32, while the upper end of the lever 35 is rotatably fixed to the eccentric shaft 23*a* of the rotating body 23. When the driving gear 32 rotates in response to the driving force of the motor 11, the rotating body 23 swings back and forth about the pivot axis 26 at a predetermined rotational angle. The rotating body 23 swings between two dead centers, namely, a roller-up position where the rotating roller 231 is located in the middle of the top opening of the sub-housing 17, and a tweezers-up position where the movable blades 3*b* are located in the same position. During the swing of the rotating body 23, the levers 33 repeat pivoting about the respective pivot axes 33*a* in opposite directions, which causes the pair of sliders 28 of the depilation block 2 to reciprocate in opposite directions. At this time, any two adjacent movable blades 3*b* swing in opposite directions so that two movable blades 3*b* alternately contact and then separate from the fixed blade 3*a* positioned between them. The first and last fixed blades 3*a*, which are positioned at both ends of the row of tweezers 3, are slightly thicker than the rest of the fixed blades 3*a* so as to have mechanical strength because the movable blades 3*b* positioned next to the first and last fixed blades 3*a* abut these fixed blade 3*a* only from one direction.

The cam groove 30*d* is designed so that each of the movable blades 3*b* swings back and forth once while the depilation block 2 pivots about the pivot axis 26 twice. In other words, each movable blade 3*b* moves from one of the two adjacent fixed blades 3*a* to the other of the two adjacent fixed blades 3*a*, while the depilation block 2 pivots once.

As shown in FIG. 10, each of the levers 33 pivots twice during a rotation of the cam 30. By setting the ratio of the number of the gear teeth of the gear 32*b* and the face gear 30*b* to 1:4, the pivoting motion of the rotating body 23 is always in agreement with the timing of nipping hairs.

When the rotating body 23 is at the tweezers-up position, which is one of the dead centers of the pivoting motion about the pivot axis 26, the movable blades 3*b* come into contact with the adjacent fixed blades 3*a*. When the rotating body 23 is at the other dead center, the movable blades 3*b* are slightly away from the fixed blades 3*a*.

In other words, when the rotating roller 231 is away from the skin in response to a pivoting motion of the depilation block 2, the fixed blades 3*a* and the movable blades 3*b* approach the skin very closely to nip the roots of hairs. As the depilation block 2 pivots in the opposite direction while the fixed and movable blades 3*a* and 3*b* are still nipping the hairs, the hairs are plucked. When the rotating roller 231 comes into contact with the skin at the other dead center, the tweezers 3 are open and the plucked hairs are released.

In the first embodiment, the depilation cycle consists of a series of regular movements, advancing toward the hair with the tweezers 3 open, nipping the hair with the tweezers 3 closed, plucking the hair during the pivoting motion of the rotating body 23 in the opposite direction, and releasing the plucked hair by opening the tweezers 3. Accordingly, the skin is stimulated at a regular interval during the depilation.

In order to reduce unpleasant stimulus, a skin supporter 5 and a skin tensioner are provided to the depilator of the present invention. In the first embodiment, the depilation block 2, which includes the row of tweezers 3, is surrounded by the connecting frame 50, as shown in FIGS. 4, 6, 7, 8, 13 and 14. Skin supporters 5 are positioned in front of and behind the depilation block 2 inside the connecting frame 50. The front skin supporter 5 has a comb 51 for making the hairs stand erect, and a tensioning piece 40 is a part of the skin tensioner. The periphery of the comb 51 is surrounded by an elastomer which is shaped integrally with the skin supporter 5. The elastomer has a hardness of 50° to 80°, and the comb 51 tensions the skin with a soft touch, while making hairs stand erect prior to depilation.

The rear skin supporter 5 has a roller 54 and a comb-like rear tensioning piece 41. The roller 54 is made of an elastomer, and rolls on the skin about the roller axis 54*a*.

The shaft 40*a* of the front tensioning piece 40 is pivotally received in the bearing 50*m* provided on the front face of the connecting frame 50, and the shaft 54*a* of the rear tensioning piece 41 is pivotally received in the bearing 50*n* provided on the rear face of the connecting frame 50.

The front and rear tensioning pieces 40 and 41 are coupled with each other by coupling arms 42 and 43. A pair of coupling arms 42 support the front tensioning piece 40, while a pair of coupling arms 43 support the rear tensioning piece 41. Each of the coupling arms 42, 43 has a downward projection 560 in the middle of the arm. The coupling arms 42 are positioned inside the coupling arms 43, and pins 42*c* extend outwardly from the downward projections 560 of the coupling arms 42. An elongated hole 42*a* is formed in the tip of each coupling arm 42, and a regular hole 42*b* is formed in the base of the coupling arm 42. Similarly, an elongated hole 43*a* is formed in the tip of each coupling arm 43, and a regular hole 43*b* is formed in the base of the coupling arm 43. When the skin tensioner and the skin supporter 5 are accommodated in the connecting wall 50, the shafts 50*g* formed on the inner face of the connecting wall 50 are inserted in the regular holes 42*b* of the coupling arms 42, so that the coupling arms 42 are pivotable about the shafts 50*g*. Similarly, the shafts 50*h* formed next to the shafts 50*g* are inserted in the regular holes 43*b* of the coupling arms 43, so that the coupling arms 43 are pivotable about the shafts 50*h*. Both ends of the rear tensioning piece 41 are rotatably supported by the tips of the coupling arms 43 via pins 41*b* which are received by the elongated holes 43*a* so as to be slidable along the elongated hole 43*a*. Similarly, both ends of the front tensioning piece 40 are rotatably supported by the tips of the coupling arms 42 via pins 40*b* which are received by the elongated holes 42*a* so as to be slidable along the elongated holes 42*a*. The coupling arms 42 and 43 cross each other, and are connected with each other by inserting the pins 42*c* extending outwardly from the coupling arms 42 (i.e., inner arms) into the elongated holes 43*c* formed in the middle of the coupling arms 43, whereby the coupling arms 42 and 43 swing about the pin 42*c*.

The coupling arms 42 are connected to legs 42*d*, which are then connected to each other by a cross-piece 42*e* extending between the bottom of the legs 42*d*. An elastic return spring 42*f* extends obliquely upwardly from the bottom of each leg 42*d*. Similarly, the coupling arms 43 are connected to legs 43*d*, which are then connected to each other by a cross-piece 43*e* extending between the bottom of the legs 43*d*. An elastic return spring 43*f* extends obliquely upwardly from the bottom of each leg 43*d*. The legs 42*d* and 43*d*, the cross-pieces 42*e* and 43*e*, and the return springs 42*f* and 43*f* are placed in the gap formed between the top wall 19*a* of the frame 19 and the connecting frame 50.

The bottom faces of the downward projections 560 are concave so as to receive the top faces 31*e* of the convex projections 31*d* formed on the oscillator 31.

When the oscillator 31 moves upwardly, the downward projections 560 are pushed up, which causes the coupling arms 42 to pivot about the shaft 50*g* that serves as a fulcrum. As a result, the tips of the coupling arms 42, in which the elongated holes 42*a* are formed, are raised, as showing in FIGS. 8 and 9. Since the front tensioning piece 40 is secured the connecting frame 50 via the pin 40*a*, and since both ends of the front tensioning piece 40 are inserted into the elongated holes 42*a* via the pins 40*b*, the pins 40*b* slide in the elongated holes 42*a* with the pin 40*a* as a fulcrum. As a result of this sliding motion, the comb-like front tensioning piece 40 swings and tensions the skin forwardly. At the same time, the downward projections 560 of the coupling arms 43 move upwardly, and the coupling arms 43 pivot about the shaft 50*h*. As a result, the tips of the coupling arms 43, in which the elongated holes 43*a* are formed, are raised. Since the rear tensioning piece 41 is secured to the connecting frame 50 via the pin 54*a*, and since both ends of the rear tensioning piece 41 are inserted into the elongated holes 43*a* via the pins 41*b*, the pins 41*b* slide in the elongated holes 43*a* with the pin 41*a* as a fulcrum. As a result, the rear tensioning piece 41 swings and tensions the skin backwardly. In this manner, as the oscillator 31 moves up, the comb-like front tensioning piece 40 swings and tensions the skin forwardly, while the rear tensioning piece 41 swings and tensions the skin backwardly. This allows the tweezers 3 to nip hairs reliably, and can reduce unpleasant stimulus caused by depilation.

Figure 9:
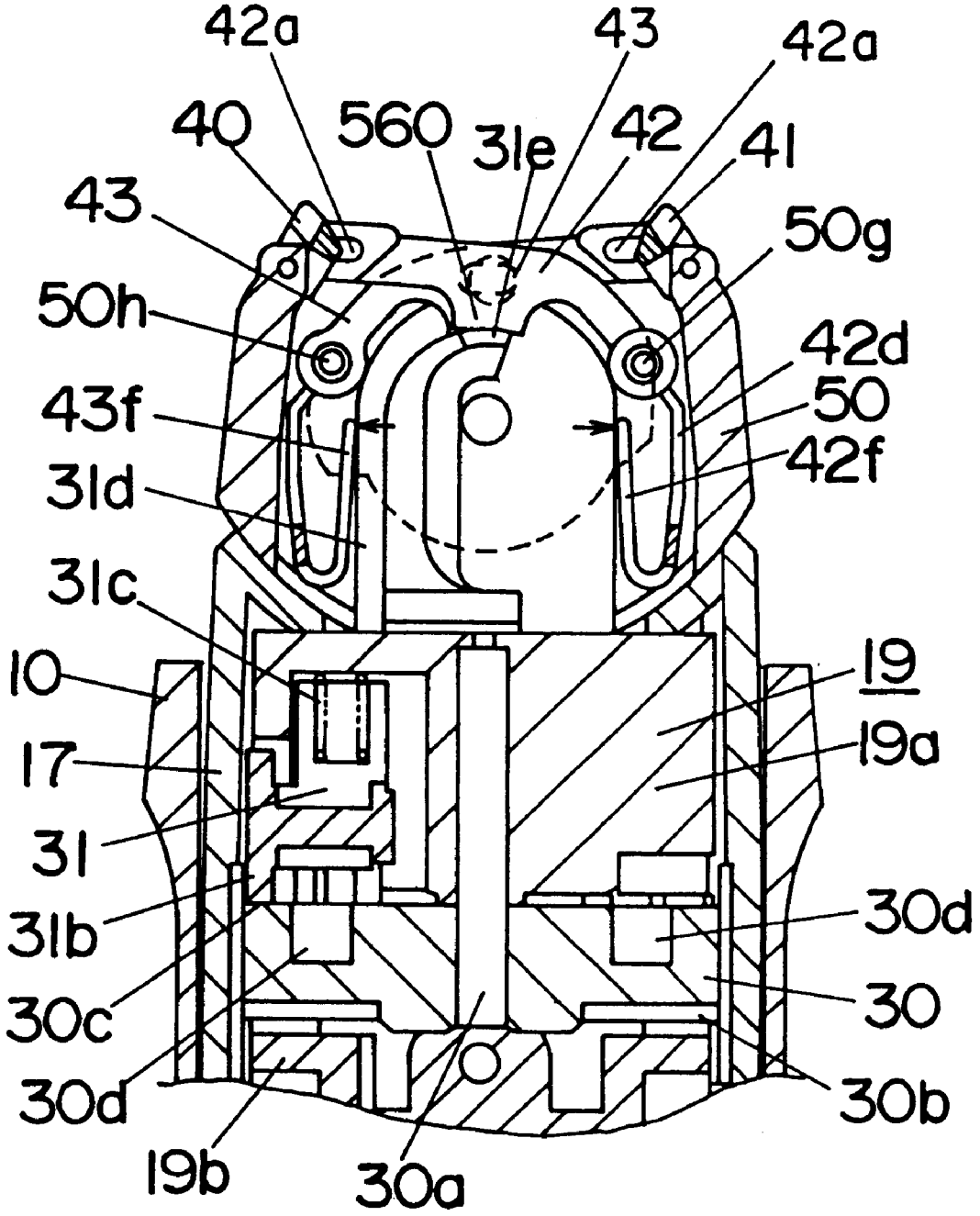
FIG. 9 is a cross-sectional side view of the skin tensioner, in which the tensioning pieces have swung into the tensioning position.

When the oscillator 31 moves upwardly, and the front and rear tensioning pieces 40 and 41 swing in the skin-tensioning directions, the return springs 42*f* and 43*f* are compressed against the frame 19 by the pivoting motions of the coupling arms 42 and 43, as shown in FIG. 9. Through the compression, return spring force is stored in the return springs 42*f* and 43*f*. When the oscillator 31 start moving downwardly, the coupling arms 42 and 43 swing back in the opposite direction by means of the stored spring force, and finally return to the state illustrated in FIGS. 3 and 7. At this time, the downward projections 560 move down while keeping in contact with the convex projections of the oscillator 31. Accordingly, when the oscillator 31 again moves upwardly, the oscillator 31 never clashes with the downward projections 560, thereby preventing noises.

In the first embodiment, the front and rear tensioning pieces 40 and 41 swing between the home position to the tensioning position in order to tension the skin during depilation. This arrangement can relieve pain or unpleasant stimulus to the skin caused by depilation. The driving load of this swing motion is relatively small, and hairs are not pulled or caught in the skin tensioner.

If the skin tensioner is made of a non-elastic hard material, tension applied to the skin is improved. However, the hard material has an unpleasant touch, and it may cause additional pain to the user's bones. In order to overcome this drawback, the positions of the front and rear tensioning pieces 40 and 41 relative to the skin supporter are adjusted in order to control the tension applied to the skin.

As has been explained above, in the first embodiment, the skin supporter, which includes the comb 51 and the roller 54, and the skin tensioner, which includes the front and rear tensioning pieces 40 and 41, are accommodated in the connecting frame 50. The comb 51 and the roller 54 are arranged parallel to and outside the front and rear tensioning pieces 40 and 41, and the comb 51 and the rollers 54 control the tension applied to the skin by means of the front and rear tensioning pieces 40 and 41.

The comb 51 is provided to control the tension applied by the front tensioning piece 40, and the surfaces of the comb 51 are covered with an elastomer. As an alternative, the comb teeth 51*b*, which project upwardly, are formed of an elastomer, and the base of the comb 51 may be made of a hard material. As shown in FIGS. 2, 6, 11, and 12, the base portion of the comb 51 is received in the recess 50*q* formed just inside the front face of the connecting frame 50. The comb 51 is movable in the vertical direction with help of the guides 50*d* formed on the both sides of the upper front face of the connecting frame 50. Both sides of the comb 51 are held by projections 50*r* formed in the recess 50*q* so as not to fall into the recess 50*q* during the vertical motion of the comb 51. A through-hole 50*s* is formed in the front face of the connecting frame 50, through which a handle 50*e* is inserted in the connecting frame 50 in such a manner that the projection 50*t* formed on the back of the handle 50*e* slides in the lateral direction along the top and bottom faces of the recess 50*q*. A boss 50*f* is also provided to the back of the handle 50*e*. The boss 50*f* is fit into the cam groove 51*a* which is formed in the comb base made of a hard material. When the handle 50*e* is slid in the lateral direction, the skin supporter 5 moves in the vertical direction. Thus, the height of the comb 51 can be set to an appropriate level by adjusting the lateral position of the handle 50*e*.

Figure 11:
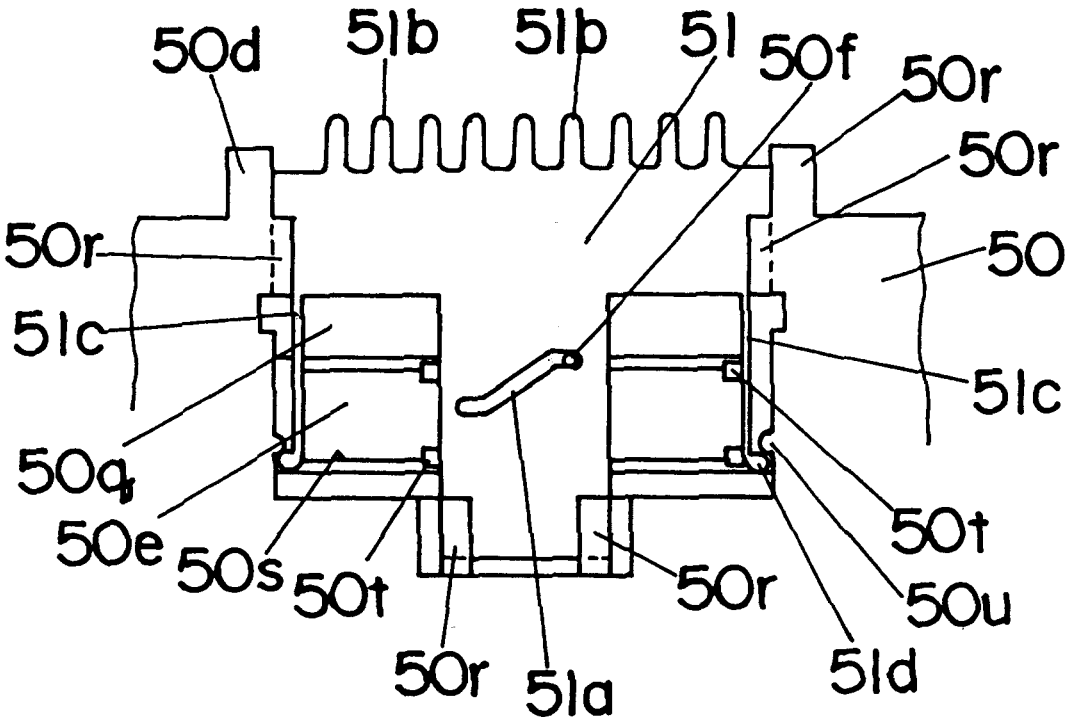
FIG. 11 is a rear view of the skin supporter which controls the tension applied to the skin, in which the height of the skin supporter is set to be small.
Figure 12:
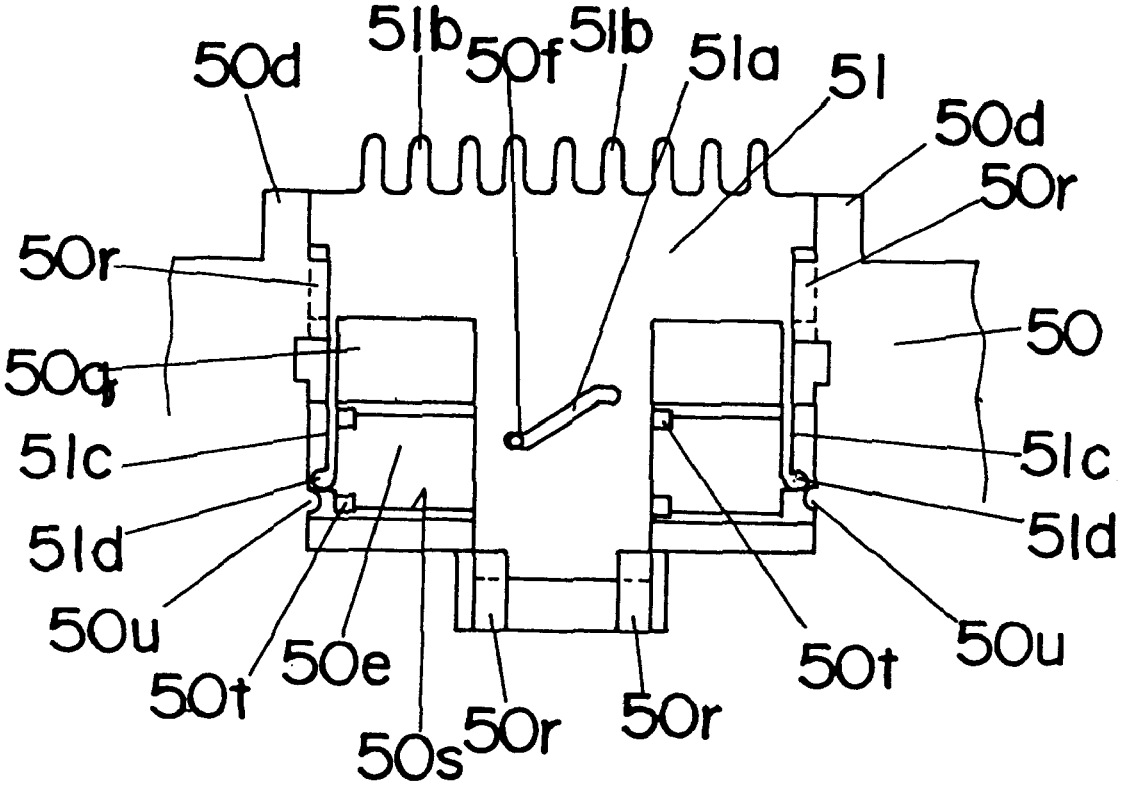
FIG. 12 is a rear view of the skin supporter, in which the height of the skin supporter is set to be large.

In the first embodiment shown in FIGS. 11 and 12, the comb 51 has elastic legs 51*c*, the bottom ends of which are provided with small projections 51*d*. When the height of the comb 51 is set to be small, as shown in FIG. 11, the top face of each projection 51*d* abuts against the bottom face of another projection 50*u* formed on the inner wall of the recess 50*q*, thereby preventing the comb 51 from abruptly sticking out. When the comb 51 is moved up, as shown in FIG. 12, the bottom face of each projection 51*d* abuts against the top face of the projection 50*u* in order to prevent the comb 51 from sinking down.

Figure 13:
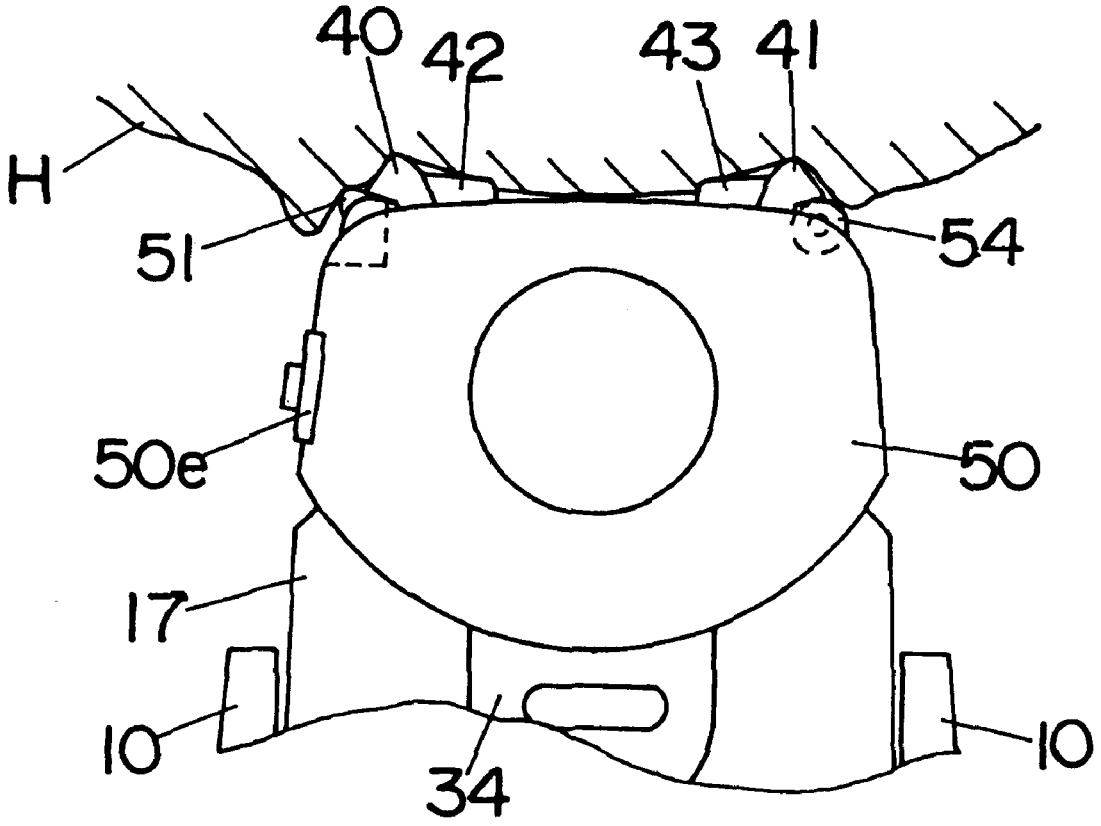
FIG. 13 is a side view of the skin supporter which is in actual use, in which the height of the skin supporter is set to be small.
Figure 14:
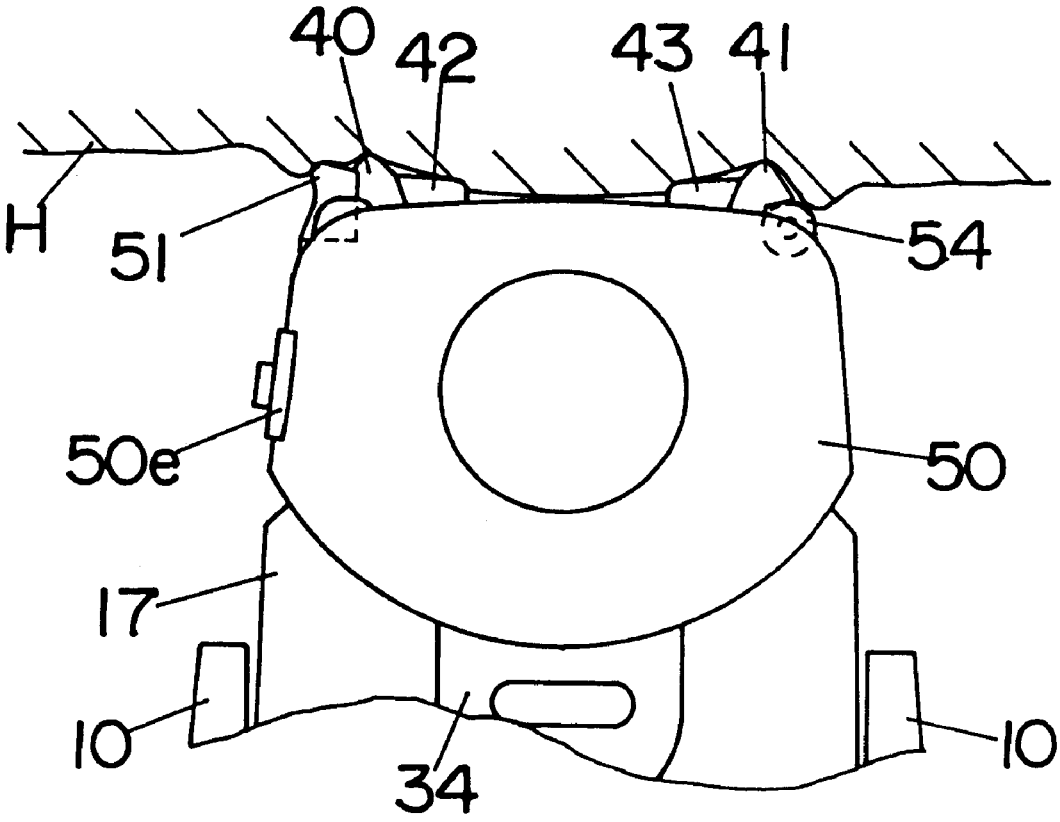
FIG. 14 is a side view of the skin supporter which is in actual use, in which the height of the skin supporter is set to be large.

FIG. 13 corresponds to FIG. 11, and it illustrates the state where the depilator is pressed on the skin H with the comb 51 at a low level. FIG. 14 corresponds to FIG. 12, and it illustrates the state where the depilator is pressed on the skin H with the comb 51 at a high level.

As shown in FIGS. 13 and 14, by changing the height of the comb 51 with respect to the top face of the connecting frame 50, the position of the front tensioning piece 40 relative to the comb 51 changes and, accordingly, the tension applied to the skin H is controlled to a desired level. If the comb 51 is lowered, as shown in FIG. 13, the tension applied to the skin H by the front tensioning piece 40 increases because the difference in height between the front tensioning piece 40 and the comb 51 becomes large, which is suitable for a soft part of the body. On the other hand, if the comb 51 is raised, as shown in FIG. 14, the tension applied to the skin H decreases, which is suitable for a harder part of the body, for example, near bones. However, if the user feels a very unpleasant stimulus during plucking of hairs, the comb 51 may be lowered to increase the tension even for a hard part of the body.

In the first embodiment, the height of the comb 51 is adjustable within the range between −3 mm to +5 mm where the negative sign indicates downward motion and the positive sign indicates upward motion from a neutral position (i.e., 0 mm).

The roller 54, which is positioned behind the skin tensioner, may also be designed so as to be movable in the vertical direction with respect to the connecting frame 50. Alternatively, the front and rear tensioning pieces 40 and 41 may be made movable so that the vertical position of the skin tensioner, which includes the first and rear tensioning pieces 40 and 41, relative to the skin supporter 5, which includes the comb 51 and the roller 54, is adjusted.

Figure 15:
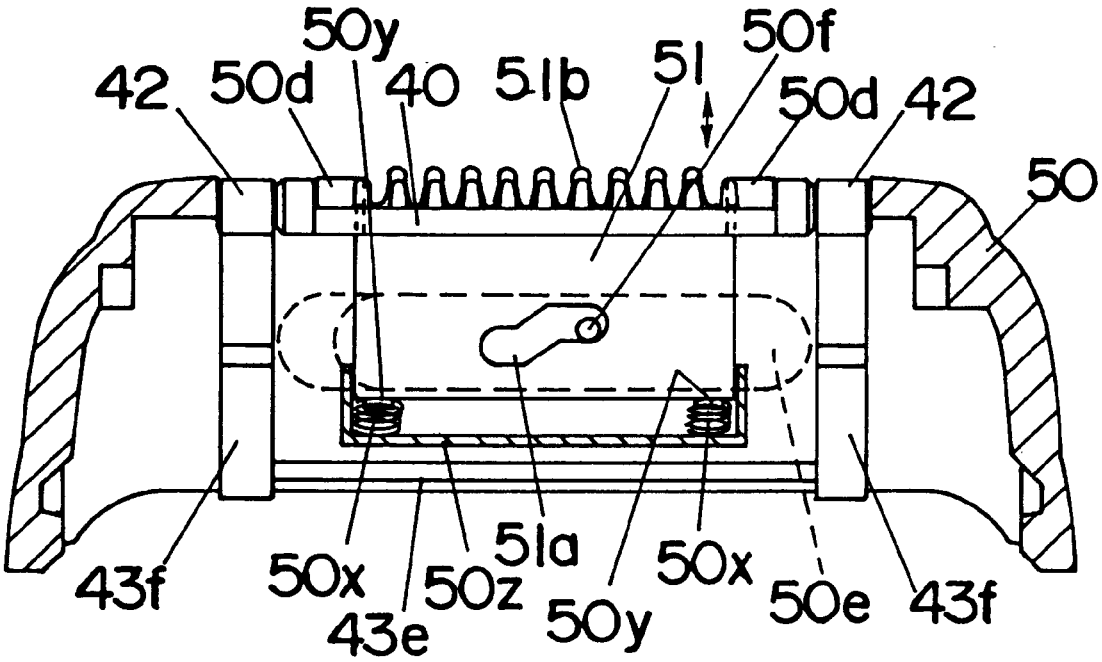
FIG. 15 illustrates a modification of the skin supporter which is adjustable with respect to the connecting frame, in which the height of the skin supporter is set to be small.
Figure 16:
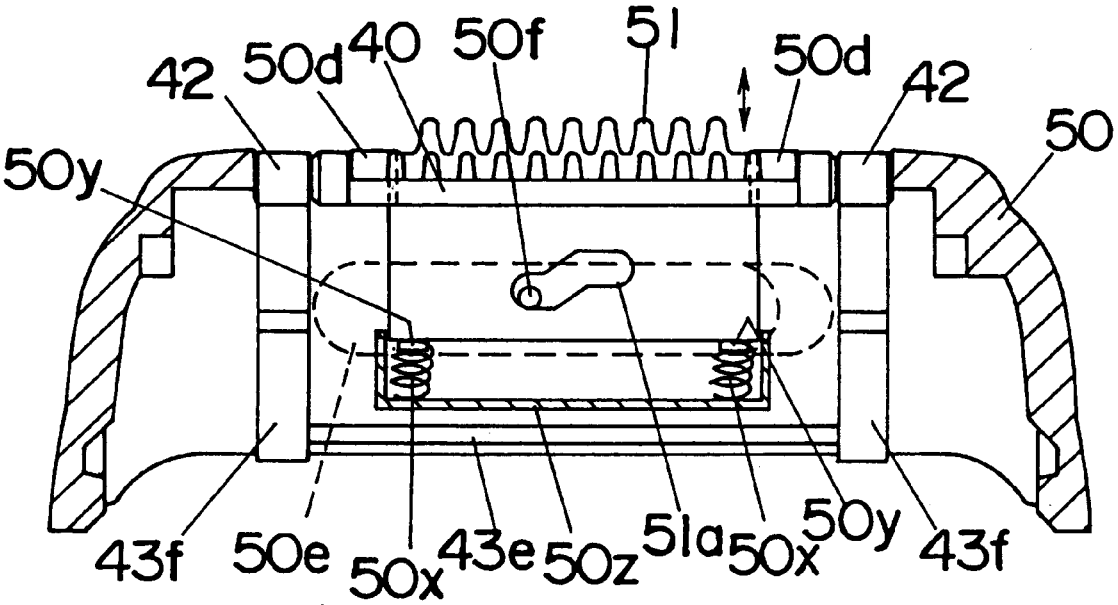
FIG. 16 illustrates the skin supporter shown in FIG. 15, in which the height of the skin supporter is set to be large.

The skin supporter 5 for controlling the tension applied to the skin may be made floatable by means of a spring 50*x*, in addition the height of the skin supporter 5 being adjusted to a desired level by the handle 50*e*. By making the skin supporter 5 floatable, the comb 51 traces the skin surface more smoothly at any fixed height of the skin supporter 5. FIGS. 15 and 16 illustrate an example in which the skin supporter 5 is floatable on springs 50*x*, where the comb 51 is at a low position in FIG. 15, while the comb 51 is at a high position in FIG. 16. In the first embodiment, bosses 50*y* are provided to the bottom end of the comb 51 which is a major element of the skin supporter 5. Springs 50*x* are fixed to the bottom of the U-shaped recess 50*z* formed below the comb 51. The springs 50*x* receive the bosses 50*y* of the comb 51 to allow the comb 51 to be floatable. Meanwhile, the lower face of the cam groove 51*a* formed in the comb 51 abuts against the boss 50*f* of the handle 50*e* by the spring force. The width of the cam groove 51*a* is set greater than the diameter of the boss 50*f*, so that the boss 50*f* can move up and down in the cam groove 51*a*. The boss 50*f* and the cam groove 51*a*, in combination with the springs 50*x*, allow the comb 51 to be floatable. In FIG. 15, the springs 50*x* are more compressed because the comb 51 is at a low position. When the comb 51 is raised, as shown in FIG. 16, the floating force generated by the springs 50*x* decreases. When depilating a hard part of the body, the comb 51 traces the skin surface with a soft touch, while receiving little of the floating force.

Although, in the first embodiment, the floating force changes according to the height of the comb 51, the floating force may be kept constant independently from the vertical position of the comb 51.

Second Embodiment

FIGS. 17 through 26 illustrate the depilator according to the second embodiment of the invention.

Figure 20:
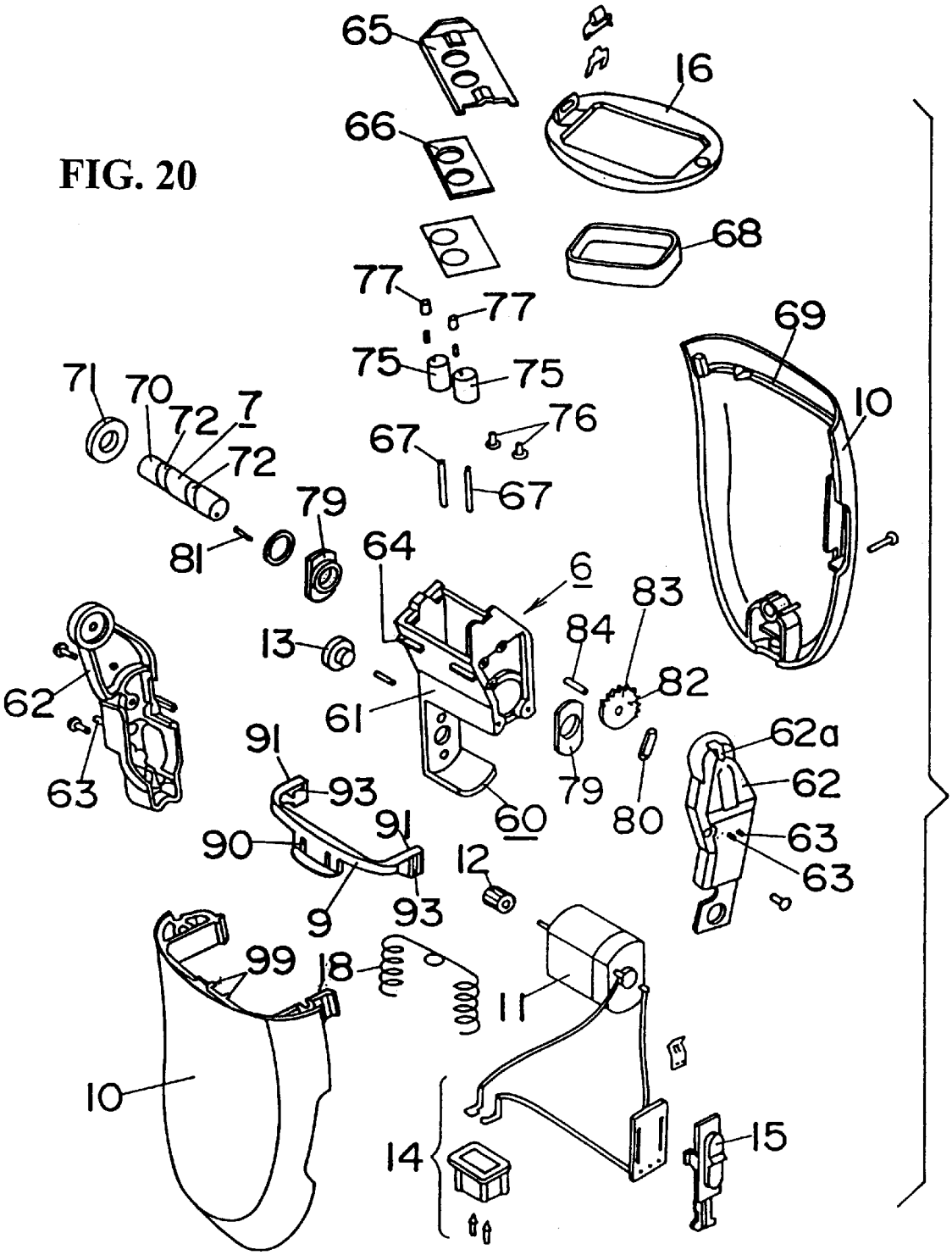
FIG. 20 is an exploded view of the depilator of FIG. 17, showing the casing and the inner parts.

As shown in FIG. 20, the driving unit 6 has a frame 60 which consists of a main frame 61 and side covers 62 fixed to both sides of the main frame 61. The frame 60 is attached to the casing 1 via a U-shaped supporting arm 9.

As shown FIG. 20, the supporting arm 9 has holes 90 in the center, and is hooked on projections 99 formed on the inner surface of the housing 10. Both ends of the supporting arm 9 are formed to be thin elastic pieces 91 which can bend upwardly and downwardly. A hole 93 is formed on the inner face of each elastic piece 91 in order to receive a projection 63 formed on either side of the driving unit 6 near the center of mass. Because the elastic pieces 91 can bend, the driving unit 6 can swing upwardly and downwardly with respect to the casing 1. In addition, the driving unit 6 is forced upwardly by a spring 18 placed on the bottom of the casing 1. The elastic pieces 91 and the spring 18 allow the driving unit 6 to be floatable within the casing 1. A packing 68 is provided between a flange 64 formed on the outer face of the frame 60 and a flange 69 formed on the inner face of the housing 10 for the purpose of preventing hairs and dust from entering the casing 1.

A motor 11 is accommodated in the lower part of the frame 60, and a depilation block 2 including a row of tweezers 3 is placed in the upper part of the frame 60. A cam 7 for driving the tweezers 3 is placed between the depilation block 2 and the motor 11. Another driving unit for reciprocating the depilation block 2 is positioned on one side of the frame 60.

The cam 7 includes a rotational shaft 70 having a pair of cam grooves 72 in an outer surface thereof, and a pair of cam followers 75. Each cam follower 75 has a boat-shaped roll 76 which moves along the associated cam groove 72. A gear 71 is fixed to one end of the rotational shaft 70. The gear 71 is meshed with an intermediate gear 13 supported by the frame 60, and the intermediate gear 13 is meshed with a pinion 12 provided on the output shaft of the motor 11. The rotational shaft 70 is supported by the frame 60 via bearings 79 so as to be rotatable about and movable along the axis of the rotationed shaft 70. A small gap is formed between the gear 71 and the bearings 79 so that the driving unit 6 has appropriate play. The pair of cam grooves 72 are formed helically with a predetermined interval between them in the axial direction. The rolls 76 of the cam followers 75 are positioned symmetrically with respect to the center of the rotational shaft 70. The axial position of the rotational shaft 70 is stable because the pair of cam followers 75 prevent the rotational shaft 70 from fluctuating or vibrating in the vertical direction.

Figure 17:
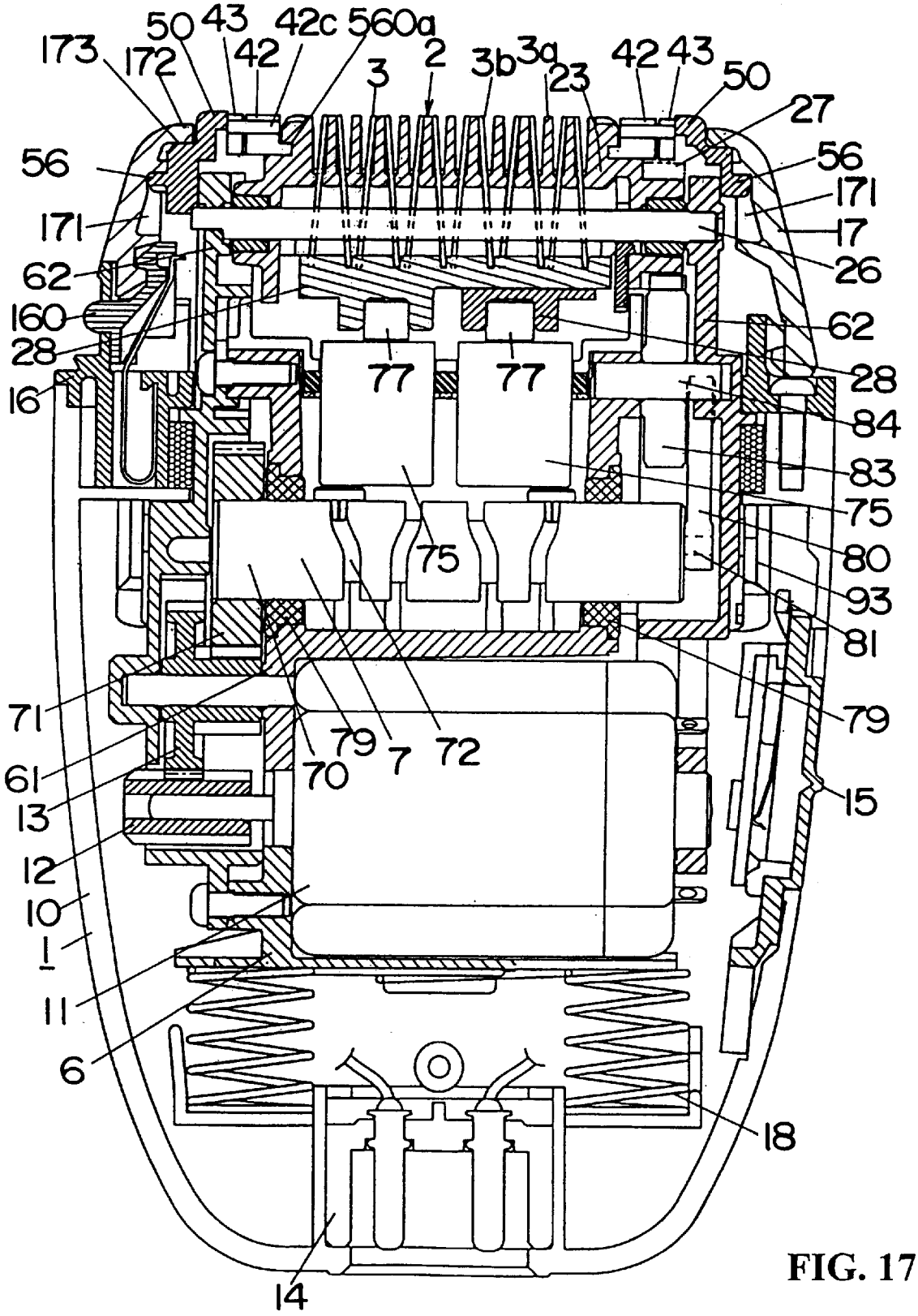
FIG. 17 is a cross-sectional front view of the depilator according to the second embodiment of the present invention.

As shown in FIGS. 17 and 20, each of the cam follower 75 is rotatable about a pivot shaft 67 extending from the frame 60. The roll 76 is provided on the bottom face of the cam follower 75 so as to be offset from the pivot shaft 67. The top face of the cam follower 75 is provided with a driving die 77 for driving the tweezers 3. The sub-housing 17 is held by a hook 160. The frame 60 is covered with a top cover 65, which is further covered with a dustproofed plate 66. A pair of shafts, each of which is coaxial with one of the shafts 67 of the cam followers 75, penetrates the top cover 65 and the dustproofed plate 66.

The depilation block 2 used in the second embodiment is the same as that in the first embodiment. A pair of sliders 28 which are provided on the rotating body 23 overlap with each other in the axial direction, and are slid in opposite directions by the driving cam 7. One of the sliders 28 causes a first set of every other movable blade 3*b* arranged along the axis of the rotating body 23 to swing at a time, and the other slider 28 causes a second set including the rest of the movable blades 3*b* to swing in the direction opposite to the swing direction of the first set of movable blades 3*b*. Each of the sliders 28 has one or two grooves 280 to receive the downward projections of the movable blades 3*b*.

In the driving unit 6, a link 80 and a gear 83 supported by the frame 60 via a shaft 84 are also accommodated in the frame 60. One end of the link 80 is linked with an end surface of the rotational shaft 70 via an eccentric pin 81, and the other and of the link 80 is linked with the eccentric part of the gear 83 via an axis 82. The gear 83 is meshed with the gear 27 provided in the depilation block 2.

As the motor 11 rotates, the rotational shaft 70 also rotates in response to the rotational force transferred through the intermediate gear 13. The link 80 and the gear 83 receive the rotational force from the rotational shaft 70, and cause the depilation block 2 to swing about the pivot shaft 26 at a predetermined rotational angle. The depilation block 2 swings between two dead centers, a roller-up position where the rotating roller 231 is located in the middle of the top opening of the sub-housing 17, and a tweezers-up position where the movable blades 3*b* are located in the same position. During the swing of the depilation block 2, the cam followers 75 and the pivot shafts 67 pivot back and forth in opposite directions, which causes the pair of sliders 28 of the depilation block 2 to slide back and forth in opposite directions. At this time, any two adjacent movable blades 3*b* swing in opposite directions so that two movable blades 3*b* alternately contact and then separate from the fixed blade 3*a* positioned between them. The first and last fixed blades 3*a*, which are positioned at both ends of the row of tweezers 3, are slightly thicker than the rest of the fixed blades 3*a* so as to have mechanical strength because the movable blades 3*b* positioned next to the first and last fixed blades 3*a* abut the fixed blade 3*a* only from one direction.

The driving cam 7 is designed so that each of the movable blades 3*b* swings back and forth once while the depilation block 2 pivots about the pivot axis 26 twice. In other words, each movable blade 3*b* moves from one of the two adjacent fixed blades 3*a* to the other of two adjacent fixed blades 3*a* while the depilation block 2 pivots once. The motion of the movable blade 3*b* is the same as in the first embodiment.

Next, the skin supporter 5 will be explained. The skin supporter 5 is accommodated in the connecting frame 50. In this embodiment, the connecting frame 50 is pivotable and floatable, and the connecting frame 50 is positioned in the opening of the sub-housing 17 which constitutes an upper part of the casing 1.

Figure 21:
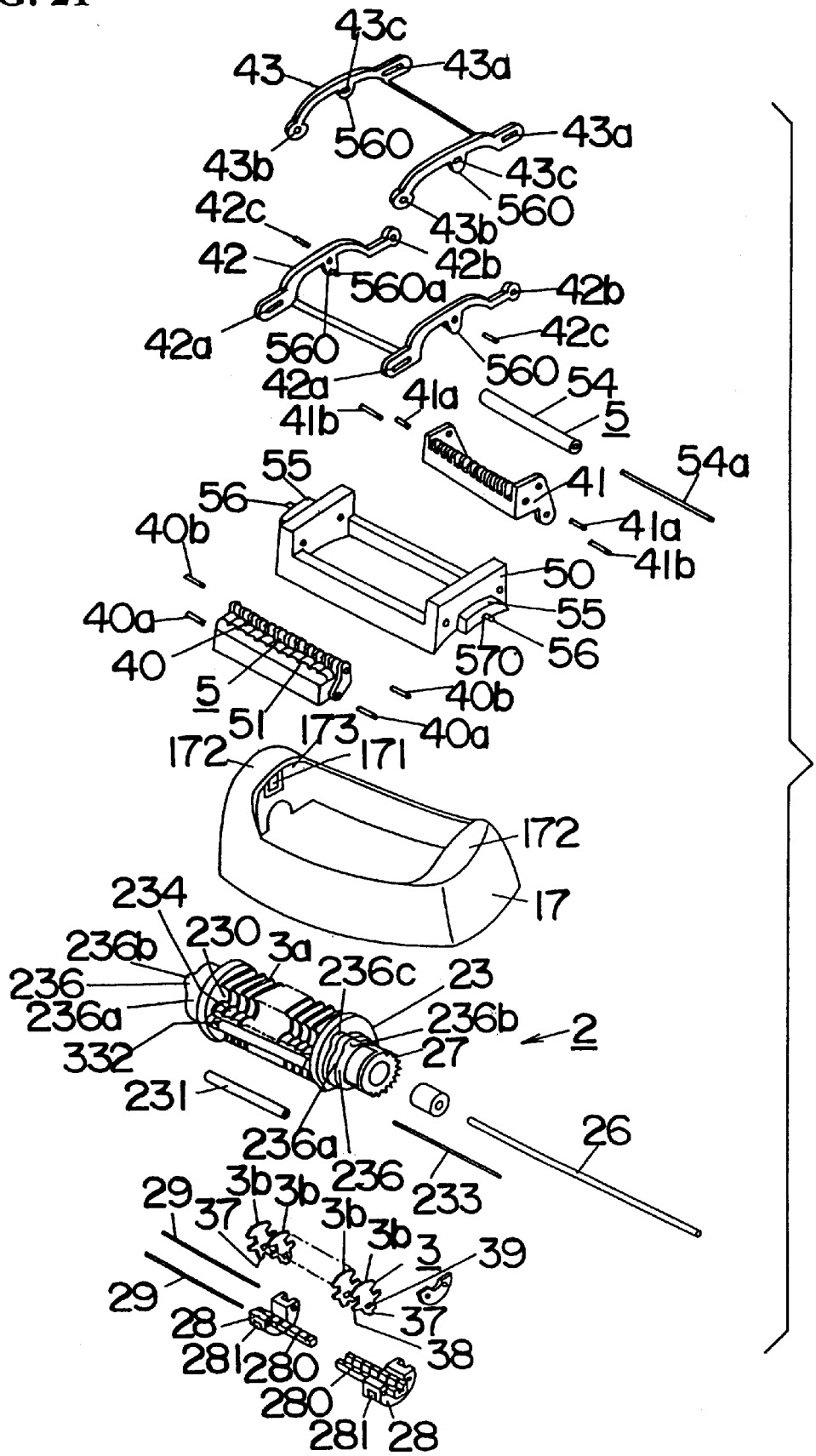
FIG. 21 is an exploded view showing the depilation block and the skin tensioner used in the depilator of FIG. 17.

As shown in FIG. 21, a knob 55 having a convex top surface is formed on either side of the connecting frame 50. A boss 56 projects from the side face of the knob 55, and a fulcrum groove 570 is formed on the bottom face thereof.

A pair of vertically elongated holes 171 are formed in the inner surface of the sub-housing 17 so as to face each other. The knobs 55 of the connecting frame 50 are fit into these elongated holes 171, and move vertically along the elongated holes 171. The skin supporter 5, which comprises a front part and a rear part, is inserted from the bottom of the sub-housing 17, and the skin supporter 5 is placed in the top opening of the sub-housing 17. The sub-housing 17 has swelling surfaces 172 above the elongated holes 171, and concave recesses 173 are formed under the swelling surfaces 172.

When the sub-housing 17 is attached to the housing 10, fulcrum ribs 62*a* formed on the side covers 62 are fit into the fulcrum grooves 570 of the connecting frame 50. In this state, the convex top surface of each knob 55 is pressed against the corresponding concave recess 173 by the upward force transferred from the spring 18 via the fulcrum rib 62*a*.

The radius of curvature of the concave recess 173 is set greater than that of the convex top surface of the knob 55 and, therefore, the convex top surface of the knob 55 contacts the concave recess 173 at only one point. This contact point becomes the fulcrum of the swing motion of the connecting frame 50. At the same time, this contact point serves as a supporting point for floating the connecting frame 50.

Since the connecting frame 50 is pivotable and floatable, the skin supporter 5 mounted on the connecting frame 50 can also swing and float together with the connecting frame 50.

The structure of the skin supporter 5 will be described in detail below.

Figure 18:
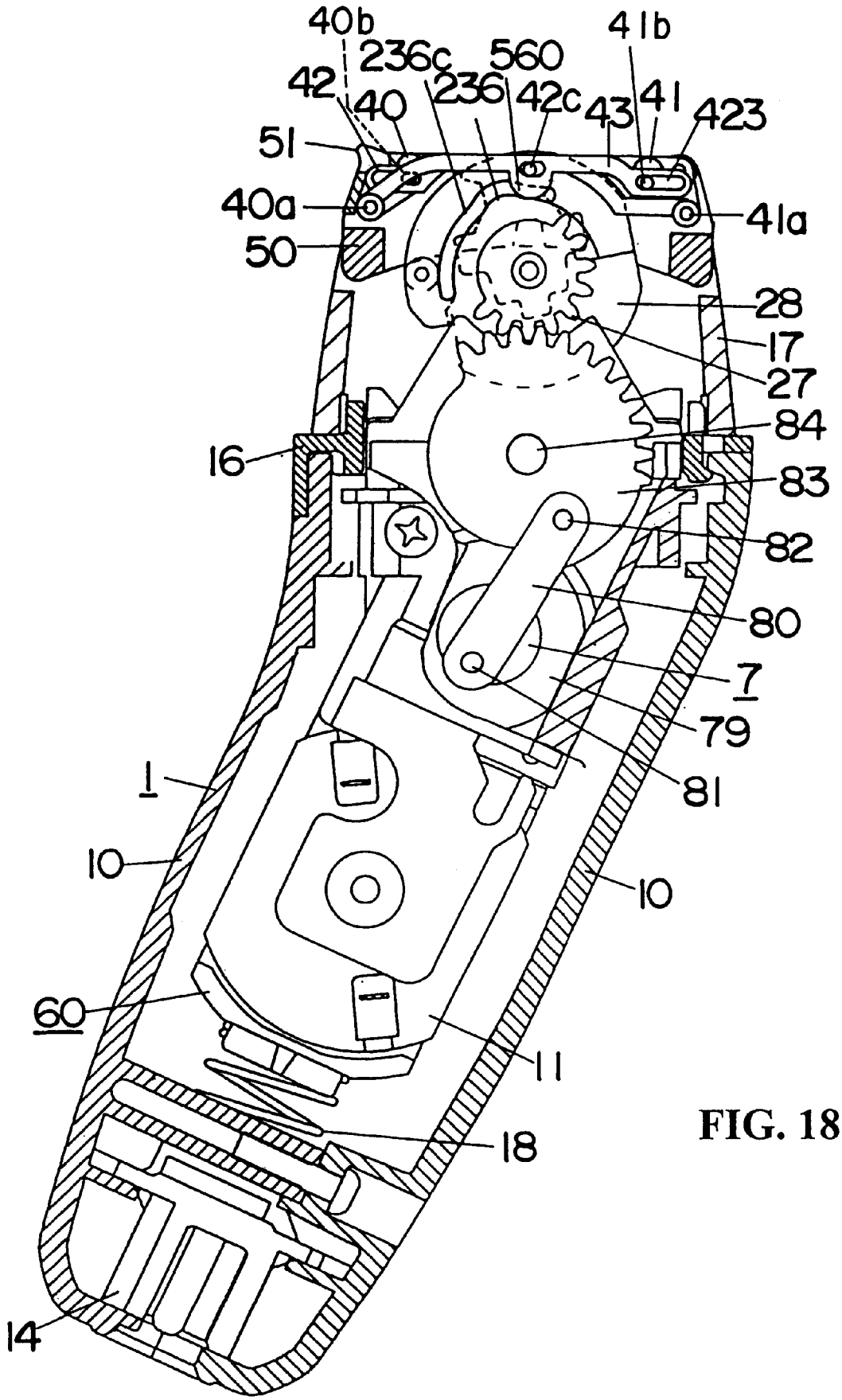
FIG. 18 is a partially omitted cross-sectional side view of the depilator shown in FIG. 17.
Figure 19:
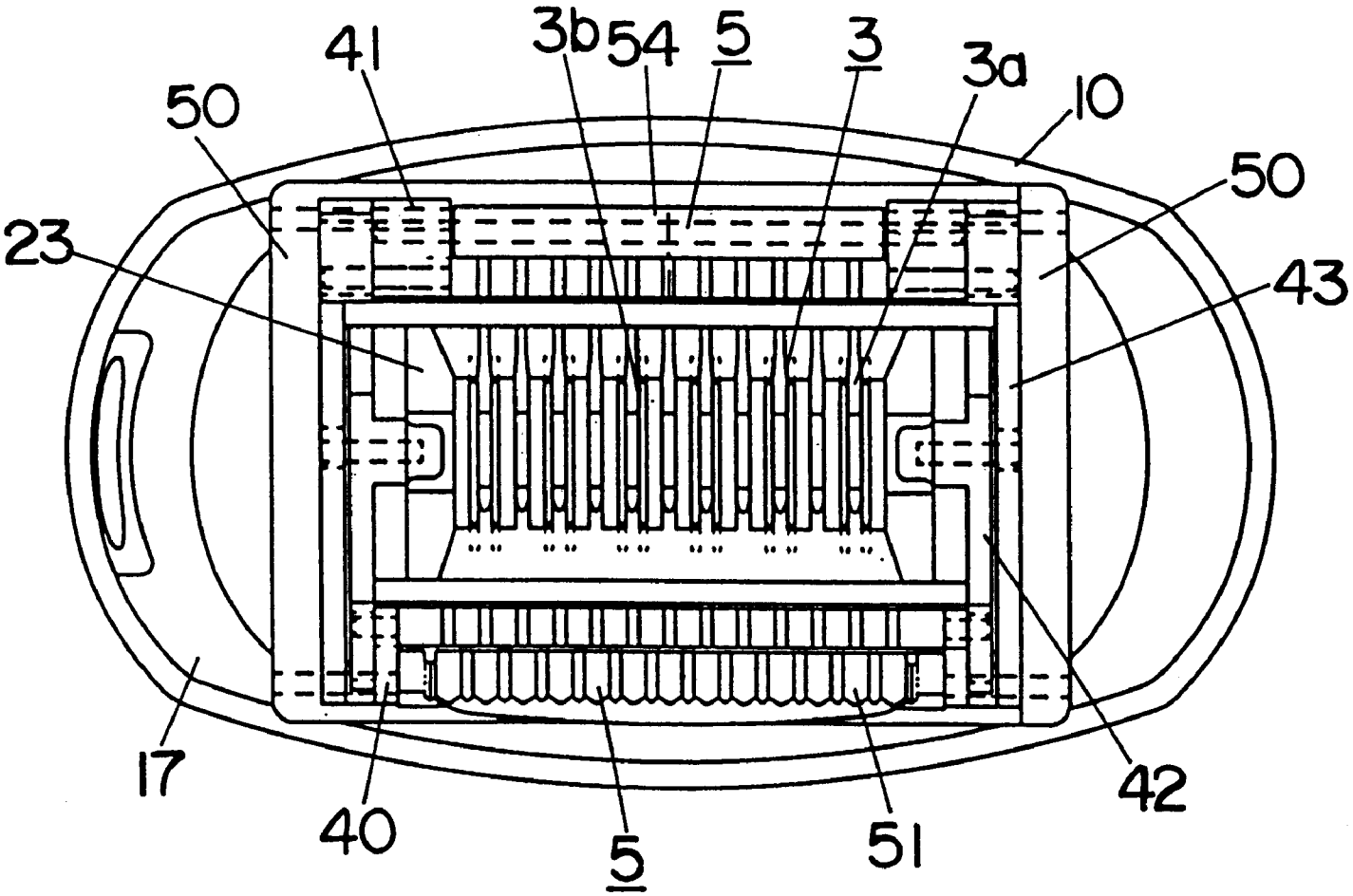
FIG. 19 is a top view of the depilator shown in FIG. 17.

As shown in FIGS. 18 and 19, skin supporters 5 are positioned in front of and behind the depilation block 2 which include a row of tweezers 3. As shown in FIG. 21, the front skin supporter 5 is attached to the front end of the connecting frame 50 via axes 40*a* which pivotably hold both ends of the front skin supporter 5. The rear skin supporter 5 is attached to the rear end of the connecting frame 50 via pivot axes 41*a* which pivotably hold both ends of the rear skin supporter 5. The front skin supporter 5 has a comb 51 for making hairs stand erect, and a comb-like front tensioning piece 40 which is a part of the skin tensioner. The periphery of the comb 51 is surrounded by an elastomer which is shaped integrally with the skin supporter 5. The elastomer has a hardness of 50° to 80°, and the comb 51 tensions the skin with a soft touch, while making hairs stand erect prior to depilation. The rear skin supporter 5 has a roller 54 and a comb-like rear tensioning piece 41. The roller 54 is made of an elastomer, and rolls on the skin about the roller axis 54*a*.

The front and rear tensioning pieces 40 and 41 are coupled with each other by coupling arms 42 and 43. A pair of coupling arms 42 support the front tensioning piece 40, while a pair of arms 43 support the rear tensioning piece 41. Each arm has a downward projection 560 in the middle of the arm. The coupling arms 42 are positioned inside the coupling arms 43, and axes 560*a* extend outwardly from the downward projections 560 of the coupling arms 42. An elongated hole 42*a* is formed in the tip of each arm 42, and a regular hole 42*b* is formed in the base of the coupling arm 42. Similarly, an elongated hole 43*a* is formed in the tip of each arm 43, and a regular hole 43*b* is formed in the base of the coupling arm 43. The pivot axes 41*a*, which pivotably support the connecting frame 50, are inserted in the regular holes 42*b* of the coupling arms 42, so that the coupling arms 42 are pivotable about the pivot axes 41*a*. Both ends of the rear skin supporter 5 are rotatably supported by the tip of the coupling arms 43 via pins 41*b* which are received by the elongated holes 43*a* so as to be slidable along the elongated hole 43*a*. Pivot axes 40*a*, which also pivotably support the connecting frame 50, are inserted in the regular holes 43*b* of the coupling arms 43, so that the coupling arms 43 are pivotable about the pivot axes 40*a*. Both ends of the front skin supporter 5 are rotatably supported by the tip of the coupling arms 42 via pins 40*b* which are received by the elongated holes 42*a* so as to be slidable along the elongated hole 42*a*. The coupling arms 42 and 43 cross each other, and are pivotably connected with each other at the cross point by inserting pins 42*c* into the holes formed in the downward projections 560 of the coupling arms 42 and 43. The holes formed in the coupling arms 43 are elongated holes 43*c*.

Cams 236 are attached to both end faces of the rotating body 23. The periphery of each cam 236 is irregularly shaped having a swell 236*b* and an indented part 236*a*. Each of the cams 236 is in contact with the downward projections 560 of the coupling arms 42 and 43. A cam groove 236*c* is formed on the end surface of the rotating body 23 along the periphery of the cam 236. The pin 560*a* extending from the downward projection 560 of the coupling arm 42 is fit into the cam groove 236*c*, and moves along the cam groove 236*c*. The pin 560*a* and the cam groove 236*c* work as a cam guide which allows the projection 560 to move along the periphery of the cam 236 smoothly. However, the pin 560*a* and the cam groove 236*c* are not essential elements, and may be omitted.

Figure 22:
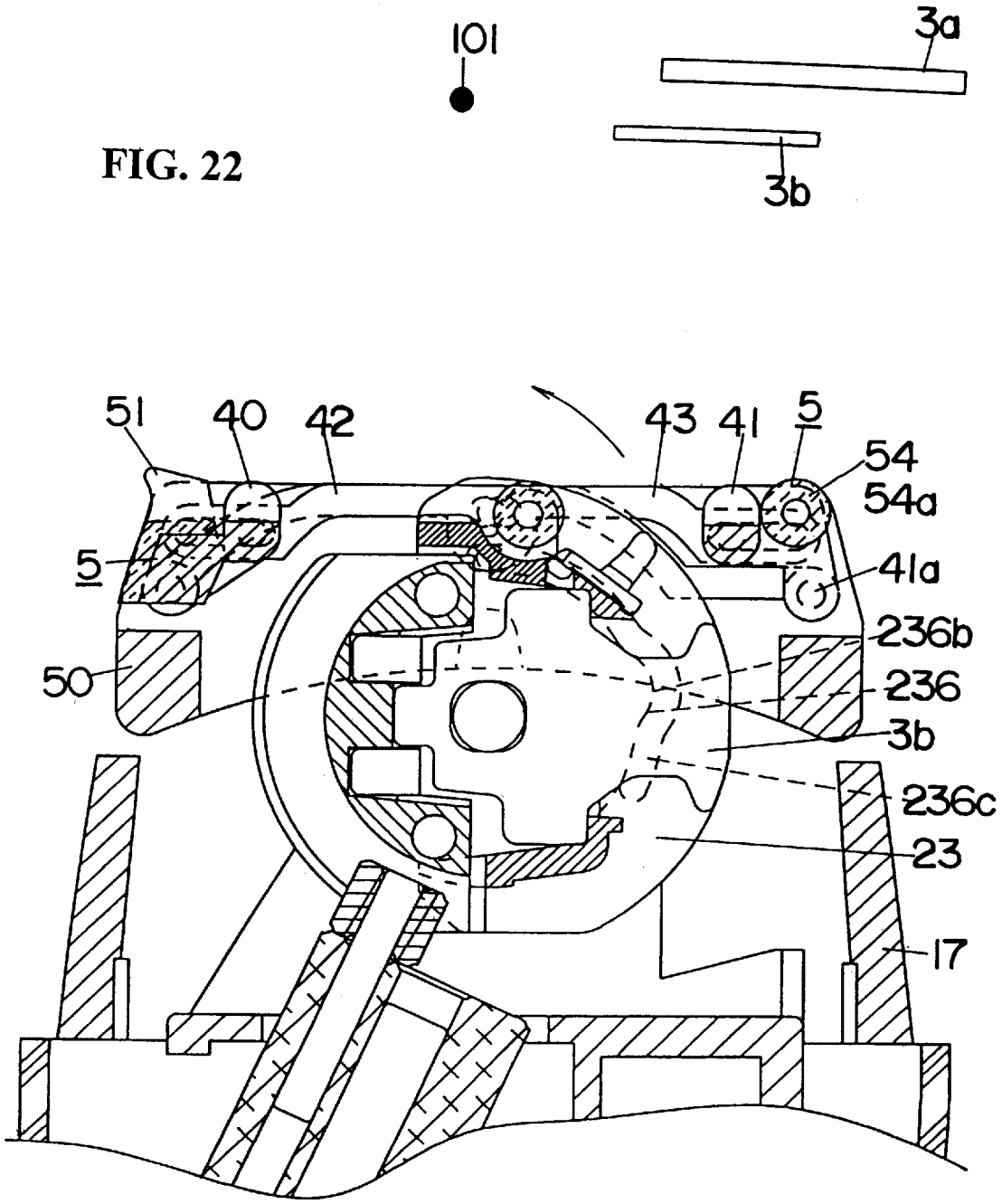
FIG. 22 illustrates the top portion of the depilator, in which the tweezers are advancing to a hair while the skin is not tensioned.
Figure 23:
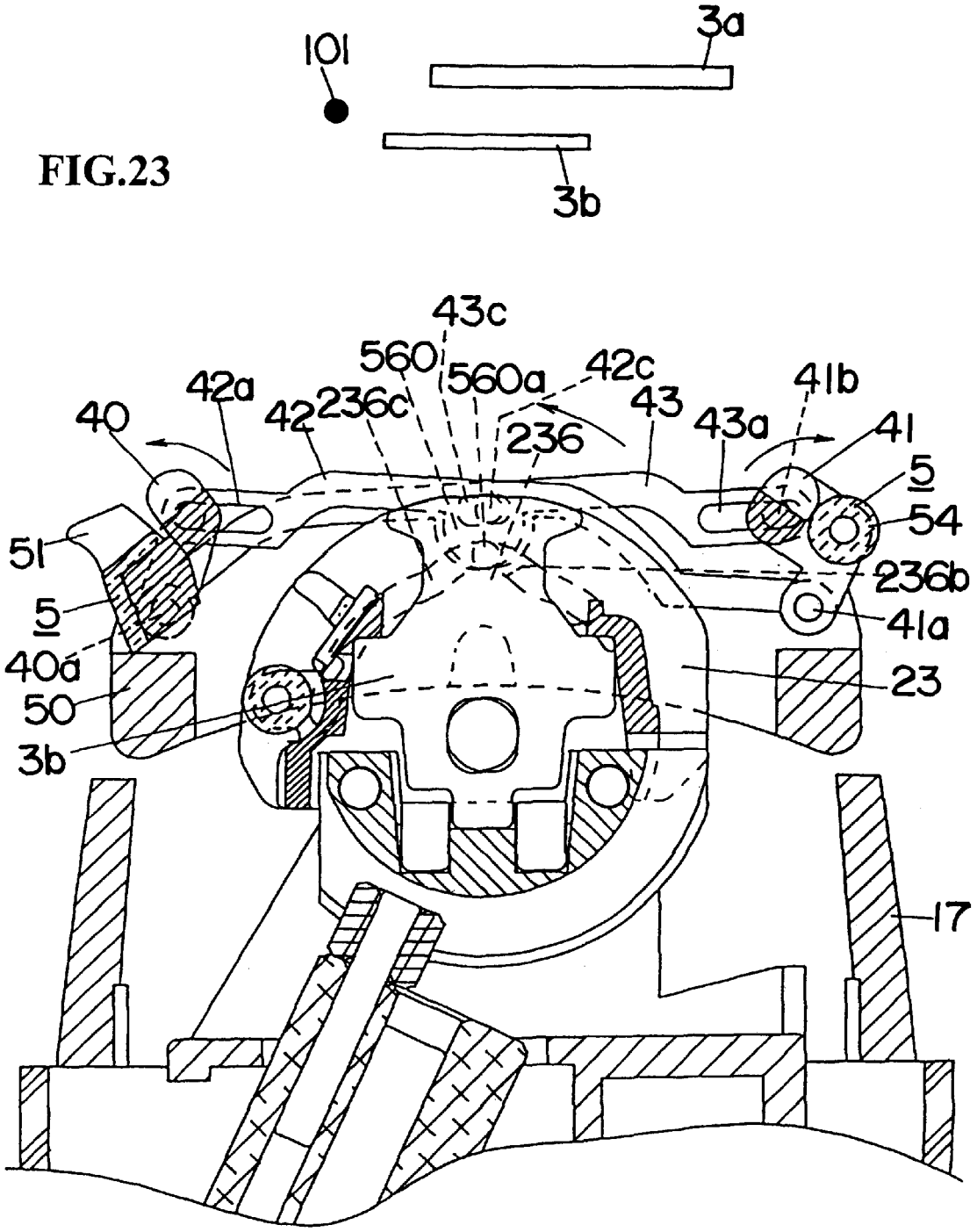
FIG. 23 illustrates the top portion of the depilator, in which the tweezers are still advancing to the hair while the skin is tensioned.

FIGS. 22 through 25 show the operation of the depilator according to the second embodiment. In FIG. 22, the fixed blade 3*a* and the movable blade 3*b* are open and approaching a hair 101. When the rotating body 23 rotates in the direction indicated by the arrow in FIG. 22, the swell 236*b* of the cam 236 comes into contact with the projection 560, which faces the indented part 236*a*, as shown in FIG. 23. The contact point acts as a connecting driving point to push up the coupling arm 42. Because the coupling arm 42 is connected to the rear skin supporter 5 and the connecting frame 50 by the pin 41*a*, the coupling arm 42 pivots about the pin 41*a* in such a manner that the tip of the coupling arm 42, in which the elongated hole 42*a* is formed, swings upwardly. The front skin supporter 5 is connected to the connecting frame 50 via the pin 40*a*, and connected to the elongated hole 42*a* via the pin 40*b*. Accordingly, the pin 40*b* slides along the elongated hole 42*b* with the connecting point with the pin 40*a* as a fulcrum, and the front skin supporter 5 swings forwardly. As the front supporter 5 swings, the comb-like front tensioning piece 40, which is positioned just behind the front skin supporter 5 and held together with the front skin supporter 5, presses the skin forward. At this time, the coupling arm 43, which is connected to the connecting frame 50 and the front skin supporter 5 by the pin 40*a*, pivots about the pin 40*a* in such a manner that the tip of the coupling arm 43, in which the elongated hole 43*a* is formed, swings upwardly. The rear skin supporter 5 is connected to the connecting frame 50 via the pin 41*a*, and connected to the elongated hole 43*a* via the pin 41*b*. Accordingly, the pin 41*b* slides along the elongated hole 43*b* having the connecting point with the pin 41*a* as a fulcrum, and the rear skin supporter 5 swings backwardly. As the rear supporter 5 swings, the comb-like rear tensioning piece 41, which is positioned just inside the rear skin supporter 5 and held together with the rear skin supporter 5, presses the skin backwardly. This state is illustrated in FIG. 23, in which the front and rear tensioning pieces 40 and 41 swing outwardly in opposite directions to tension the skin, while the fixed and movable blades 3*a* and 3*b* are still approaching the hair in the open state.

Because the coupling arm 42 and the coupling arm 43 are connected with each other by the pin 42*c*, and because the hole 43*c* for receiving the pin 42*c* of the coupling arm 43 is an elongated hole, the coupling arms 42 and 43 swing together smoothly.

In FIG. 24, the tweezers 3 are closed (i.e., the movable blade 3*b* pivots toward the fixed blade 3*a*), and the hair 101 is nipped. At this time, the projection 560 faces the indented part 236*a* of the cam 236, and the tension, which has been applied by the front and rear tensioning pieces 40 and 41, is released. In FIG. 25, the hair 101 is being plucked. Before the tweezers 3 start plucking the hair 101, the swell 236*b* has again come into contact with the projection 560, and the front and rear tensioning pieces 40 and 41 have started swinging in opposite directions to tension the skin.

In this manner, the front and rear tensioning pieces 40 and 41 repeatedly tension the skin in response to the rotation of the rotating body 23. The comb 51 (i.e., the major element of the front skin supporter 5) and the roller 54 (i.e., the major element of the rear skin supporter 5) are positioned outside the front and rear tensioning pieces 40 and 41, respectively, and control the tension applied to the skin by the front and rear tensioning pieces 40 and 41.

During the period when the projection 560 faces the indented part 236*a*, the front and rear tensioning pieces 40 and 41 are away from the skin by approximately 0 mm to 3 mm. When the projection 560 contacts with the swell 236*b*, the front and rear tensioning pieces 40 and 41 press the skin about 0.5 mm to 5 mm deeper than the contact surface of the tweezers 3 with the skin.

It is preferable to tension the skin for the first moments of the plucking because at this moment plucking is most painful. By appropriately tensioning the skin, the pain can be effectively relieved.

In addition, it is preferable to tension the skin for the last moments of approaching the hair (that is, immediately before the nipping) in order to allow the tweezers 3 to nip the root of the hair. Nipping the root of the hair can reduce the pain as compared with the case in which the middle or end of the hair is nipped.

The radius of curvature of the projection 560 is set smaller than the radius of curvature of the swell 236*b* of the cam 236 in order to smoothly tension the skin.

The swell 236*b* may have different radii of curvature depending on a positions thereof. If the radius of curvature of the leading part (i.e., the forward part) is set greater than that of the tracing part, tension is applied more moderately during the approach to the hair and more quickly during the plucking, whereby the touch to the skin becomes softer. Similarly, the depth of the indented part 236*a* may be varied. For example, the depth of the indent following the swell 236*b* can be set greater than the depth of the indent leading the swell 236*b*. In this case, more tension is applied to the skin during plucking in order to relieve pain, while less tension is applied during the approach to the hair.

Figure 26:
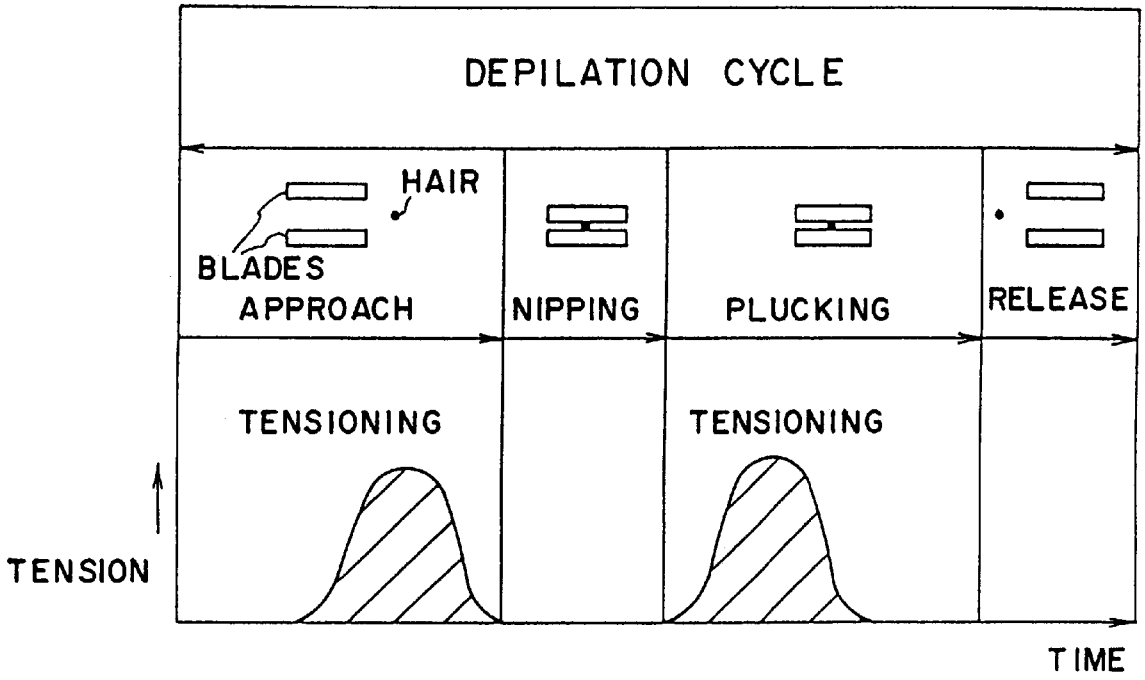
FIG. 26 shows the depilation cycle illustrated in FIGS. 22 through 26.

FIG. 26 shows the depilation cycle according to the actions of the depilator shown in FIGS. 22 through 25. This table shows the positions of the tweezers 3, as well as the tension applied to the skin. As is clear from FIG. 26, tension is applied twice in one depilation cycle, during the approach to the hair and the plucking of the hair. Tension applied during the approaching period allows the tweezers 3 to nip the root, and tension applied during plucking the hair can reduce the pain to the skin and the resistance of the hair.

In this embodiment, tension is applied in the first moments of the plucking period in which the user feel pain the most, thereby reducing the pain effectively.

In addition, the skin is tensioned in the last moments of the approaching period in which the tweezers 3 are approaching to the hair with the blades open, as shown in FIGS. 22 and 23, so that the tweezers 3 can reliably nip the root of the hair.

The present invention is not limited to this depilation cycle. By changing the position, shape, or size of the cam 236, various tensioning patterns for reducing pain can be produced.

For example, by changing the shape of the cam 236, a constant tension may be applied for some amount of time during the approaching period and the plucking period in order to achieve more reliable nipping and pain-relieved plucking.

Figure 27:
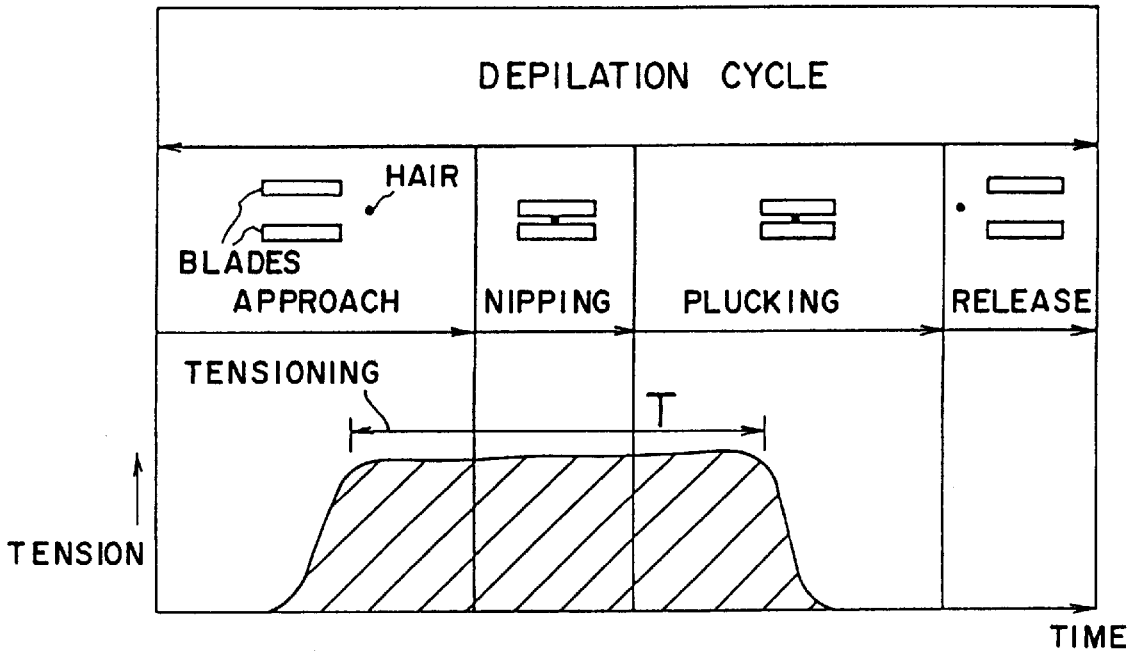
FIG. 27 shows another example of the depilation cycle.

Alternatively, a constant tension may be continuously applied from the end of the approaching period to the beginning of the plucking period, as shown in FIG. 27. This tensioning pattern is achieved by shaping the cam 236 so that the swell 236*b* occupies almost half of the cam periphery and has a flat portion 236*d* in the part that swells the most, as shown in FIG. 28. This flat portion 236*d* achieves the continuous tensioning period T shown in FIG. 27.

In the second embodiment, the fulcrums of the swinging motions of the front and rear tensioning pieces 40 and 41 are always located below the connecting points with the coupling arms 42 and 43, and the front and rear tensioning pieces 40 and 41 swing together with the comb 51 and the roller 54 at a large rotational angle. However, the connecting points 40*b* and 41*b* of the front and rear tensioning pieces 40 and 41 with the coupling arms 42 and 43 may go down below the fulcrums 40*a* and 41*a*, as shown in FIGS. 29 and 30. In FIG. 29, the hair has just been nipped and the tension is released. In FIG. 30, the hair is being plucked, while applying tension to the skin. In this case, the swinging angle of the front and rear tensioning pieces 40 and 41 becomes wider, and the range of tension applied to the skin increases, which can achieve a more reliable contact with the skin, preventing the front and rear tensioning pieces 40 and 41 from slipping on the skin.

In the second embodiment, the front skin supporter 5 and the front tensioning piece 40 are held together by the coupling arms 42, and the rear skin supporter 5 and the rear tensioning piece 41 are held together by the coupling arms 43. However, the skin tensioner 5 and the front and rear tensioning piece 40, 41 may be held separately, as in FIG. 31, which shows the hair is being plucked while the skin is tensioned by the front and rear tensioning pieces 40 and 41. In this example, the coupling arms 42 and 43 hold only the front and rear tensioning pieces 40 and 41, respectively. The front skin supporter 5 has a comb 51 and is monolithically formed with the front face of the connecting frame 50. The rear skin supporter 5 has a roller 54 and is monolithically formed with the rear face of the connecting frame 50. The front end of the front tensioning piece 40 is connected to the base of the coupling arm 43 at a connecting point which is pivotably supported by the comb 51 via an shaft. The rear end of the front tensioning piece 40 is pivotably connected to the tip of the coupling arm 42 by the arrangement of the elongated hole 42*a* and the pin 40*b*. The rear end of the rear tensioning piece 41 is connected to the base of the coupling arm 42 of a connecting point which is pivotably supported by the rear face of the connecting frame 50 via an shaft. The front end of the rear tensioning piece 41 is pivotably connected to the tip of the coupling arm 43 by the arrangement of the elongated hole 43*a* and the pin 41*b*. Other elements of the structure are the same as those in the previous example shown in FIGS. 17 through 21, and the explanation of those similar elements will be omitted. The separation of the front and rear tensioning pieces 40, 41 and the skin supporters 5 can reduce the vibration due to the tensioning cycle.

The front and rear tensioning pieces 40, 41 may be formed monolithically with the coupling arms 42, 43, respectively, by means of a thin hinge formed therebetween, as shown in FIG. 31, instead of forming an elongated hole in the tip of the arm and using a pin to connect the front and rear tensioning pieces and the coupling arm 42, 43, respectively.

Figure 32:
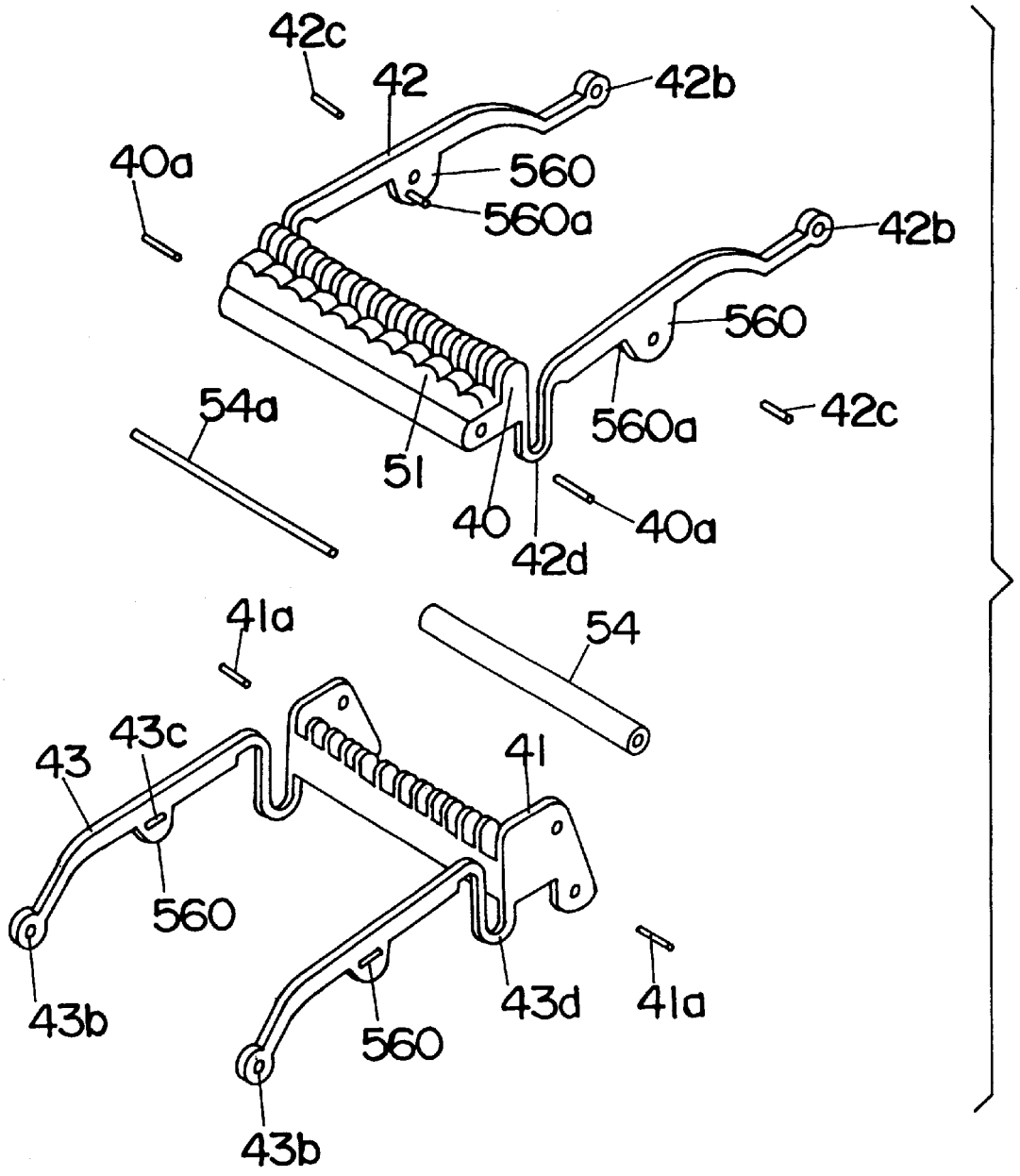
FIG. 32 is an exploded view of a modification of the skin tensioner, in which the coupling arms are monolithically connected to the tensioning piece via elastic hinges.
Figure 33:
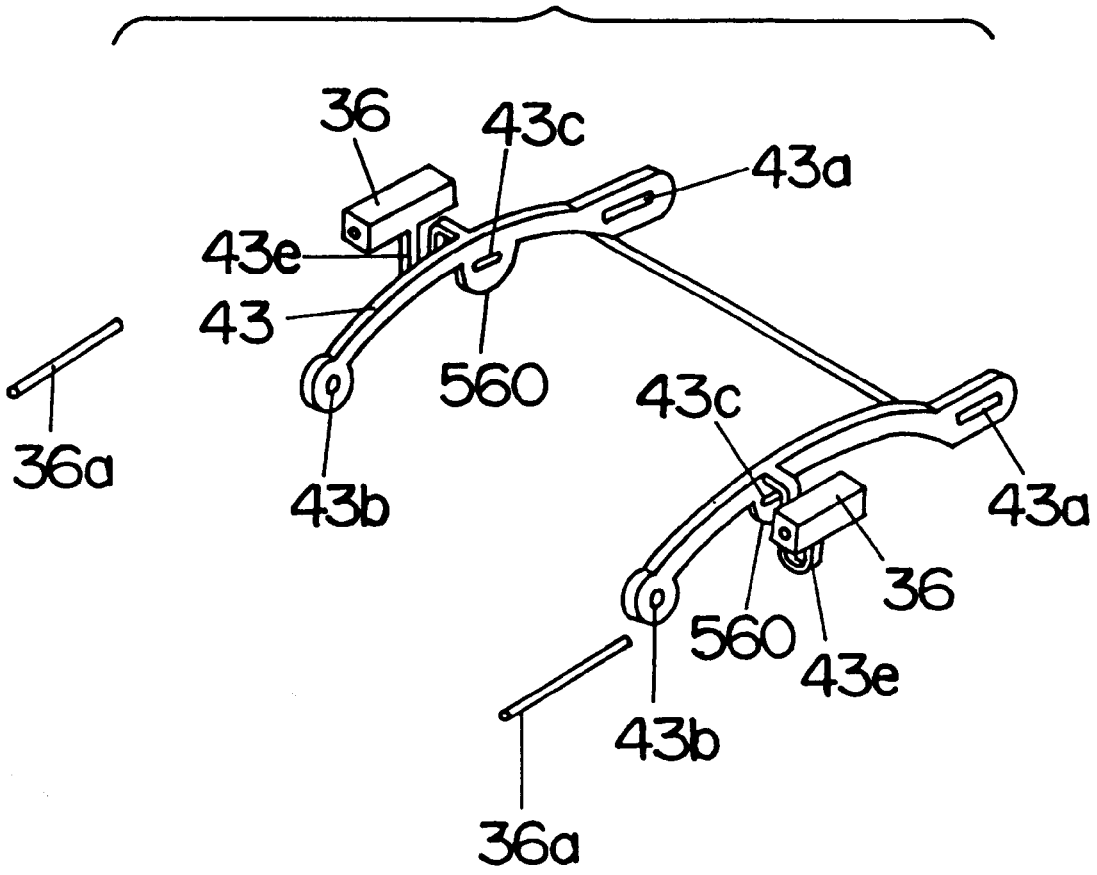
FIG. 33 shows another modification of the skin tensioner, in which additional tensioning pieces are provided on the outer sides of the coupling arms.
Figure 34:
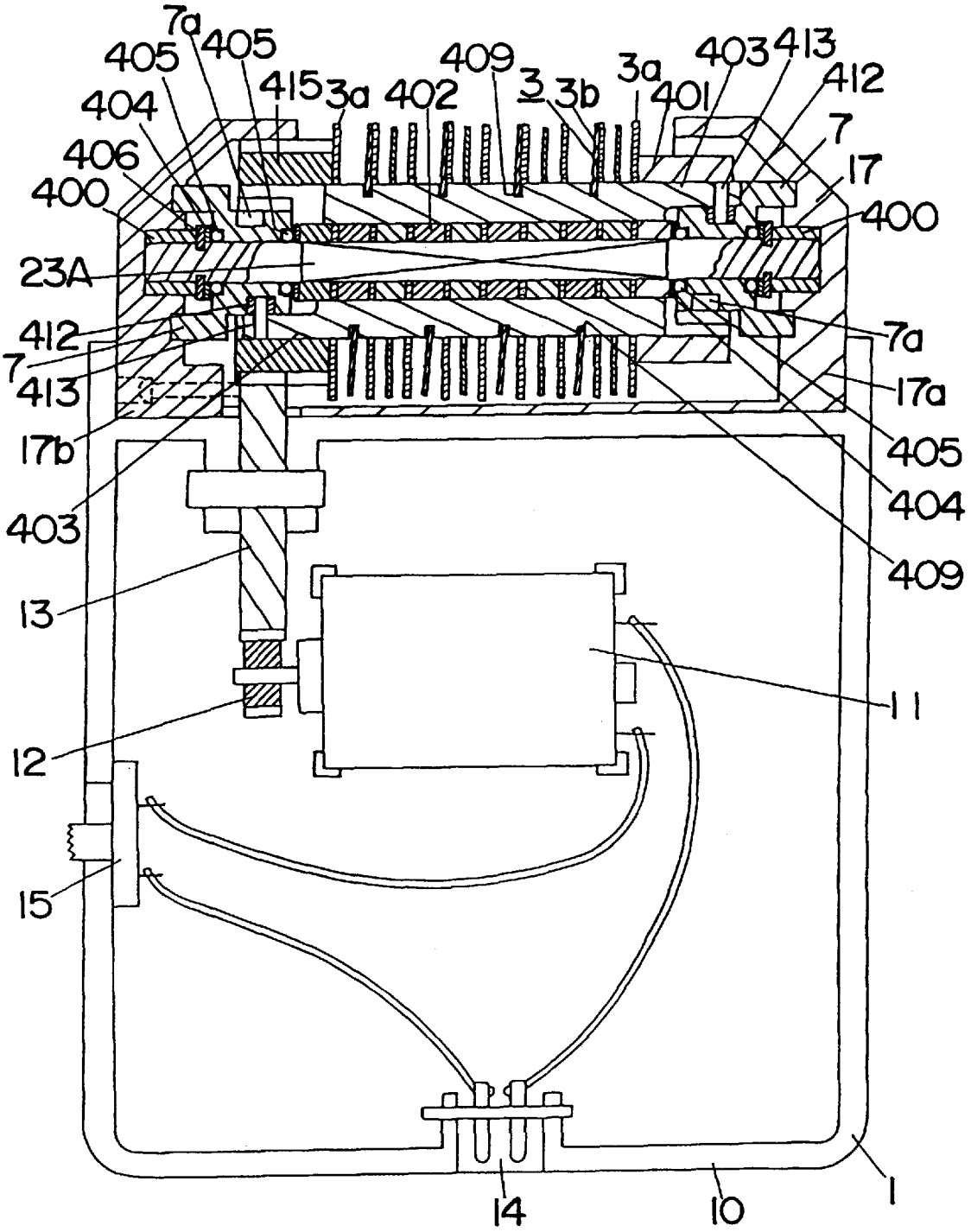
FIG. 34 is a cross-sectional front view of the depilator according to the third embodiment of the present invention.

Furthermore, one of the coupling arms 42 and 43, illustrated in FIG. 21, may be designed as is the one shown in FIG. 32. With this arrangement, the skin is tensioned not only in front of and behind the row of tweezers 3, but also on both sides of the tweezers 3. In the example shown in FIG. 33, an additional tensioning piece 36 is provided on the outer side face of the coupling arm 43 via a hinge 43*e*. The tensioning piece 36 is pivotably supported by the connecting frame 50 via a shaft 36*a*. When the projection 560 is pushed up by the swell 236*b* of the cam 236, the tensioning piece 36 pivots about the shaft 36*a* in the direction away from the depilation block 2, thereby tensioning the skin outwardly beside the tweezers 3.

Third Embodiment

FIGS. 34 through 37 illustrate the depilator according to the third embodiment of the present invention. In the first and second embodiment, a cycle of depilation is performed during one revolution of the cam 236. In the third embodiment, depilation is performed several times during one revolution of the cam 236.

In the third embodiment, the tweezers 3 include a plurality of disk-like blades, each having swelling portions every 90 degrees in the radial direction. A rectangular rotational shaft 23A penetrates through the center of each disk-like blade so that the swellings portions project from the rectangular rotational shaft 23A in four radial directions. In other words, four rows of tweezers 3 are formed using the disc-like blades. In particular, a plurality of fixed blades 3*a*, which rotates together with the rotational shaft 23A, but do not swing relative to the rotational shaft 23A, and a plurality of movable blades 3*b*, which rotate together with the rotational shaft 23 and swing about the rotational shaft 23A, are alternately arranged.

A motor 11 is accommodated in a casing 1, and a row of tweezers 3 are accommodated in a sub-housing 17 which is fixed on the top end of the casing 1. The casing 1 consists of front and rear walls of the housing 10. A power source jack 14, a switch 15, and an intermediate gear 13, which is meshed with a pinion 12 attached to the output shaft of the motor 11, are provided in the casing 1.

The sub-housing 17 consists of a pair of sub-housing walls 17*a* and 17*b*. A pair of driving cams 7 are placed inside the sub-housing walls 17*a* and 17*b*. A rotational shaft 23A penetrates the pair of cams 7, and the rotational shaft 23A is pivotably supported by bearings 400 provided in the inner face of the sub-housing walls 17*a* and 17*b*. A speed reducer 415, which is meshed with the intermediate gear 13, is fixed to one end of the rectangular rotational shaft 23A. A support plate 401 is fixed to the other end of the rectangular rotational shaft 23A. A plurality of fixed disk blades 3*a* are fixed around the rectangular rotational shaft 23A at a predetermined interval via a square collar 402. A plurality of movable blades 3*b* are inserted between any two adjacent fixed blades 3*a*. Four levers 403 extend along the longitudinal direction of the rectangular rotational shaft 23A at every 90 degrees, and each lever 403 penetrates the fixed and movable blades 3*a* and 3*b* of a row tweezers 3. Washers 404 are provided on both end of the rotational shaft 23A. Balls 405 are inserted between the rotational shaft 23A and the driving cams 7 to smooth the rotation of the rotational shaft 23A relative to the driving cams 7 and the support plate 401. Retaining rings 406 are used to retain the driving cams 7 and the support plate 401 in place along the rotational shaft 23A.

The levers 403 are slidable in the axial direction. Two adjacent levers 403 are engaged with one of the cams 7 at one end thereof, the other two levers 403 are engaged with the other cam 7 at the other end thereof. A pin 413 having a roller 412 extending from the engaging end of the lever 403, is fit into the spiral cam groove 7*a* formed on the outer surface of the driving cam 7.

Figure 35A:
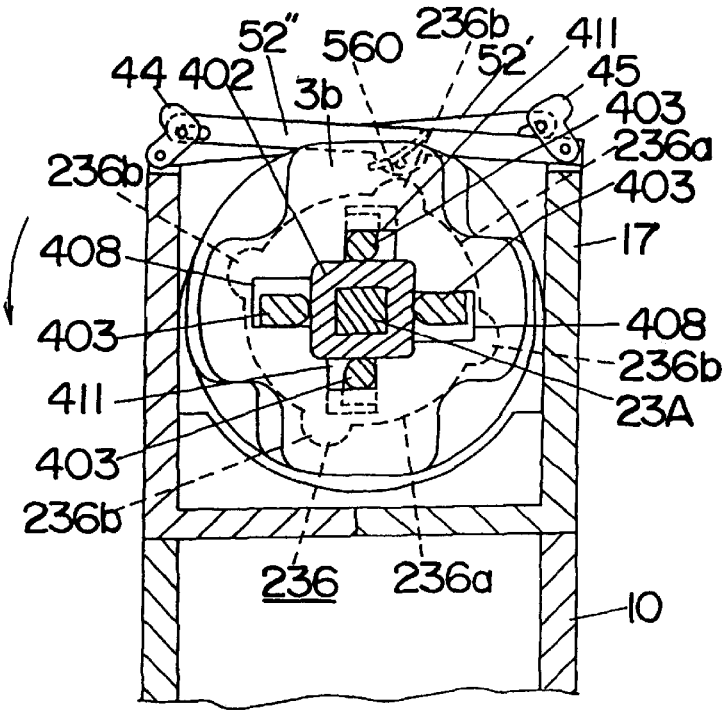
FIG. 35(*a*) is a cross-sectional side view of a major part of the depilator shown in FIG. 34, and FIG. 35(*b*) is a cross-sectional front view of a major part of the same depilator.
Figure 35B:
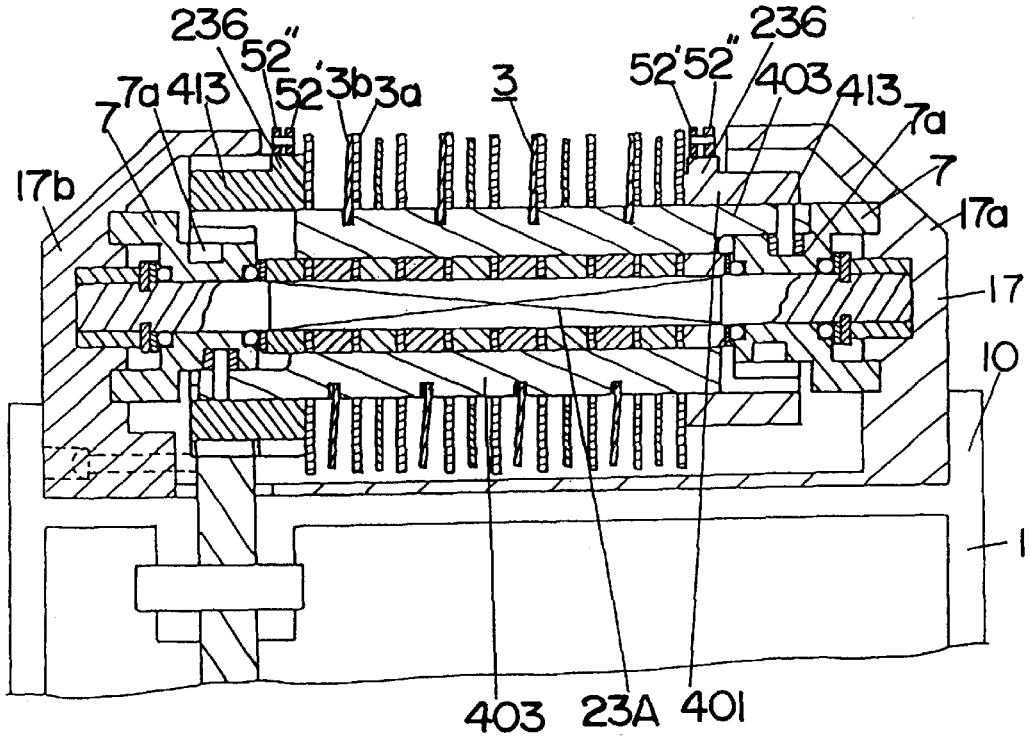
Figure 36:
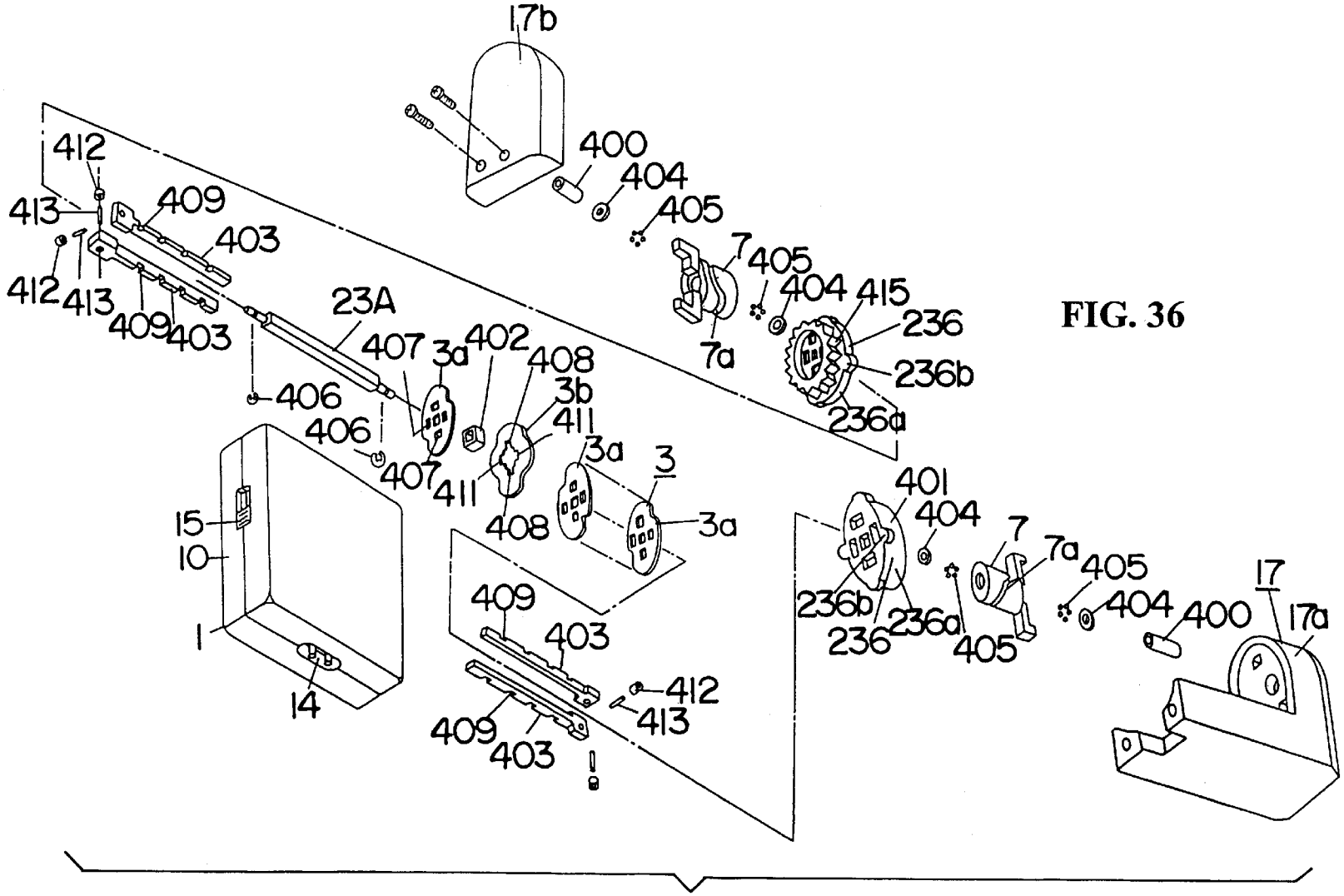
FIG. 36 is an exploded view of a major part of the same depilator.

As shown in FIG. 36, each fixed blade 3*a* has four holes 407, through which the four levers 403 penetrate. Each fixed blade 3*a* is kept perpendicular to the rotational shaft 23A because the center of the fixed blade 3*a* is supported by the square collar 402. On the other hand, the movable blades 3*b* extend radially from the outer surface of the square collar 402, and can swing toward the adjacent fixed blade 3*a*. The center hole of each movable blade 3*b* has a pair of cut-away portions 408 at opposite positions 180 degrees apart, through which two opposite levers 403 penetrate. A pair of indentations 411 are apart from the cut-away portions 408 by 90 degrees, and are engaged with the slots 409 formed on the other two levers 403 so as to have some play. The positional relationship between the cut-away portions 408 and the indentations 411 is clearly shown in FIG. 35A. When the two levers 403 that are engaged with the indentations 411 slide in the axial directions, the movable blade 3*b* swings back and forth. A first set of every other movable blade 3*b* is engaged with two opposite levers 403, and a second set consisting of the rest of the movable blades 3*b* are engaged with the other two levers 403. The levers 403 that penetrate the cut-away portions 408 are simply inserted in the cut-away porions 408. The levers 403 that are engaged with the indentations 411 are inserted in the indentations 411, and then twisted by 90 degrees so that the slots 409 are engaged with the indentations 411.

When the rotational shaft 23A rotates in response to the rotation of the motor 11, the fixed blades 3*a*, the movable blades 3*b*, and the levers 403 rotate together with the rotational shaft 23A. During the rotation, each lever 403 slides in the axial direction according to the displacement along the spiral cam groove 7*a* of the driving cam 7 which is fixed to the sub-housing 17. This sliding motion causes the movable blades 3*b* to swing and contact the adjacent fixed blades 3*a*.

The cam grooves 7*a* of the pair of driving cams 7 are symmetric with each other. The distance between the two cam grooves 7*a* increases toward the opening of the sub-housing 17. As the rotational shaft 23A makes one revolution, the levers 403 reciprocate once one after another. In other words, as the rotational shaft 23A rotates, the lever 403 that slides along the axial direction successively changes. The first set of every other movable blade 3*b*, that is engaged with the two opposite levers 403 that are currently located at the top and the bottom of the rotational shaft 23A, swing and contact the adjacent fixed blades 3*a* in response to the sliding motion of the top lever 403.

The two opposite levers 403 which are fit to the first set of every other movable blade 3*b* are engaged with different driving cams 7. Accordingly, when the rotational shaft 23A rotates 180 degrees, a movable blade 3*b*, that contacted one of the two adjacent fixed blades 3*a*, swings in the opposite direction and comes into contact with the other adjacent fixed blade 3*a*. Thus, during one revolution of the rotational shaft 23A, each of the movable blades 3*b* alternately contacts the adjacent fixed lade 3*a* at the opening of the sub-housing 17.

Once the movable blade 3*b* comes into contact with the adjacent fixed blade 3*a*, the movable blade 36 and fixed blade 3*a* keep contact with each other for a while. Consequently, the hair nipped between the two blades is plucked as the rotational shaft 23A further rotates. When the movable blade 3*b* swings back and separates from the fixed blade 3*a*, the plucked hair flies away due to the centrifugal force.

In the third embodiment, depilation is performed four times during one revolution. Accordingly, the skin tensioner is designed so as to tension the skin according to this depilation cycle. In order to drive the skin tensioner, cams 236 are provided on the support plate 401 and the speed reducer 415 which rotates together with the rotational shaft 23A. A plurality of swells 236*b* (four in the third embodiment) are formed along the periphery of the cam 236, as shown in FIG. 35A.

Tensioning pieces 44 and 45 are linked to the sub-housing 17 at one end, and are connected to the coupling arms 52' and 52", respectively, at the other end by means of elongated holes and pins. The bases of the coupling arms 52' and 52" are pivotably linked to the sub-housing 17. A downward projection 560 is formed in the middle of each coupling arm 52, 52". This projection 560 is engaged with the cam 236, and the tensioning pieces 44 and 45 swing outward via the coupling arms 52' and 52" as the pair of cams 236 rotate.

Figure 37:
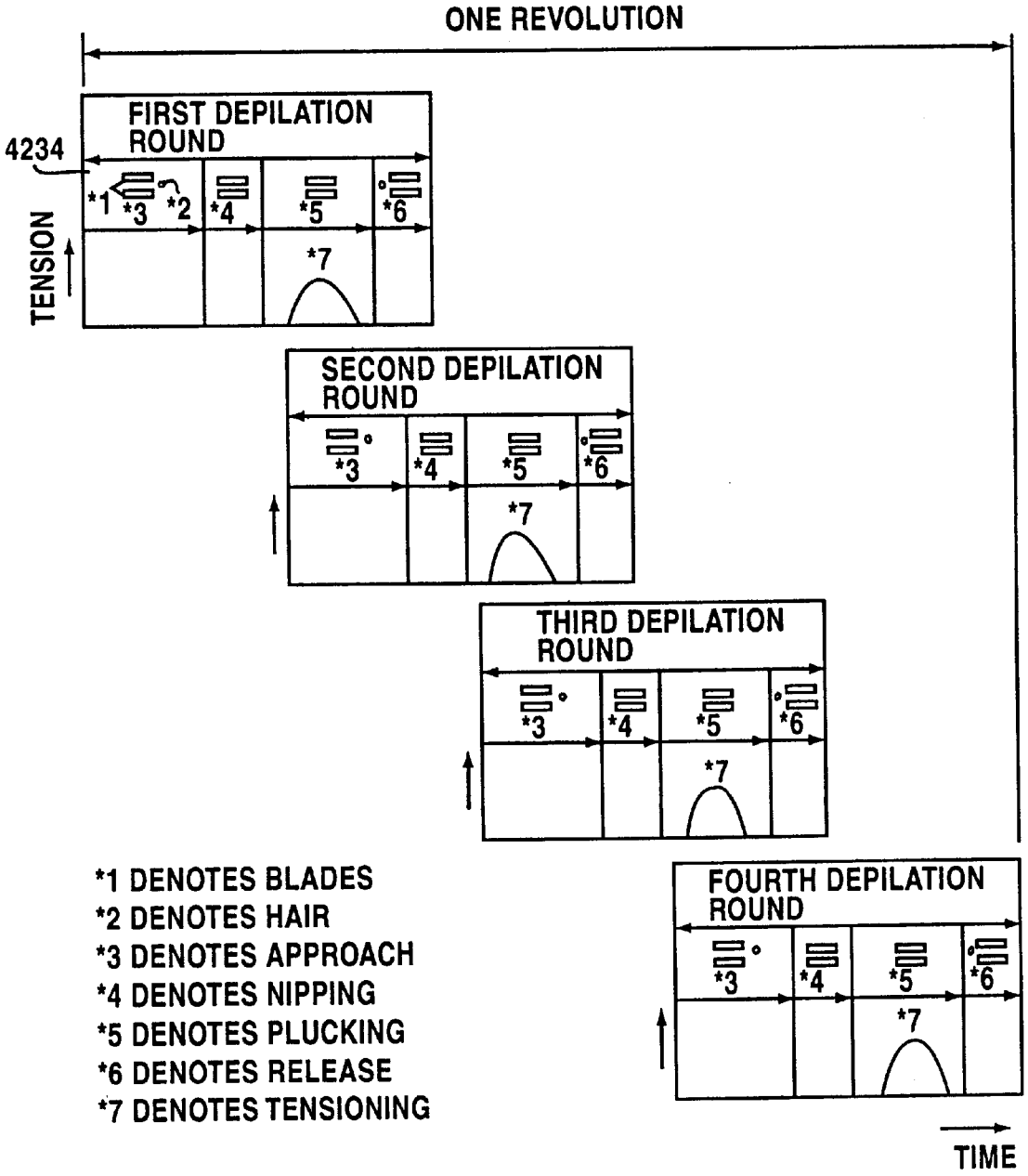
FIG. 37 shows the skin-tensioning cycle, in which depilation is performed four times per rotation.

As has been explained, in the third embodiment, depilation is performed by the fixed and movable blades 3*a* and 3*b* every 90 degrees of revolution. While a row of tweezers are plucking hairs, the next row of tweezers are approaching other hairs. As shown in FIG. 37, the plucking operation of the current row of tweezers overlaps with the approaching period of the next row of tweezers.

The skin is tensioned during the period of plucking hairs of the first depilation cycle, which corresponds to the approaching period of the second depilation cycle. The skin is tensioned only once in each depilation cycle every 90 degrees of revolution. However, in the continuous depilation operation, the skin is tensioned in both the period of approaching the hairs and the period of the hair.

Because the cam 236 has four swells 236*b* every 90 degrees along a circumference thereof, the tensioning pieces 44, 45 swing four times per revolution. When the projection 560 is moving along the indentations 236*a* formed between two swells 236*b*, no tension is applied to the skin.

In the first through third embodiments shown in FIGS. 17 through 37, the tensioning pieces swing back and forth in opposite directions between the initial position and the tensioning position in order to tension the skin with a small driving load, while preventing from being caught in the skin tensioner. This arrangement can effectively reduce pain to the skin caused by plucking hairs against the resistance of the hairs.

Fourth Embodiment

Figure 38:
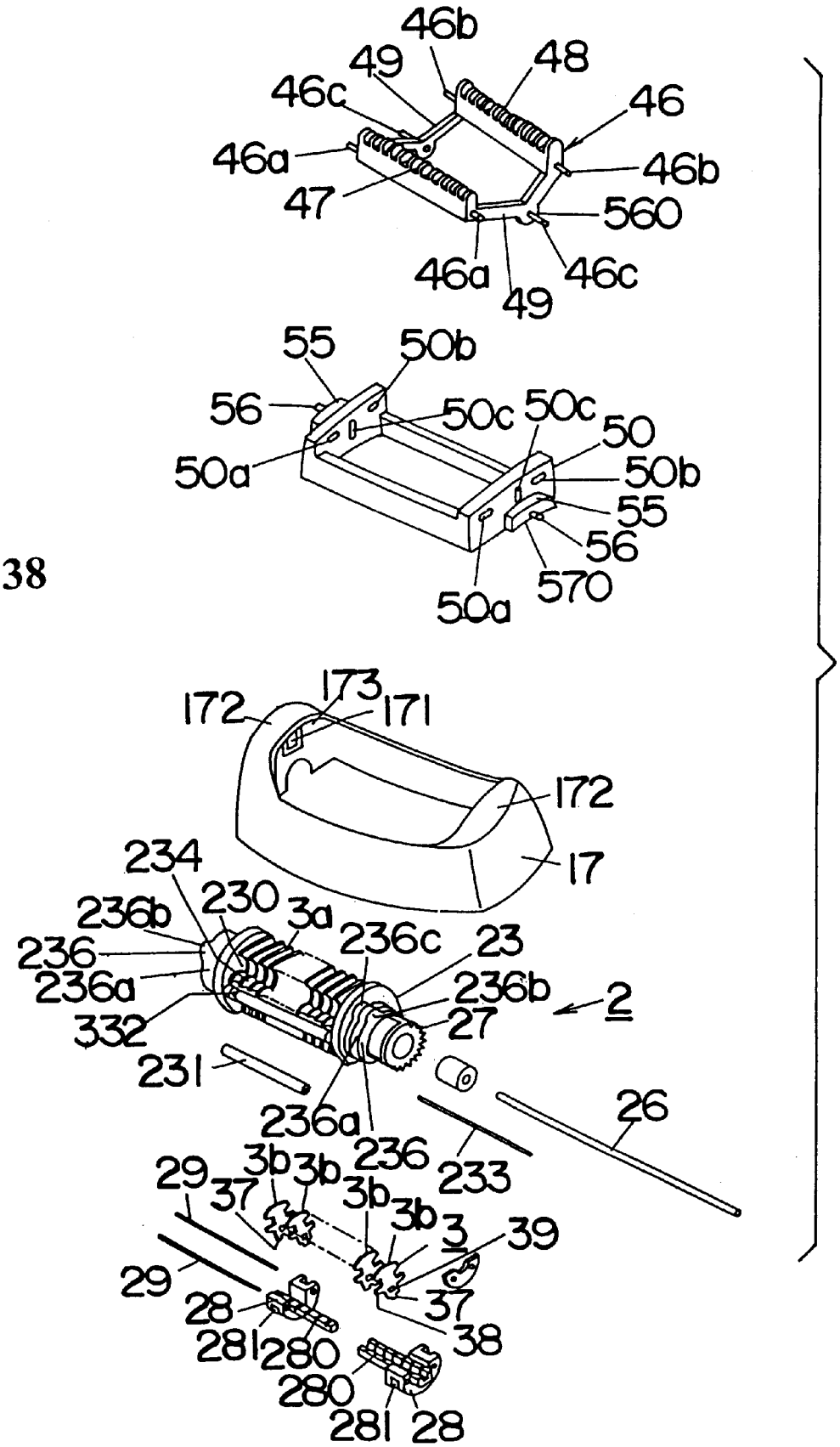
FIG. 38 is an exploded view of the depilation block according to the fourth embodiment of the present invention.
Figure 39:
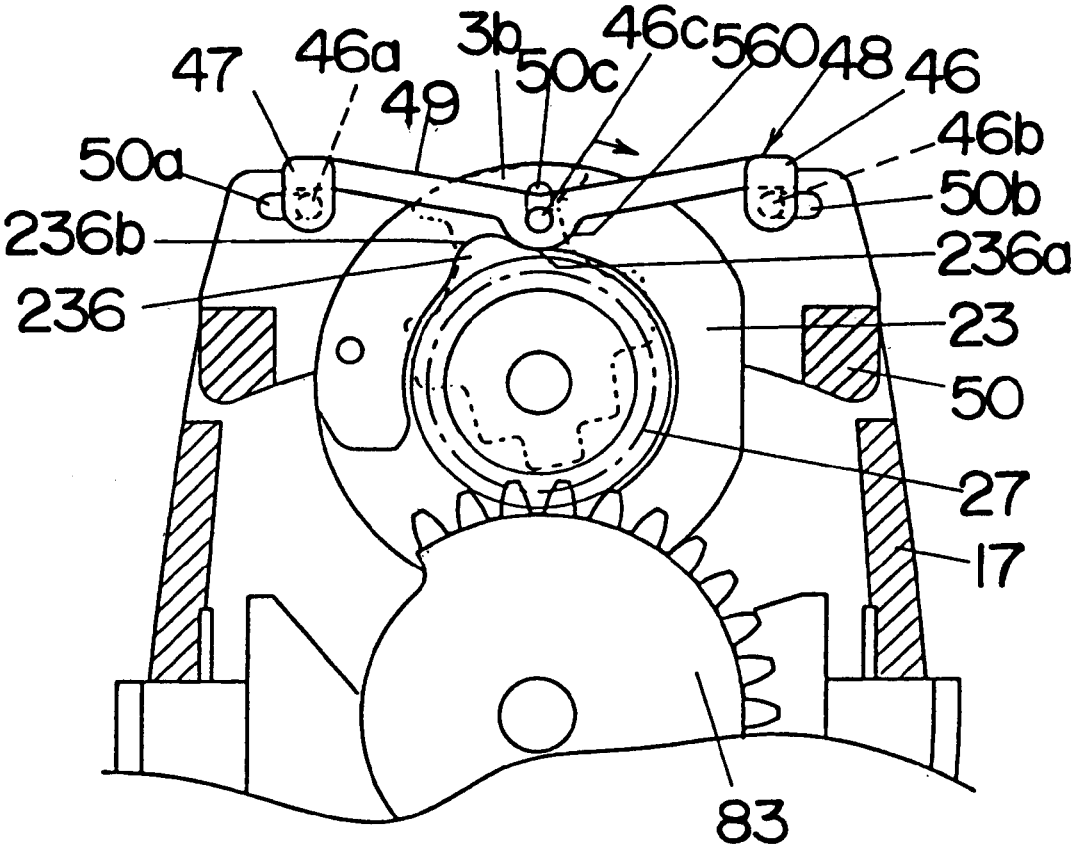
FIG. 39 illustrates the top portion of the depilator of FIG. 34 in a cross-sectional view, in which a hair is nipped while the skin is not tensioned.
Figure 40:
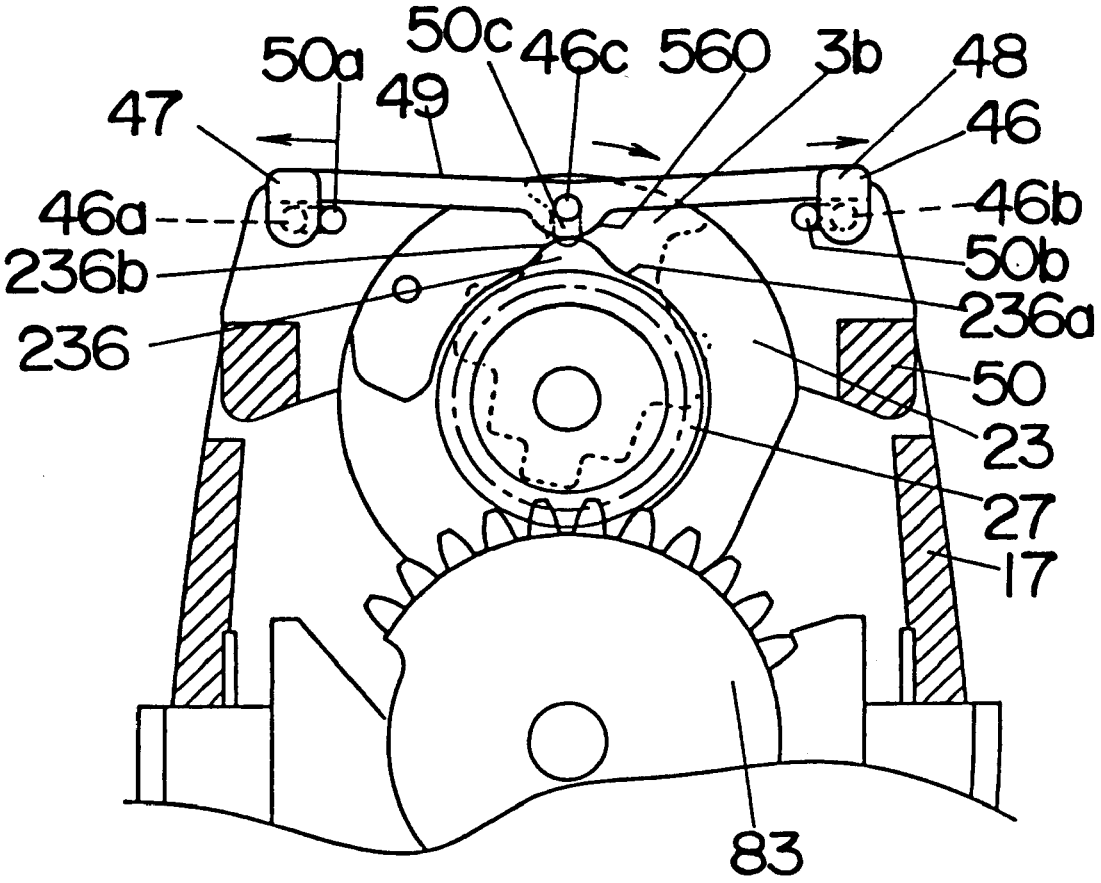
FIG. 40 illustrates the top portion of the depilator of FIG. 34 in a cross-sectional view, in which the hair is being tweezed while the skin is tensioned.

FIGS. 38 through 40 shows the fourth embodiment of the present invention, in which the tensioning pieces fictionally translate on the skin surface back and forth in the direction parallel to the motion of the depilator. The tweezers 3 and the cam 286 have the same structure as those shown in the second embodiment as illustrated in FIGS. 17 through 21, and therefore, the explanation thereof will be omitted here.

As shown in FIG. 38, the connecting frame 50 has laterally elongated holes 50*a* and 50*b* and a vertically elongated hole 50*c* between them on either side face. A reciprocating skin tensioner 46 comprises a pair of comb-like tensioning pieces 47 and 48 which are connected to the coupling arm 49 at both ends thereof. The coupling arm 49 is a V-shaped elastic hinge, and has a downward projection 560 at the bottom. A boss 46*c* extends outwardly from the side face of the projection 560. Other bosses 46*a* and 46*b* extend outwardly from both ends of the tensioning pieces 47 and 48. The boss 46*c* is fit into the vertically elongated hole 50*c* of the connecting frame 50 so as to be slidable in the vertical direction, while the bosses 46*a* and 46*b* are fit into the laterally elongated holes 50*a* and 50*b* so as to be slidable in the lateral direction, so that the front and rear tensioning pieces 47 and 48 are coupled with the connecting frame 50. Pins may be used in place of the bosses 46*a*, 46*b* and 46*c*.

FIGS. 39 and 40 show the operation of the depilator according to the fourth embodiment. In FIG. 39, tweezers 3 are closed to nip hairs. As the rotating body 23 rotates in the direction indicated by the arrow, the projection 560, which faced the indentation 236*a* of the cam 236 in FIG. 40, comes into contact with the swell 236*b*, and the projection 500 is pushed up, as shown in FIG. 40. In response to the rotation, the bosses 46*a* and 46*b* slide along the laterally elongated holes 50*a* and 50*b*, and the V-shaped elastic hinge of the coupling arm 49 bends outwardly. As a result, the tensioning pieces 47 and 48 frictionally move on the skin in opposite directions to apply a tension to the skin. At this time, the nipped hairs are plucked as the rotating body 23 rotates.

Figure 41:
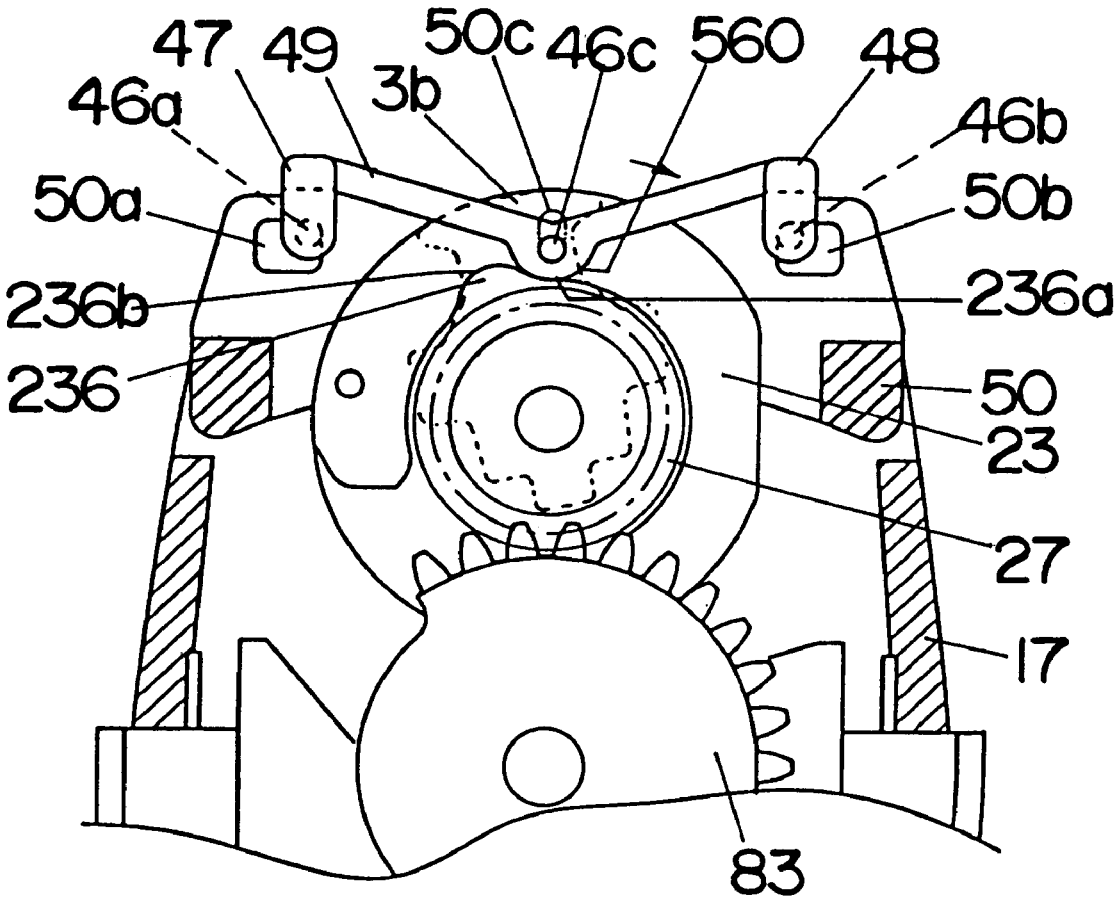
FIG. 41 illustrates an modification of the top portion of the depilator, in which the hair is nipped while the skin is not tensioned.
Figure 42:
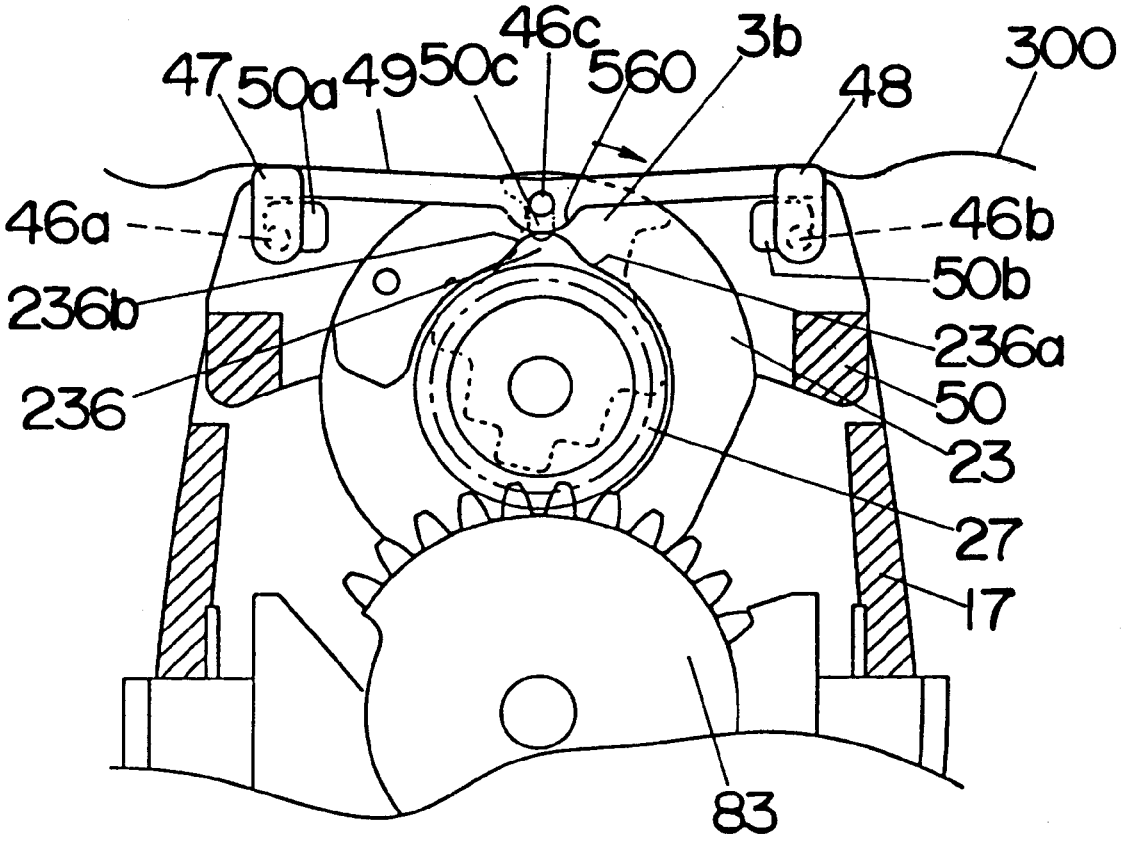
FIG. 42 illustrates the same modification, in which the hair is being tweezed while the skin is tensioned.

The laterally elongated holes 50*a* and 50*b* may have a width greater than the diameter of the bosses 46*a* and 46*b*, as shown in FIG. 41, so that the bosses 46*a* and 46*b* can move in the vertical direction in addition to the lateral direction. This arrangement allows the tensioning pieces 47 and 48 to be floatable and to fit themselves to the skin surface with a soft touch. In addition, the tensioning pieces 47 and 48 become pivotable about the boss 46*c* with respect to the connecting frame 50.

In fourth embodiment, the rotation of the rotating body 23 is transferred directly to the coupling arms 49 and the tensioning pieces 47 and 48. The skin is tensioned during depilation with a simple structure and less power-transfer loss.

The tensioning pieces 47 and 48 reciprocate between the initial position and the tensioning position along the direction parallel to the motion of the depilator, while making hairs stand erect using the comb-like shapes. The depilator of the fourth embodiment can achieve the same effects as those in the previous embodiments, that is, the skin is appropriately tensioned during the depilation in order to reduce pain to the skin and the resistance of hair, without catching the hair in the skin tensioner having a small driving load.

In the fourth embodiment, the downward projection 560 is pushed up and down by the cam 236, thereby reciprocating the tensioning pieces 47, 48 in the direction parallel to the motion of the depilator. However, the oscillator 31 used in the first embodiment and illustrated in FIGS. 1 through 10 may be used in place of the cam 236.

Fifth Embodiment

Figure 43:
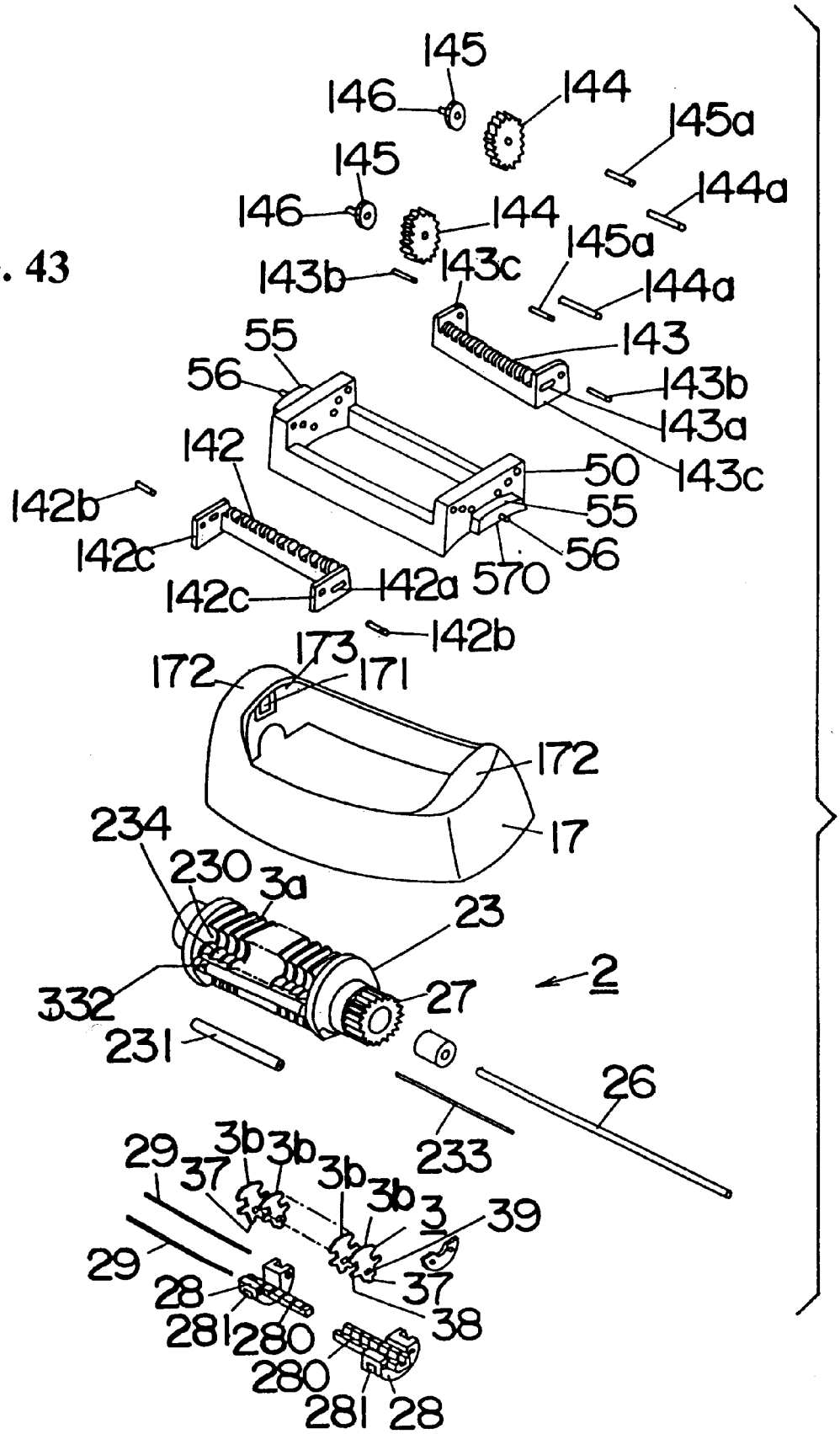
FIG. 43 is an exploded view showing the depilation block and the skin tensioner used in the depilator according to the fifth embodiment of the present invention.
Figure 44:
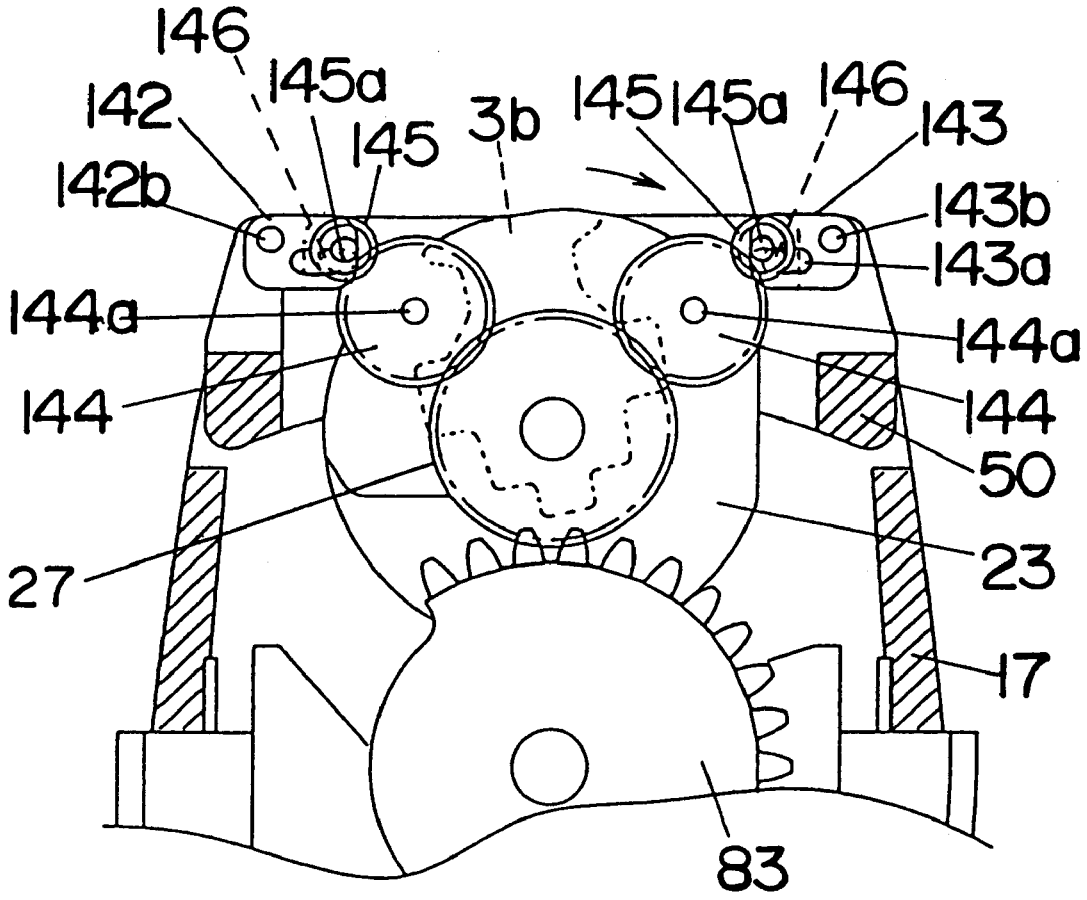
FIG. 44 illustrates the top portion of the depilator of FIG. 43 in a cross-sectional view, in which a hair is nipped while the skin is not tensioned.
Figure 45:
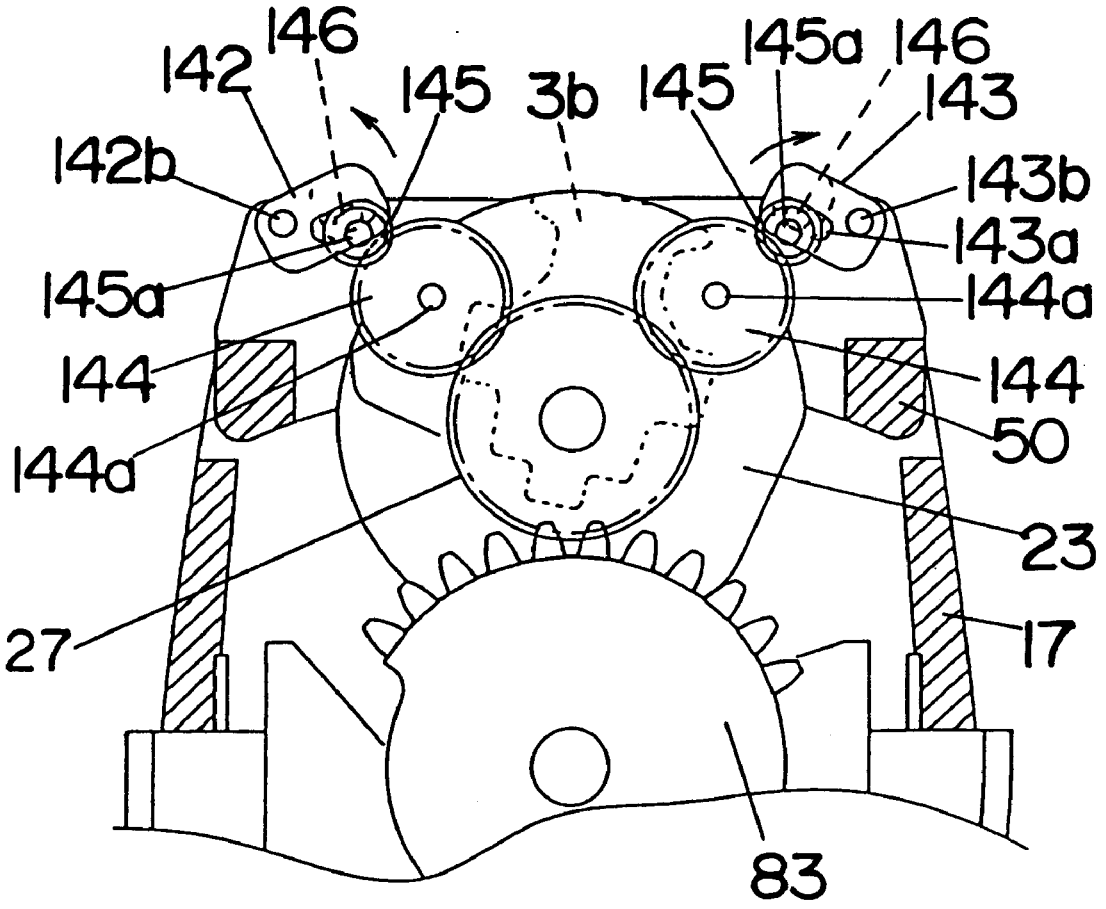
FIG. 45 illustrates the top portion of the depilator of FIG. 43, in which the hair is being tweezed while the skin is tensioned.

FIGS. 43 through 45 shows the depilator according to the fifth embodiment of the present invention. The depilator of the fifth embodiment has a swing type skin tensioner. The structure of the tweezers 3 is the same as those shown in the first through fourth embodiments. However, the driving mechanism for receiving the rotational force of the rotating body 23 and moving the skin tensioner is different.

Arms 142*c* are provided to both ends of a comb-like front tensioning piece 142, while arms 143*c* are provided to both ends of a comb-like rear tensioning piece 143. The ends of the arms 142*c* of the front tensioning piece 142 are pivotably attached to the connecting frame 50 via pins 142*b*. A pair of coupling gears 144 and a pair of cam gears 145 are rotatably supported by the shafts 144*a* and 145*a* onto the side face of the connecting frame 50. One of the coupling gears 144 meshes with one of the cam gears 145 near the front tensioning piece 142, and the other coupling gear 144 meshes with the other cam gear 145 near the rear tensioning piece 143. An eccentric pin 146 projects from each cam gear 145. The eccentric pin 146 of the front cam gear 145 is fit into an elongated hole 142*a* formed in the arm 142*c* of the front tensioning piece 142, while the eccentric pin 146 of the rear cam gear 145 is fit into an elongated hole 143*a* formed in the arm 143*c* of the rear tensioning piece 143. The front and rear coupling gears 144 are meshed with the gear 27 provided to the rotating body 23, as shown in FIG. 44. The rotation of the rotating body 23 is transferred to the front and rear cam gears 145 via the gear 27 and the front and rear coupling gears 144. As each cam gear 145 rotates, the eccentric pin 146 slides along the elongated hole 142*a* (or 143*a* ) and abuts against the end of the elongated hole 142*a* (or 143*a* ), whereby the tensioning pieces 142 and 143 swing outwardly about the shafts 142*b* and 143*b*, respectively, in the direction indicated by the arrow in FIG. 45.

The motion of the tensioning pieces 142 and 143 is associated with the depilation cycle of the rotating body 23. A sufficient amount of force is transferred to the tensioning pieces 142 and 143 by means of a speed reducer 415. The skin can be tensioned twice or more in one depilation cycle by setting the number of gear teeth of the cam gear 145 smaller than that of the gear 27 of the rotating body 23.

In the fifth embodiment, the tensioning pieces 142 and 143 swing back and forth in opposite directions between the initial position and the tensioning position in order to apply an appropriate tension to the skin during the depilation, thereby reducing pain or unpleasant stimulus to the skin. The driving load for driving the tensioning pieces 142, 143 is relatively small, and hairs are not caught in the tensioning pieces 142, 143 because they are combed and made to stand erect by the comb-like tensioning pieces 142, 143 prior to being nipped.

Sixth Embodiment

Figure 46:
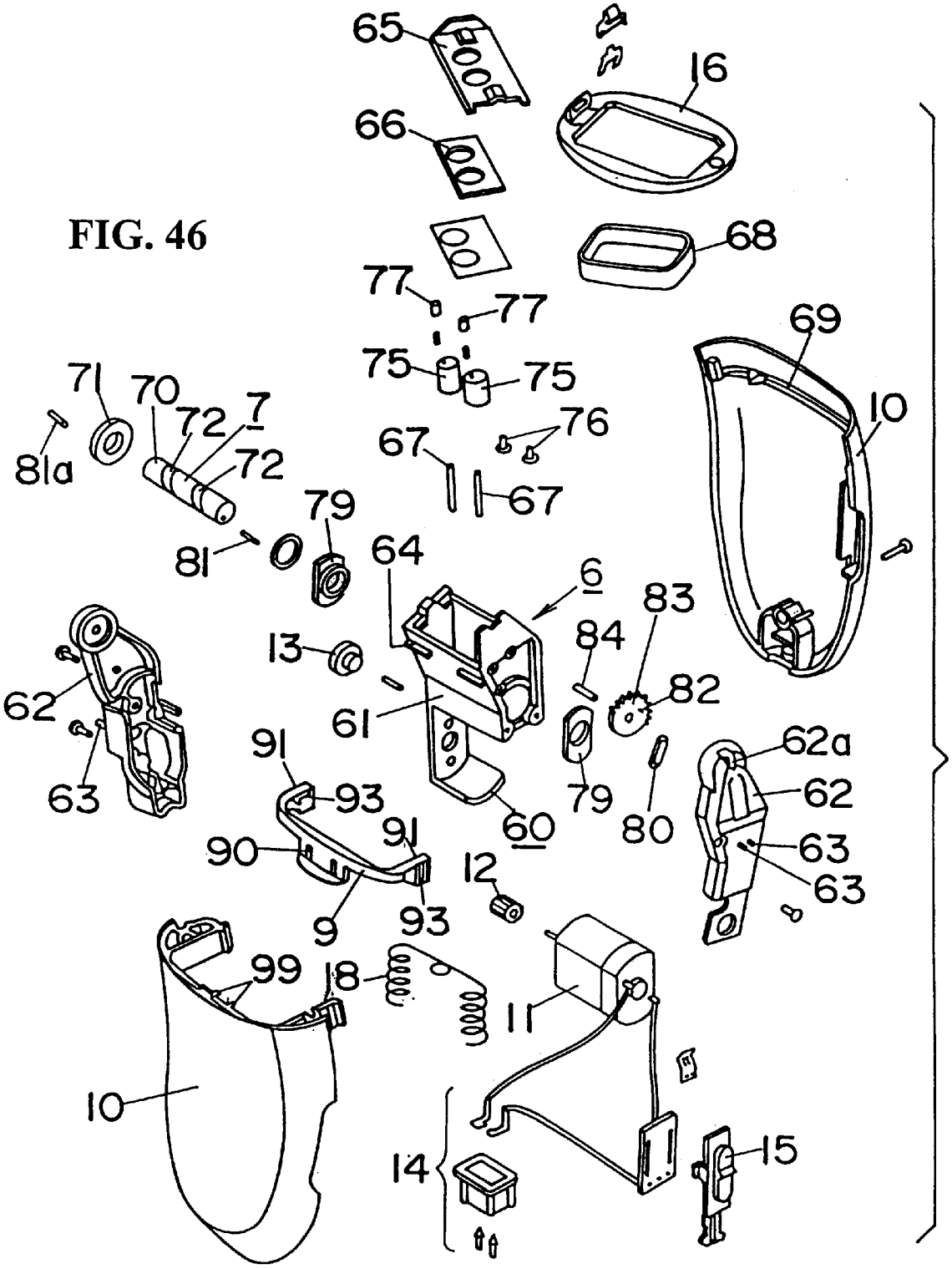
FIG. 46 is an exploded view showing the casing and the inner parts of the depilator according to the sixth embodiment of the present invention.
Figure 47:
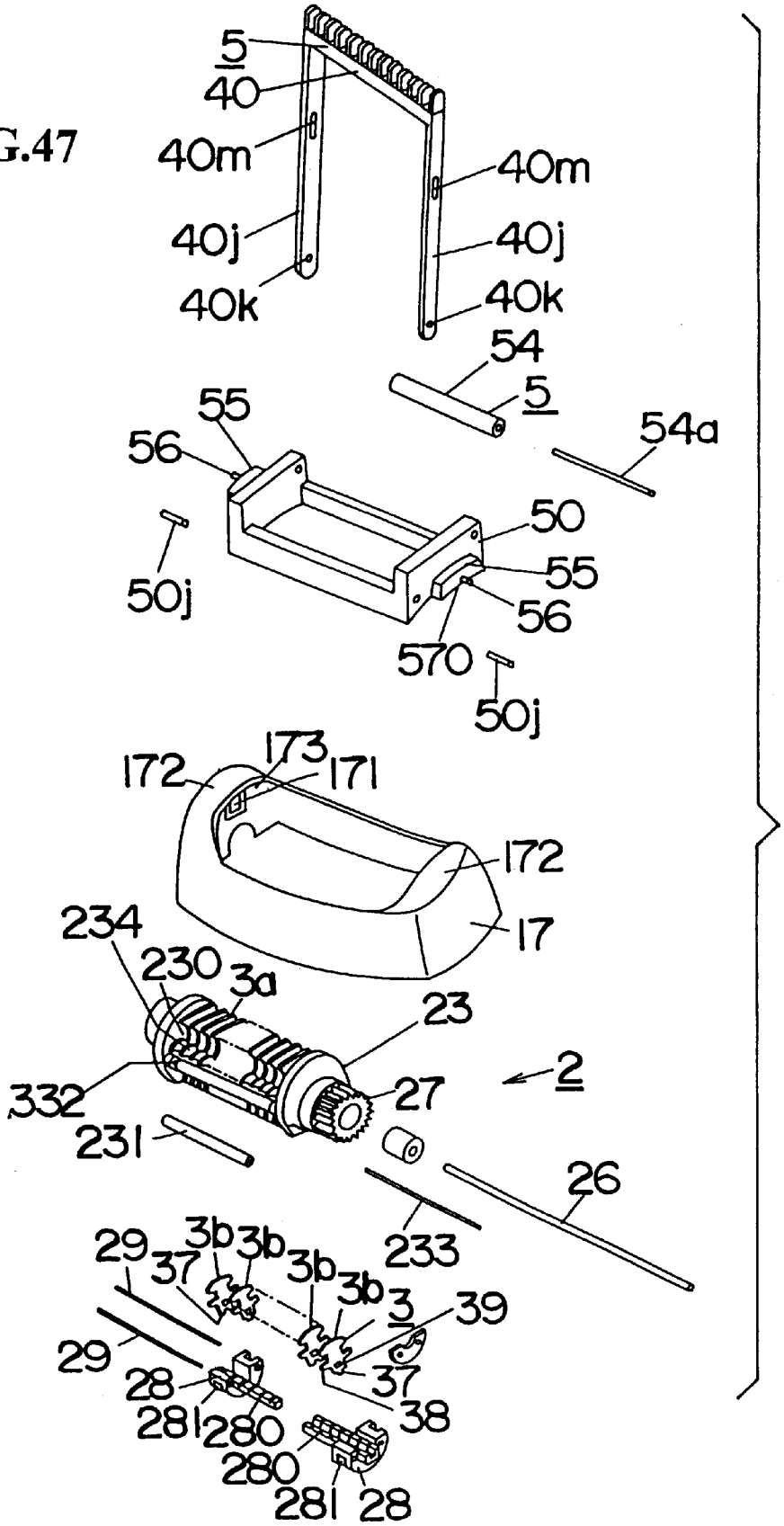
FIG. 47 is an exploded view showing the depilation block and the skin tensioner used in the depilator of the fifth embodiment of the present invention.
Figure 48:
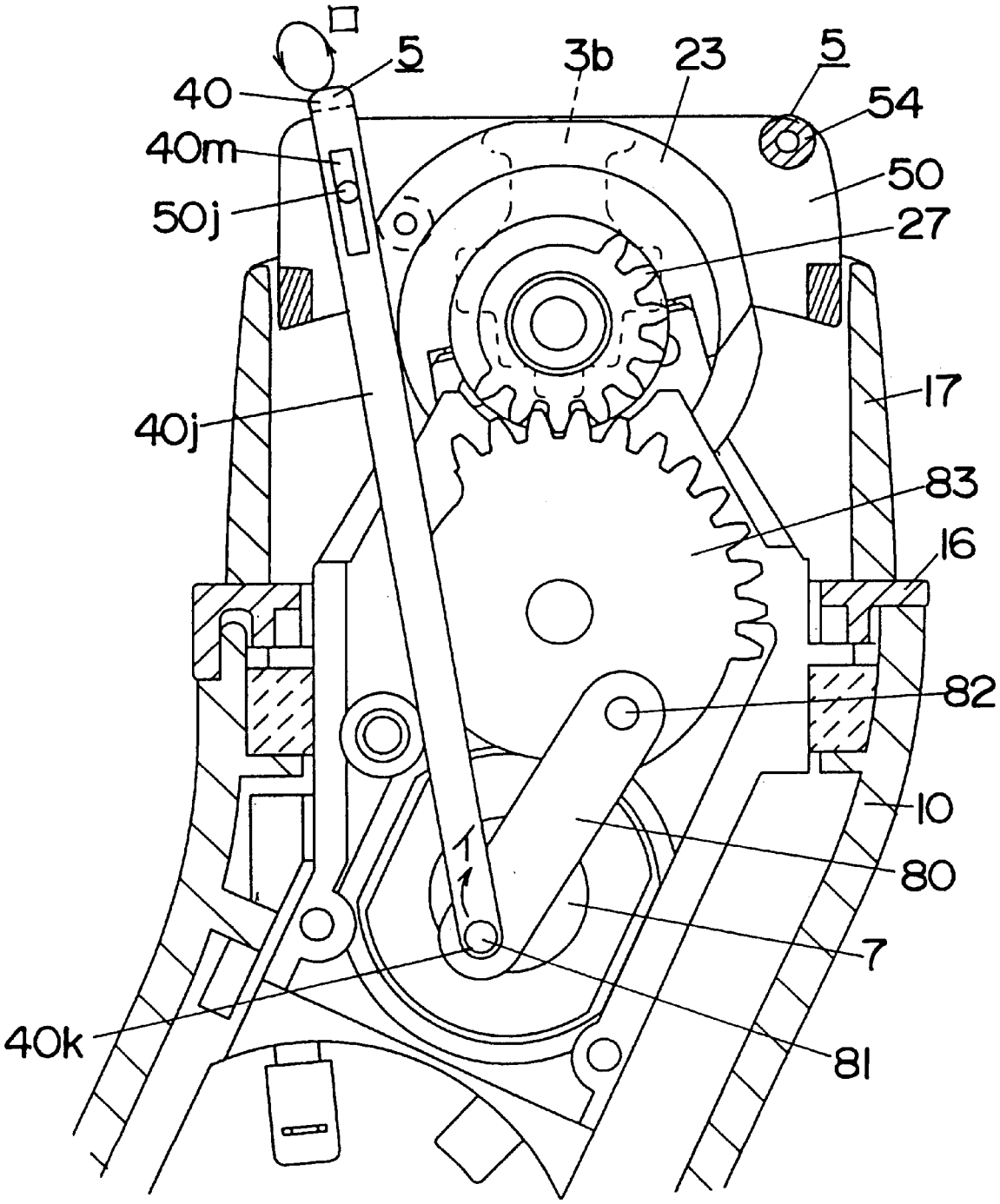
FIG. 48 is an enlarged cross-sectional side view of the driving mechanism for driving the skin tensioner.

FIGS. 46 through 48 show the depilator according to the sixth embodiment of the present invention. In the first through the third and the fifth embodiments, a pair of tensioning pieces swing in opposite directions between the initial position and the tensioning position to apply a tension to the skin, while, in the fourth embodiment, a pair of tensioning pieces translate back an forth (or reciprocate) in opposite directions on the skin surface in the direction parallel to the motion of the depilator. In the sixth embodiment, a single tensioning piece is used, and the single tensioning piece moves along a loop in the vertical direction.

The driving unit 6, illustrated in FIG. 46, is the same as that shown in FIG. 20 and therefore, an explanation thereof will be omitted here. Also, the depilation block 2, illustrated in FIG. 47, is the same as that shown in FIG. 21 and therefore, an explanation thereof will be omitted here. A roller 54, which serves as a rear skin supporter 5, is attached to the rear face of the connecting frame 50 so as to be pivotable about a shaft 54*a*. The front skin supporter 5 holds a comb-like tensioning piece 40. Pivotable arms 40*j* extend downwardly from both ends of the comb-like tensioning piece 40. A hole 40*k* is formed in the bottom end of each arm 40*j*, while an elongated hole 40*m* is formed on the top end of the arm 40*j*. The front skin supporter 5 is inserted in the front part of the space inside the connecting frame 50. Pins 50*j* are inserted into the elongated holes 40*m* of the pivotable arms 40*j* to fix the pivotable arms 40*j* to the connecting frame 50, so that the pivotable arms 40*j* are pivotable about the pins 50*j* and are movable in the vertical direction along the elongated holes 40*m*. Eccentric pins 81 and 81*a* extend from the end surfaces of the cam shaft 70 of the driving cam 7, offset from the center axis. These eccentric pins 81 and 81*a* are the same as those shown in FIG. 20, and are inserted into the holes 40*k* of the pivotable arms 40*j*. As the cam 7 rotates, the eccentric pins 81 and 81*a* rotate about the rotation center of the cam shaft 70, which causes the pivotable arms 40*j* supported by the pins 50*j* in the elongated holes 40*m* to move up and down. The direction in which the eccentric pins 81 and 81*a* rotate is indicated by arrow A in FIG. 48.

At this time, the tensioning piece 40 supported by the tip of the pivotable arms 40*j* moves along a loop in the vertical direction, as indicated by arrow B in FIG. 48. To be more precise, the tensioning piece 40 moves forwardly and upwardly in the first half, and turns backwardly and downwardly in the latter half of the rotation. According to this motion, the skin is pulled forward, while it is pressed, in the first half, and is smoothed out by the tensioning piece 40, while releasing the pressure, in the latter half. If the skin tensioner is provided on the rear end of the connecting frame 50, the tensioning piece 40 moves along a loop in the opposite direction. That is, it moves backwardly and upwardly in the first half, and turns forwardly and downwardly in the latter half.

By changing the positions of the pins 50*j* and the elongated holes 40*m*, the pattern of the loop traced by the tensioning piece 40 can be changed. Thus, tension applied to the skin and the tensioned area can be adjusted.

Although the eccentric pins 81 and 81*a* are provided on the end surfaces of the cam shaft 70 so as to be offset from the center axis, they may be provided on another shaft so as to be offset from a center axis thereof. Furthermore, the eccentric pins 81 and 81*a* may be supported between the tensioning piece 40 and the pin 50*j*. The pin 50*j* may be fixed to the sub-housing 17 or housing 10, instead of being fixed to the connecting frame 50.

As has been described, a skin tensioner, which consists of a pair of tensioning pieces or a single tensioning piece, is provided in the depilator. The pair of tensioning pieces swing or translate back and forth in opposite directions to appropriately tension the skin during the depilation. The single tensioning piece moves along a loop in the vertical direction during the depilation. These arrangement can effectively prevent hairs from being caught in the rotating device and, at the same time, the driving load can be reduced. By applying an appropriate tension to the skin through the swinging, translating, or looping motion, pain or an unpleasant stimulus, caused by plucking a hair, is greatly reduced.

While the present invention has been described by way of an exemplary embodiment, it is understood that many changes and substitutions may be made by those skilled in the art with without departing from the spirit and the scope of the present invention, which is defined by the appended claims.

This application claims priority to Japanese Applications Nos. Hei 9 (1997)-322623, Hei 9 (1997)-259173 and Hei 9 (1997)-40320, each disclosure of which is incorporated by reference in its entity.

What is claimed is:

1. A depilator comprising:

a casing which allows a user to grip said depilator;

a row of tweezers for tweezing hairs; and a skin tensioner which is driven by motor means via a driving force transmitting mechanism in correspondence with movements of said row of tweezers such that said skin tensioner moves from a home position to a tensioning position to produce tension on said user's skin, and moves back from said tensioning position to said home position to release tension.

2. The depilator according to claim 1, wherein said skin tensioner includes a tensioning piece, and wherein said tensioning piece has a pivot shaft and swings about said pivot shaft between said home position and said tensioning position.

3. The depilator according to claim 2, wherein said skin tensioner includes a coupling arm for supporting said tensioning piece, said tensioning piece being connected to a first end of said coupling arm, so that said tensioning piece can swing about said pivot shaft constituting a first fulcrum, a second end of said coupling arm pivots about a second fulcrum, and wherein said pivot shaft of said tensioning piece is positioned farther from said row of tweezers than a connecting point of said tensioning piece and said coupling arm.

4. The depilator according to claim 3, wherein an elongated hole is formed in said first ends of each of said coupling arms, respectively, into which said pivot shafts of said tensioning pieces are inserted so as to be slidable along said elongated hole, and wherein when a driving force is applied to said coupling arm, said tensioning pieces swing about said first and second fulcrums, respectively.

5. The depilator according to claim 3, wherein said skin tensioner includes said coupling arm for supporting said tensioning piece, said tensioning piece being connected to a first end of said coupling arm so that said tensioning piece can swing about a first fulcrum, a second end of said coupling arm pivots about a second fulcrum, and wherein a point of application for driving said coupling arm is located in a middle of said coupling arm between said first end and said second end.

6. The depilator according to claim 3, wherein said skin tensioner includes said coupling arm for supporting said tensioning piece, and wherein said tensioning piece is formed monolithically with said coupling arm, via an elastic hinge formed between said tensioning piece and said coupling arm, whereby said tensioning piece can swing about said first fulcrum when a driving force is applied to said coupling arm, while a second end of said coupling arm pivot about said second fulcrum.

7. The depilator according to claim 2, wherein said row of tweezers comprise a depilation block that any one of reciprocates and rotates, and wherein a driving force is transferred from said depilation block to said tensioning pieces, and said tensioning pieces swing in response to said driving force.

8. The depilator according to claim 2, wherein a driving force is transferred through an oscillator which causes said tensioning piece to swing via said coupling arm.

9. The depilator according to claim 1, wherein said skin tensioner includes a tensioning piece which slides back and forth on a surface of said user's skin in opposite directions parallel to a direction in which said depilator moves.

10. The depilator according to claim 9, wherein said skin tensioner includes a coupling arm, which is formed monolithically with said tensioning piece, with an elastic hinge formed between said coupling arm and said tensioning piece, and wherein an elongated hole is formed in said casing, a pivot shaft of said tensioning piece is inserted in said elongated hole in such a manner that said pivot shaft slides along said elongated hole, whereby said tensioning piece reciprocates when a driving force is applied to said coupling arm.

11. The depilator according to claim 9, wherein said row of tweezers comprise a depilation block which any one of reciprocates and rotates, and wherein a driving force is transferred from said depilation block to said coupling arms which causes said tensioning pieces to slide back and forth.

12. The depilator according to claim 9, wherein a driving force is transferred through oscillators which cause said tensioning pieces to slide back and forth via said coupling arms.

13. The depilator according to claim 1, wherein said skin tensioner has a tensioning piece that moves along a loop in a plane perpendicular to said user's skin.

14. The depilator according to claim 13, wherein an eccentric pin is provided to a pivoting axis of a coupling arm, and an elongated hole is formed in a first end of said coupling arm of said skin tensioner, said first end of said coupling arm being connected to said tensioning piece by a pin inserted into said elongated hole, a second end of said coupling arm being supported by said pivoting axis via said eccentric pin, and wherein as said eccentric pin moves, said tensioning piece moves along a loop.

15. The depilator according to claim 1, further comprising a gear having an eccentric pin, wherein said eccentric pin moves as said gear rotates, and a tensioning piece of said skin tensioner is driven by a motion of said eccentric pin.

16. The depilator according to claim 1, wherein said skin tensioner has a pair of tensioning pieces positioned in front of and behind said row of tweezers along a direction in which said depilator move, and wherein said tensioning pieces tension said user's skin in opposite directions.

17. The depilator according to claim 16, wherein said tensioning pieces both project toward said user's skin at one time.

18. The depilator according to claim 2, wherein said skin tensioner includes a pair of coupling arms connected to each other by elongated holes and pins, and each of said pair of coupling arms has a fulcrum about which said each of said pair of coupling arms pivots.

19. The depilator according to claim 1, wherein said skin tensioner has tensioning pieces which are positioned any one of, in front of behind, and both in front of and behind said row of tweezers along a direction in which said depilator moves, and wherein skin supporters are fixed outside said tensioning pieces in order to help said tensioning pieces tension said user's skin outwardly.

20. The depilator according to claim 1, further comprising a skin supporter for controlling said tension applied to said user's skin by said skin tensioner, and a connecting frame for accommodating said skin tensioner and said skin supporter, wherein a height of said skin supporter, with respect to a top face of said connecting frame of said depilator, is adjustable, whereby a position of said user's skin tensioner relative to said skin supporter is changed in order to control said tension applied to skin.

21. The depilator according to claim 20, wherein said height of said skin supporter with respect to said top face of said connecting frame is adjusted by sliding a handle in a lateral direction.

22. The depilator according to claim 20, wherein a tensioning piece and said skin supporter are placed inside said connecting frame so that said skin supporter is positioned substantially parallel to and outside of said tensioning piece.

23. The depilator according to claim 20, wherein said skin supporter has comb-like projections on a top surface thereof.

24. The depilator according to claim 23, wherein said projections provided on said top surface of said skin supporter are made of an elastic material.

25. The depilator according to claim 23, wherein said projections provided on said top surface of said skin supporter are made of an elastic material, and a bottom portion of said skin supporter is made of a hard material.

26. The depilator according to claim 20, wherein said skin supporter for controlling said tension of a tensioning piece is floatable from said connecting frame of said depilator.

27. The depilator according to claim 1, wherein said row of tweezers repeat a depilation cycle which comprises approaching a hair, nipping said hair, plucking said hair, and releasing said hair after plucking, and wherein said depilation cycle is associated with a skin tensioning cycle.

28. The depilator according to claim 27, wherein said user's skin is tensioned by said skin tensioner at least during a period of said depilation, cycle in which said hair is plucked.

29. The depilator according to claim 27, wherein said user's skin is tensioned by said skin tensioner at least during a period of said depilation cycle in which said hair is approached.

* * * * *